US011064830B2

(12) United States Patent
Jacob

(10) Patent No.: US 11,064,830 B2
(45) Date of Patent: Jul. 20, 2021

(54) GASKETS AND BEVERAGE CONTAINER SYSTEMS AND KITS COMPRISING GASKETS

(71) Applicants: BruMate, LLC, Denver, CO (US); Dylan M. Jacob, Denver, CO (US)

(72) Inventor: Dylan M. Jacob, Denver, CO (US)

(73) Assignee: BruMate, Inc., Dover, DE (US)

( * ) Notice: Subject to any disclaimer, the term of this patent is extended or adjusted under 35 U.S.C. 154(b) by 0 days.

(21) Appl. No.: 16/664,776

(22) Filed: Oct. 25, 2019

(65) Prior Publication Data

US 2020/0339327 A1 Oct. 29, 2020

Related U.S. Application Data

(63) Continuation-in-part of application No. 29/688,974, filed on Apr. 25, 2019, now Pat. No. Des. 904,119, and a continuation-in-part of application No. 29/688,948, filed on Apr. 25, 2019, and a continuation-in-part of application No. 29/688,942, filed on Apr. 25, 2019, now Pat. No. Des. 904,118.

(51) Int. Cl.

| | |
|---|---|
| ***A47G 23/02*** | (2006.01) |
| ***B65D 43/02*** | (2006.01) |
| ***B65D 53/02*** | (2006.01) |

(52) U.S. Cl.

CPC ..... *A47G 23/0266* (2013.01); *B65D 43/0229* (2013.01); *B65D 53/02* (2013.01); *F25D 2331/805* (2013.01)

(58) Field of Classification Search

CPC ..... A47G 23/0266; B65D 43/0229; B65D 53/02; F25D 2331/805

USPC ..... 220/739, 740, 903

See application file for complete search history.

(56) References Cited

U.S. PATENT DOCUMENTS

| | | | | | |
|---|---|---|---|---|---|
| 3,285,455 | A * | 11/1966 | Pewitt | A47G 23/0241 | 215/395 |
| 4,596,370 | A * | 6/1986 | Adkins | B62J 11/00 | 224/414 |
| 4,629,153 | A * | 12/1986 | Marcum | A47G 23/0266 | 108/46 |
| 4,768,354 | A * | 9/1988 | Barnwell | B65D 81/3883 | 220/592.17 |
| 4,964,600 | A * | 10/1990 | Lee | A47G 23/0225 | 248/146 |
| 4,974,741 | A * | 12/1990 | Gustafson | B65D 81/3886 | 206/486 |
| 5,212,963 | A | 5/1993 | McGinnis | | |
| D373,704 | S | 9/1996 | Doxey | | |
| D398,479 | S | 9/1998 | Vultaggio et al. | | |
| D416,198 | S | 11/1999 | Lindsay | | |
| 5,983,662 | A * | 11/1999 | Luetsch | F25D 7/00 | 62/315 |
| 6,189,755 | B1 * | 2/2001 | Wakefield | B60N 3/108 | 224/542 |

(Continued)

*Primary Examiner* — James N Smalley

(74) *Attorney, Agent, or Firm* — Reichel Stohry Dean LLP; Mark C. Reichel; Natalie J. Dean

(57) ABSTRACT

Gaskets and beverage container systems and kits comprising gaskets. An exemplary gasket disclosed herein includes a gasket body comprising a generally cylindrical shape, at least two arcuate flanges positioned within a relative inside of the gasket body, the at least two arcuate flanges extending inward from the gasket body, and at least one gap existing between two arcuate flanges of the at least two arcuate flanges.

17 Claims, 55 Drawing Sheets

(56) References Cited

U.S. PATENT DOCUMENTS

| | | | |
|---|---|---|---|
| D492,546 | S | 7/2004 | Bodum |
| D501,362 | S | 2/2005 | Gauss |
| D534,762 | S | 1/2007 | Gluck |
| D539,155 | S | 3/2007 | Steinmann |
| D539,567 | S | 3/2007 | Webb et al. |
| D541,665 | S | 5/2007 | Druart |
| D551,984 | S | 10/2007 | La Kier et al. |
| D557,140 | S | 12/2007 | Voight et al. |
| D591,556 | S | 5/2009 | Fuller |
| D602,362 | S | 10/2009 | Hering |
| 7,628,285 | B2 | 12/2009 | Salvia |
| D635,019 | S | 3/2011 | Goto et al. |
| D641,591 | S | 7/2011 | Tsukida |
| 8,033,407 | B2 | 10/2011 | Minca |
| D654,762 | S | 2/2012 | Gilbert |
| D660,084 | S | 5/2012 | Gilbert |
| D664,045 | S | 7/2012 | Toh et al. |
| D690,988 | S | 10/2013 | Audette |
| D707,087 | S | 6/2014 | Joy |
| D727,093 | S | 4/2015 | Lapsker |
| D727,688 | S | 4/2015 | Hewitt et al. |
| D728,314 | S | 5/2015 | Carstensen et al. |
| D732,968 | S | 6/2015 | Heisner et al. |
| D750,497 | S | 3/2016 | Gibbs et al. |
| D752,397 | S | 3/2016 | Seiders et al. |
| D761,618 | S | 7/2016 | Lapsker |
| D761,623 | S | 7/2016 | Leimone |
| D761,624 | S | 7/2016 | McLean et al. |
| D770,851 | S | 11/2016 | Herbst |
| D773,296 | S | 12/2016 | Lynd et al. |
| D775,495 | S | 1/2017 | Boroski et al. |
| D779,285 | S | 2/2017 | Seiders et al. |
| D779,891 | S | 2/2017 | Seiders et al. |
| D779,892 | S | 2/2017 | Seiders et al. |
| D780,530 | S | 3/2017 | Seiders et al. |
| D780,531 | S | 3/2017 | Seiders et al. |
| D780,532 | S | 3/2017 | Seiders et al. |
| D780,533 | S | 3/2017 | Seiders et al. |
| D784,763 | S | 4/2017 | Oshana |
| D786,025 | S | 5/2017 | Seiders et al. |
| D786,700 | S | 5/2017 | Schlatter et al. |
| D799,901 | S | 10/2017 | Jacob |
| 10,005,608 | B1 | 6/2018 | Jacob |
| D826,003 | S | 8/2018 | Seiders et al. |
| D829,058 | S | 9/2018 | Seiders et al. |
| D836,983 | S | 1/2019 | Jacob |
| 2013/0126369 | A1 | 5/2013 | Gamelli |
| 2014/0205725 | A1 | 7/2014 | Albanese |
| 2014/0251938 | A1 | 9/2014 | Rose |
| 2018/0086540 | A1* | 3/2018 | Haas ..... B65D 81/3881 |

* cited by examiner

GASKETS AND BEVERAGE CONTAINER SYSTEMS AND KITS COMPRISING GASKETS

PRIORITY & RELATED APPLICATIONS

The present application is related to, claims the priority benefit of, and is a U.S. continuation-in-part application of, U.S. Design patent application Ser. No. 29/688,974, filed Apr. 25, 2019, U.S. Design patent application Ser. No. 29/688,948, filed Apr. 25, 2019, and U.S. Design patent application Ser. No. 29/688,942, filed Apr. 25, 2019. The contents of each of these applications are incorporated herein directly and by reference in their entirety.

The vast majority of the present application contains matter that would be considered as continuation matter in view of the disclosures of the aforementioned U.S. design patent applications and have full support and priority to said U.S. design patent applications.

BACKGROUND

Various beverage containers, such as those used to keep a hot beverage hot and a cold beverage cold, are currently available in the marketplace and are sold in various configurations. However, said containers typically include a container and a lid, such as a travel mug, but are not otherwise configured to hold a secondary beverage container therein, such as a can of a beverage. Various "koozies" are also available in the marketplace, which are generally flexible and surround the bottom and most of the sides of a beverage can. Said koozies do not use a lid, and do not otherwise utilize any other compatible parts.

In view of the foregoing, a beverage system, configured to retain a beverage within a can and a beverage not within a can, with various lids and/or gaskets, and additional adapters to help keep the beverage cold, would be well received in the marketplace.

BRIEF SUMMARY

The present disclosure includes disclosure of a gasket, comprising a gasket body comprising a generally cylindrical shape, at least two arcuate flanges positioned within a relative inside of the gasket body, the at least two arcuate flanges extending inward from the gasket body, and at least one gap existing between two arcuate flanges of the at least two arcuate flanges.

The present disclosure includes disclosure of a gasket, wherein the gasket is configured to be threadably coupled to a threaded portion of a beverage container.

The present disclosure includes disclosure of a gasket, wherein the at least two arcuate flanges are present within the same axial plane.

The present disclosure includes disclosure of a gasket, wherein the at least one gap is defined within part of the gasket body so to form an indention within the gasket body.

The present disclosure includes disclosure of a gasket, wherein the at least two arcuate flanges extend inward from the gasket body further than any other portion of the gasket body.

The present disclosure includes disclosure of a gasket, wherein the at least one gap is defined within part of the gasket body so to form an indention within the gasket body.

The present disclosure includes disclosure of a gasket, wherein the at least two arcuate flanges comprise at least four arcuate flanges, wherein the at least one gap comprises at least four gaps, and wherein each gap of the at least four gaps is present between two adjacent arcuate flanges of the at least four arcuate flanges.

The present disclosure includes disclosure of a gasket, wherein the at least four arcuate flanges are present within the same axial plane.

The present disclosure includes disclosure of a gasket, wherein a first pair of arcuate flanges of the at least four arcuate flanges exist within a first axial plane and wherein a second pair of arcuate flanges of the at least four arcuate flanges exist within a second axial plane, the first axial plane being parallel to the second axial plane.

The present disclosure includes disclosure of a gasket, wherein a first pair of arcuate flanges of the at least four arcuate flanges have a first pair of gaps of the at least four gaps defined or existing therebetween, and wherein the second pair of arcuate flanges of the at least four arcuate flanges have a second pair of gaps of the at least four gaps defined or existing therebetween.

The present disclosure includes disclosure of a gasket, wherein the at least two arcuate flanges comprise at least four arcuate flanges, wherein the at least one gap comprises at least a first gap and at least a second gap, wherein the first gap is defined or existing between a first pair of arcuate flanges of the at least four arcuate flanges exists immediately adjacent to a second gap defined or existing between a second pair of arcuate flanges of the at least four arcuate flanges.

The present disclosure includes disclosure of a gasket, wherein the at least one gap further comprises at least a third gap and at least a fourth gap, wherein the third gap is defined or existing between the first pair of arcuate flanges of the at least four arcuate flanges exists immediately adjacent to a fourth gap defined or existing between the second pair of arcuate flanges of the at least four arcuate flanges.

The present disclosure includes disclosure of a gasket, wherein the at least two arcuate flanges are configured to reversibly engage a beverage can when the gasket is coupled to a beverage container and when the beverage can is at least partially positioned within the beverage container.

The present disclosure includes disclosure of a gasket, forming part of a system or kit, the system or kit further comprising a beverage container, wherein the gasket is configured to be threadably coupled to the beverage container.

The present disclosure includes disclosure of a gasket, comprising a gasket body comprising a generally cylindrical shape, a first set of four arcuate flanges positioned within a relative inside of the gasket body, the first set of at least four arcuate flanges extending inward from the gasket body and present within a first axial plane, a first set of four gaps, each gap of the first set of four gaps existing between two adjacent arcuate flanges of the first set of four arcuate flanges, a second set of four arcuate flanges positioned within the relative inside of the gasket body, the second set of at least four arcuate flanges extending inward from the gasket body and present within a second axial plane, the second axial plane parallel to the first axial plane, and a second set of four gaps, each gap of the second set of four gaps existing between two adjacent arcuate flanges of the second set of four arcuate flanges.

The present disclosure includes disclosure of a gasket, wherein each gap of the first set of four gaps and each gap of the second set of four gaps is defined within part of the gasket body so to form an indention within the gasket body.

The present disclosure includes disclosure of a gasket, forming part of a system or kit, the system or kit further comprising a beverage container, wherein the gasket is configured to be threadably coupled to the beverage container.

The present disclosure includes disclosure of a system or kit, comprising a gasket, comprising a gasket body comprising a generally cylindrical shape, a first set of four arcuate flanges positioned within a relative inside of the gasket body, the first set of at least four arcuate flanges extending inward from the gasket body and present within a first axial plane, a first set of four gaps, each gap of the first set of four gaps existing between two adjacent arcuate flanges of the first set of four arcuate flanges, a second set of four arcuate flanges positioned within the relative inside of the gasket body, the second set of at least four arcuate flanges extending inward from the gasket body and present within a second axial plane, the second axial plane parallel to the first axial plane, and a second set of four gaps, each gap of the second set of four gaps existing between two adjacent arcuate flanges of the second set of four arcuate flanges, and a beverage container, wherein the gasket is configured to be threadably coupled to the beverage container.

The present disclosure includes disclosure of a system or kit, further comprising a lid configured to reversibly engage an internal portion of the beverage container when the gasket is not threadably coupled to the beverage container.

The present disclosure includes disclosure of a system or kit, further comprising an adapter configured to be positioned within the beverage container prior to a beverage can being at least partially positioned within the beverage container, wherein the gasket is configured to be threadably coupled to the beverage container when the beverage can is at least partially positioned within the beverage container.

BRIEF DESCRIPTION OF THE DRAWINGS

The disclosed embodiments and other features, advantages, and disclosures contained herein, and the matter of attaining them, will become apparent and the present disclosure will be better understood by reference to the following description of various exemplary embodiments of the present disclosure taken in conjunction with the accompanying drawings, wherein.

Figure 1:
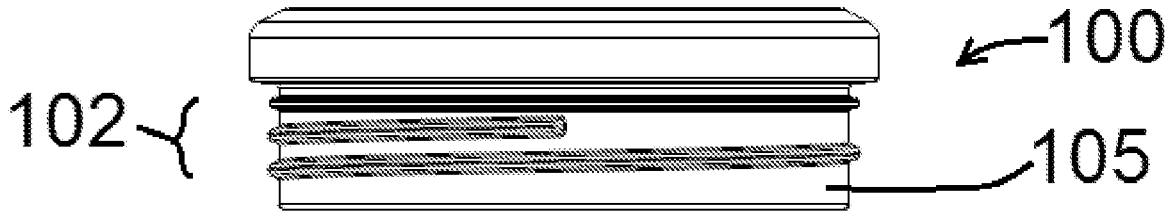
FIG. 1 shows a front view of a gasket, according to at least one embodiment of the present disclosure.
Figure 2:
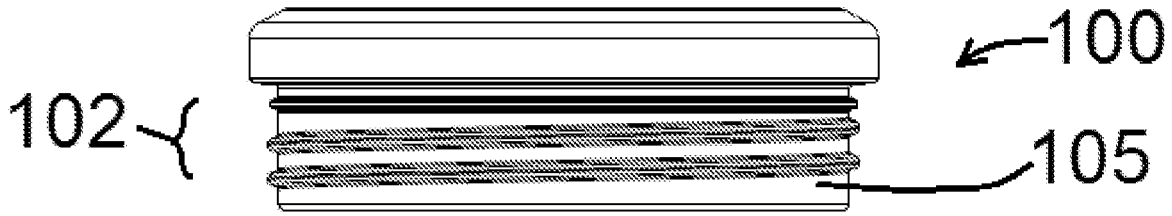
FIG. 2 shows a left side view of a gasket, according to at least one embodiment of the present disclosure.
Figure 3:
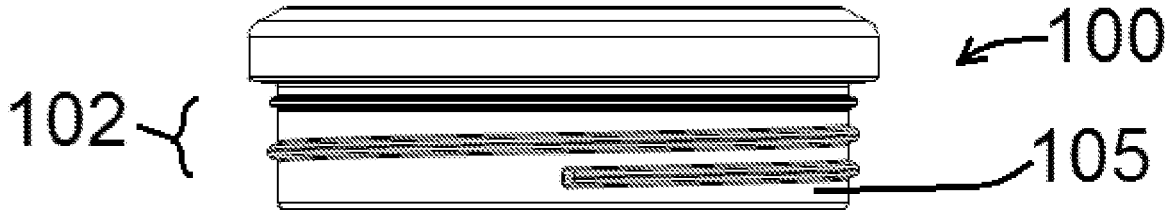
FIG. 3 shows a rear view of a gasket, according to at least one embodiment of the present disclosure.
Figure 4:
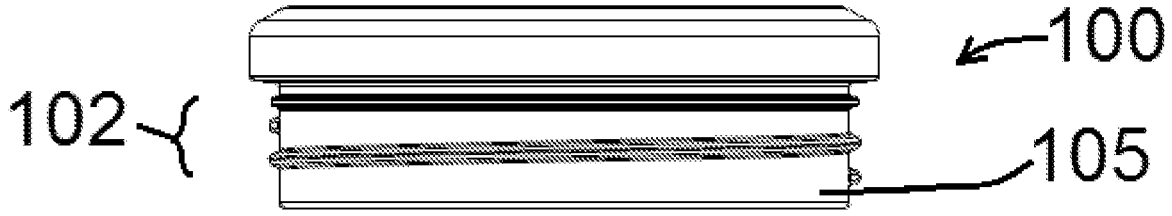
FIG. 4 shows a right side view of a gasket, according to at least one embodiment of the present disclosure.

As such, an overview of the features, functions and/or configurations of the components depicted in the various figures will now be presented. It should be appreciated that not all of the features of the components of the figures are necessarily described and some of these non-discussed features (as well as discussed features) are inherent from the figures themselves. Other non-discussed features may be inherent in component geometry and/or configuration. Furthermore, wherever feasible and convenient, like reference numerals are used in the figures and the description to refer to the same or like parts or steps. The figures are in a simplified form and not to precise scale.

DETAILED DESCRIPTION

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

Figure 5:
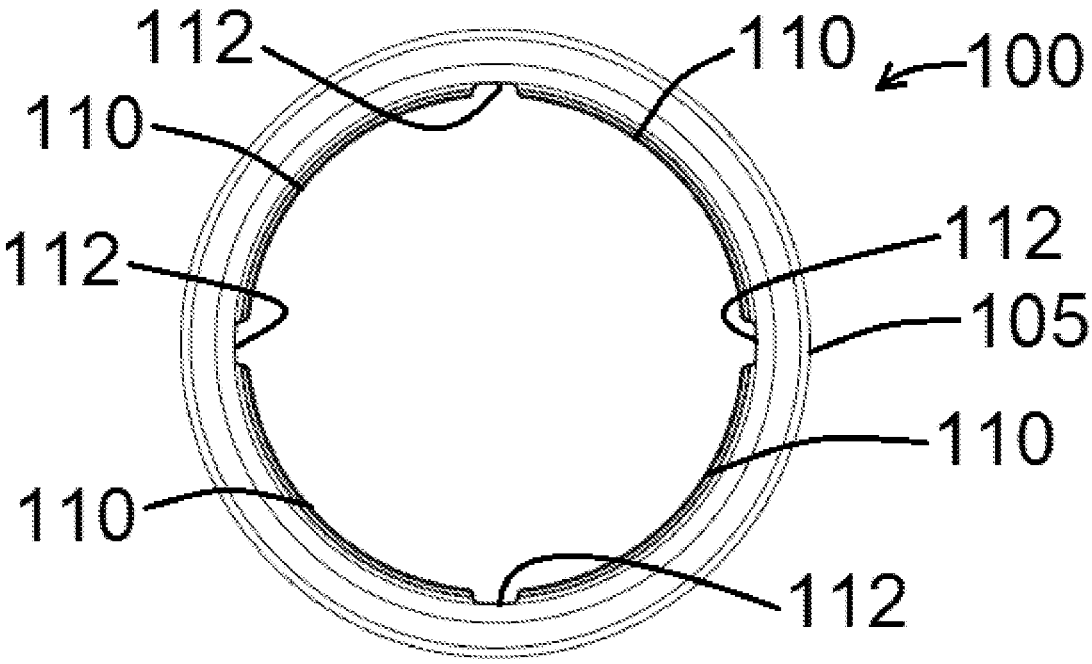
FIG. 5 shows a top view of a gasket, according to at least one embodiment of the present disclosure.
Figure 6:
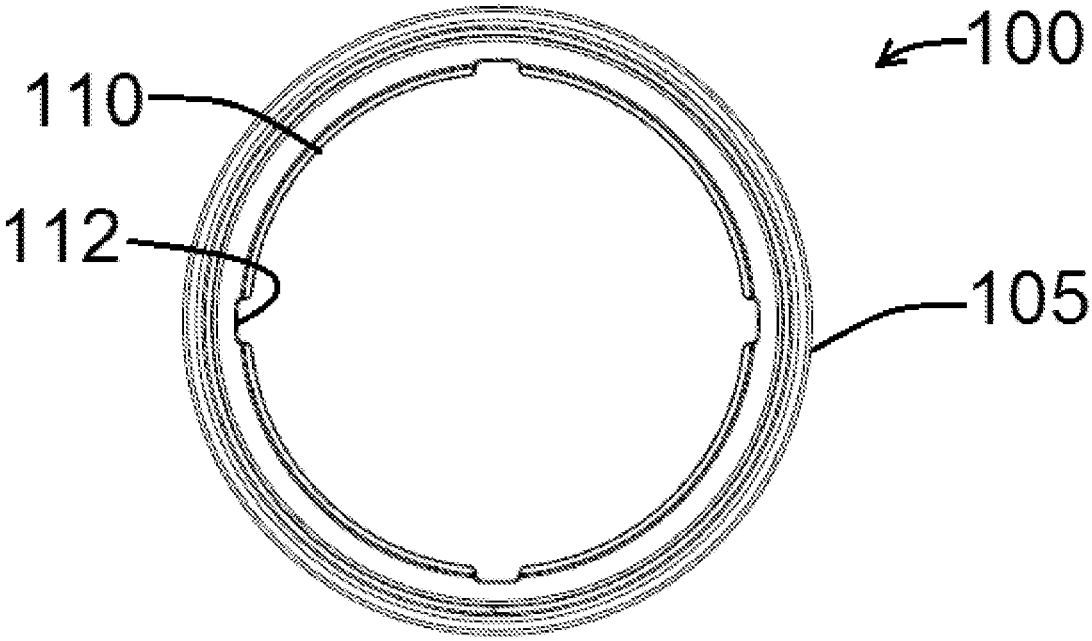
FIG. 6 shows a bottom view of a gasket, according to at least one embodiment of the present disclosure.

An exemplary gasket 100 of the present disclosure is shown in FIGS. 5, 6, 7A, 7B, and 7C. As shown in FIGS. 5 and 6, gasket 100 comprises a general cylindrical shape, namely a round shape having some height/depth, which can be seen in FIGS. 1, 2, 3, 4, 7A, 7B, and 7C, for example. Said general cylindrical shape defines the body 105 of said gasket 100.

Gaskets 100 of the present disclosure comprise a threaded portion 102 on a relative outside of gasket 100 (on a relative outside of body 105), as shown in FIGS. 1, 2, 3, 4, 7B, and 7C, for example, whereby threaded section 102 is configured to couple to a threaded section of an item, such as a beverage container 2900, as shown in FIGS. 29, 30, 31, 32, and 33, for example. When threaded section 102 of gasket 100 is threadably coupled to a threaded portion of a beverage container 2900, such as shown in FIGS. 29, 30, 31, 32, and 33, for example, gasket 100 is reversibly coupled to beverage container 2900.

Figure 7A:
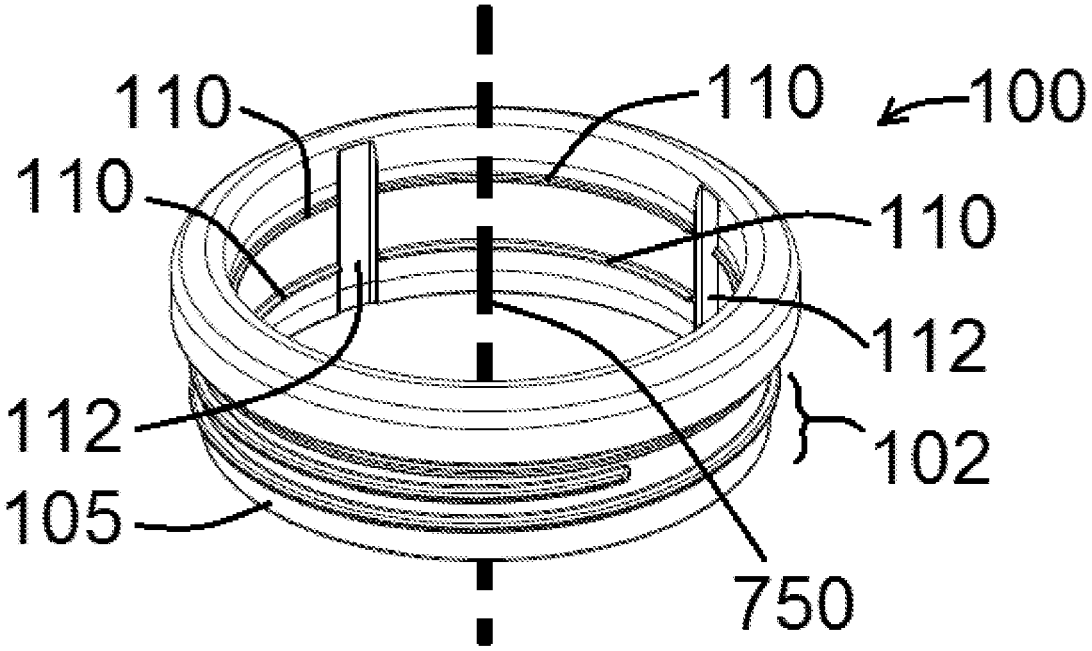
FIGS. 7A, 7B, ad 7C show perspective views of gaskets, according to embodiments of the present disclosure.
Figure 7B:
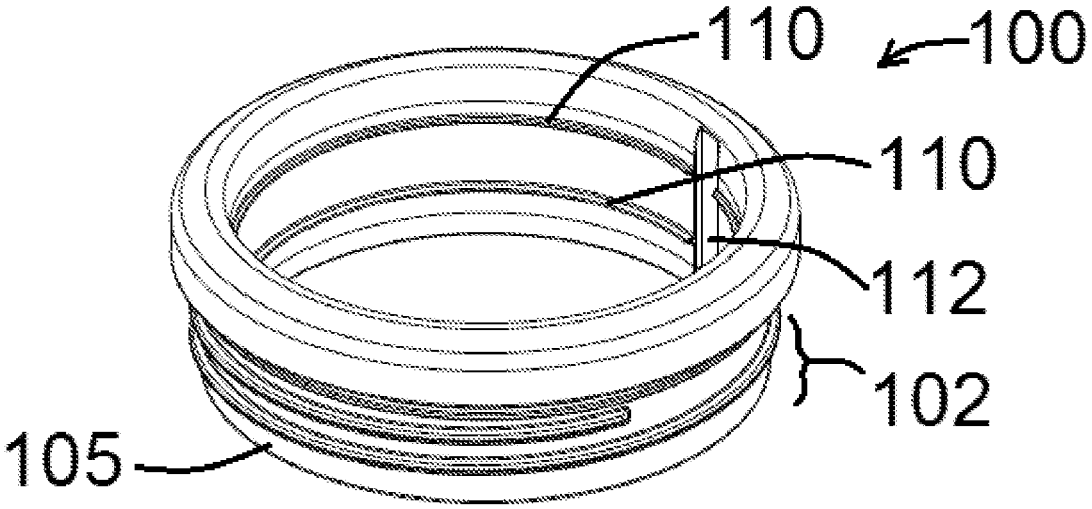
Figure 7C:
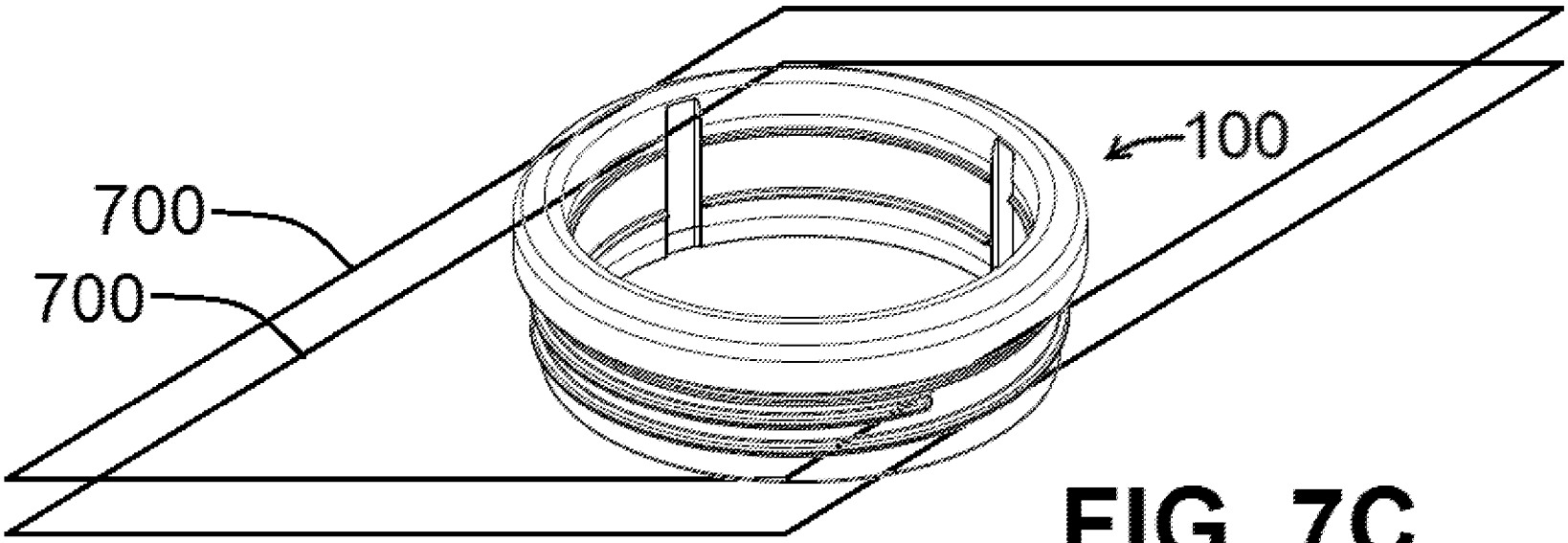
Figure 8:
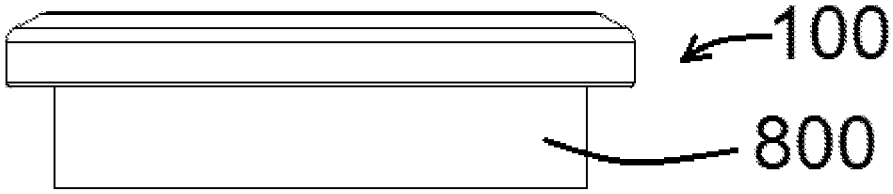
FIG. 8 shows a front view of a non-threaded portion of a gasket, with the threaded portion removed for ease of illustration, according to at least one embodiment of the present disclosure.
Figure 9:
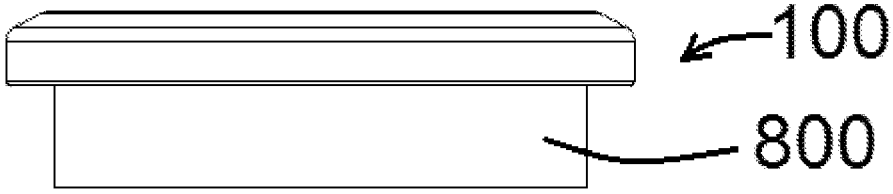
FIG. 9 shows a left side view of a non-threaded portion of a gasket, with the threaded portion removed for ease of illustration, according to at least one embodiment of the present disclosure.
Figure 10:
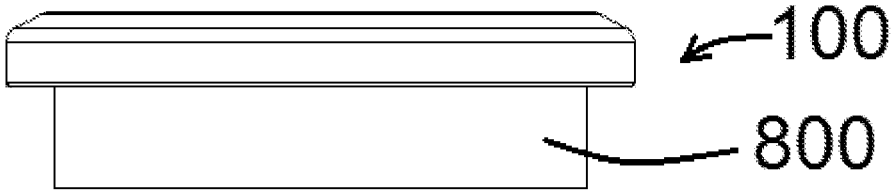
FIG. 10 shows a rear view of a non-threaded portion of a gasket, with the threaded portion removed for ease of illustration, according to at least one embodiment of the present disclosure.
Figure 11:
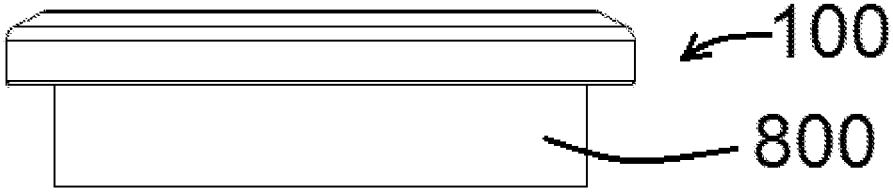
FIG. 11 shows a right side view of a non-threaded portion of a gasket, with the threaded portion removed for ease of illustration, according to at least one embodiment of the present disclosure.
Figure 12:
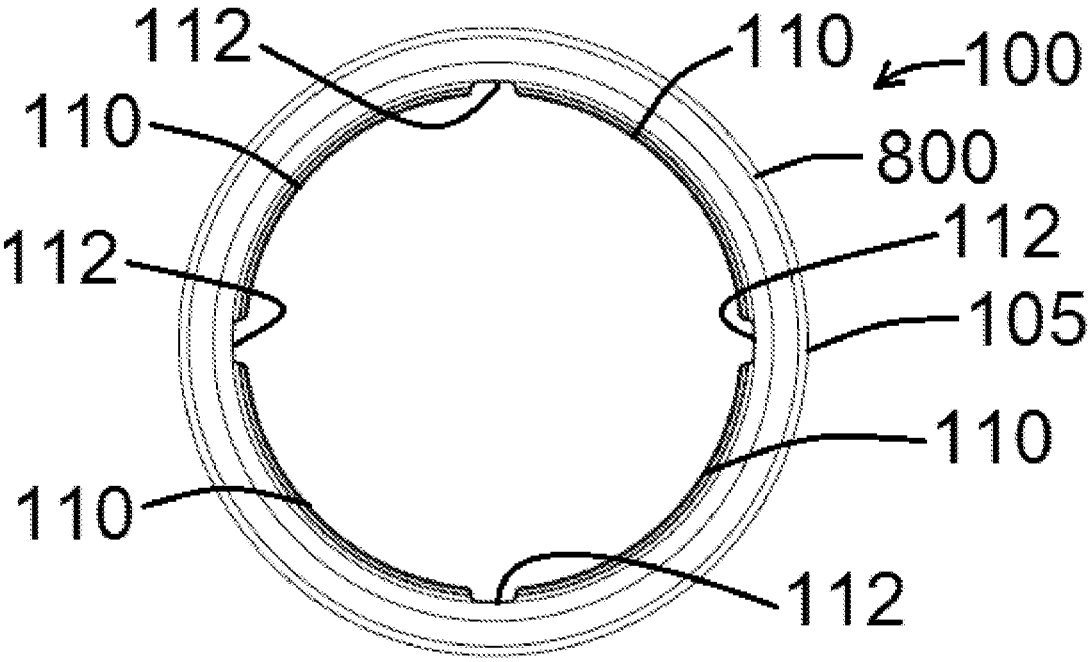
FIG. 12 shows a top view of a non-threaded portion of a gasket, with the threaded portion removed for ease of illustration, according to at least one embodiment of the present disclosure.
Figure 13:
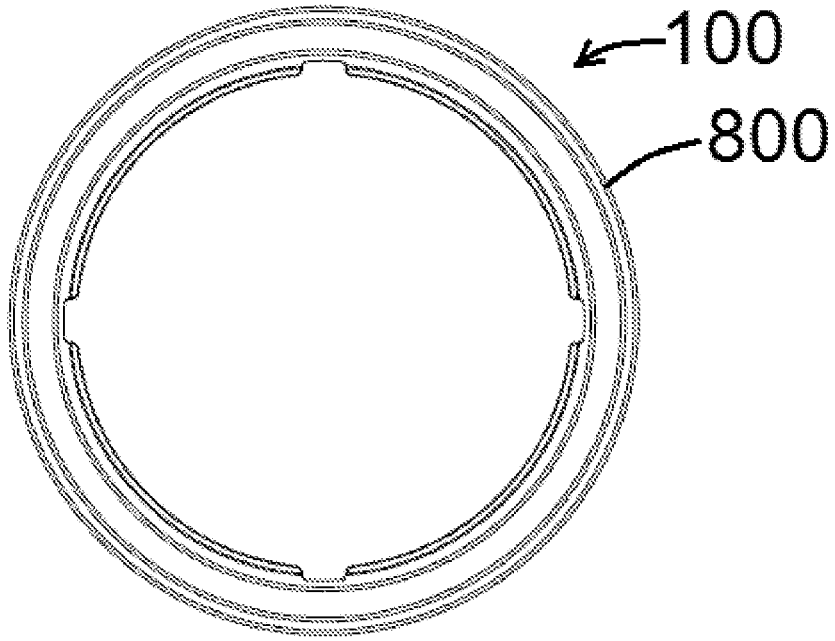
FIG. 13 shows a bottom view of a non-threaded portion of a gasket, with the threaded portion removed for ease of illustration, according to at least one embodiment of the present disclosure.
Figure 14:
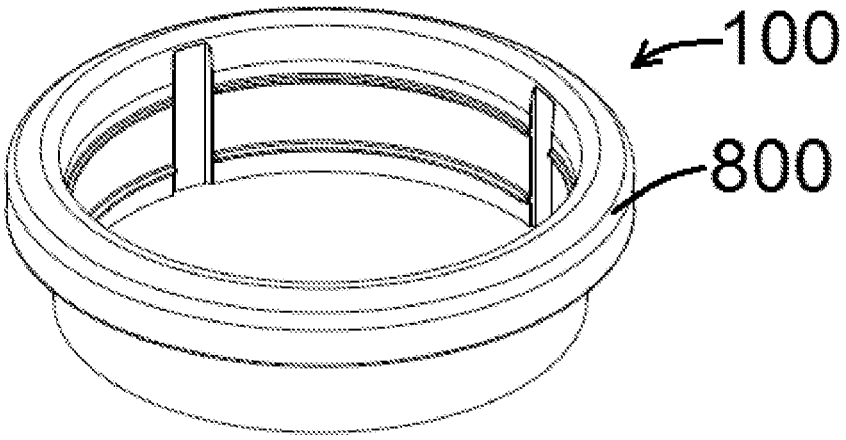
FIG. 14 shows a perspective view of a threaded portion of a gasket, with the threaded portion removed for ease of illustration, according to at least one embodiment of the present disclosure.
Figure 15:
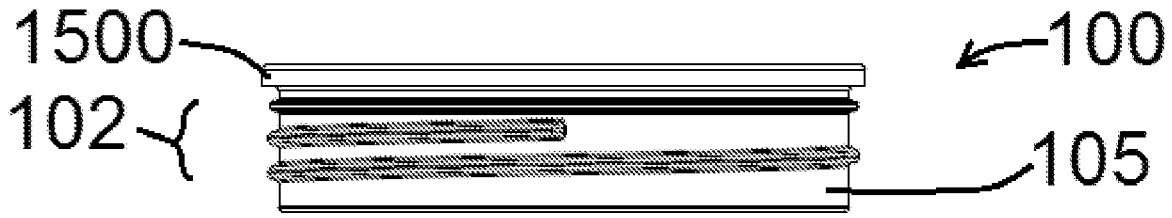
FIG. 15 shows a front view of a threaded portion of a gasket, with the non-threaded portion removed for ease of illustration, according to at least one embodiment of the present disclosure.
Figure 16:
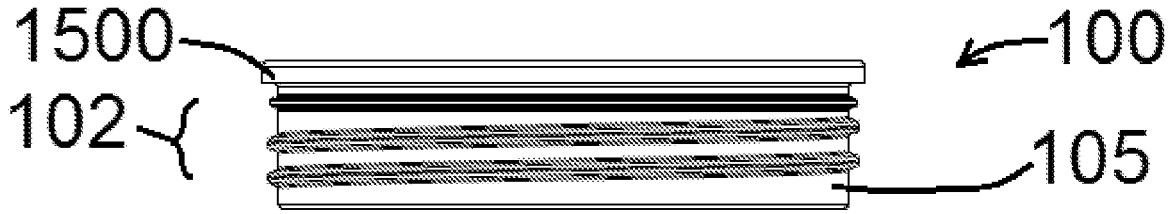
FIG. 16 shows a left side view of a threaded portion of a gasket, with the non-threaded portion removed for ease of illustration, according to at least one embodiment of the present disclosure.
Figure 17:
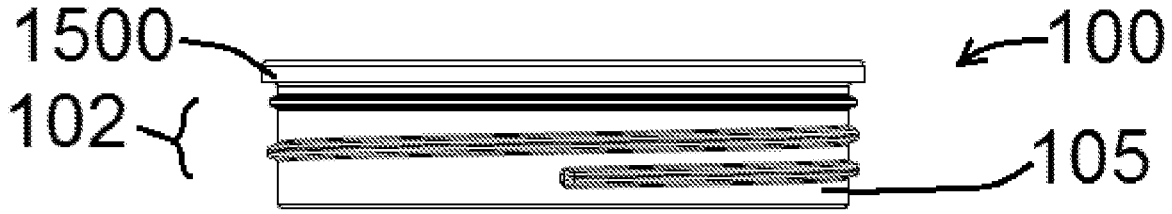
FIG. 17 shows a rear view of a threaded portion of a gasket, with the non-threaded portion removed for ease of illustration, according to at least one embodiment of the present disclosure.
Figure 18:
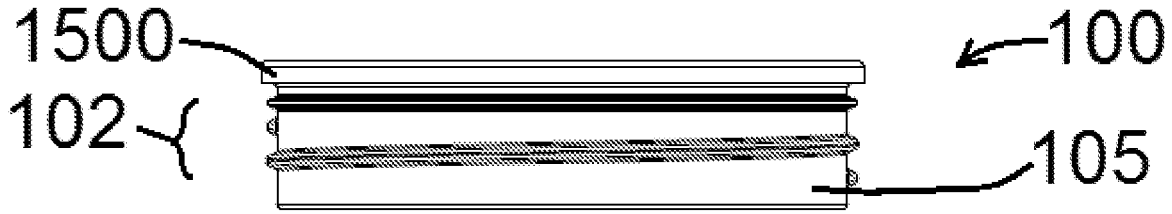
FIG. 18 shows a right side view of a threaded portion of a gasket, with the non-threaded portion removed for ease of illustration, according to at least one embodiment of the present disclosure.
Figure 19:
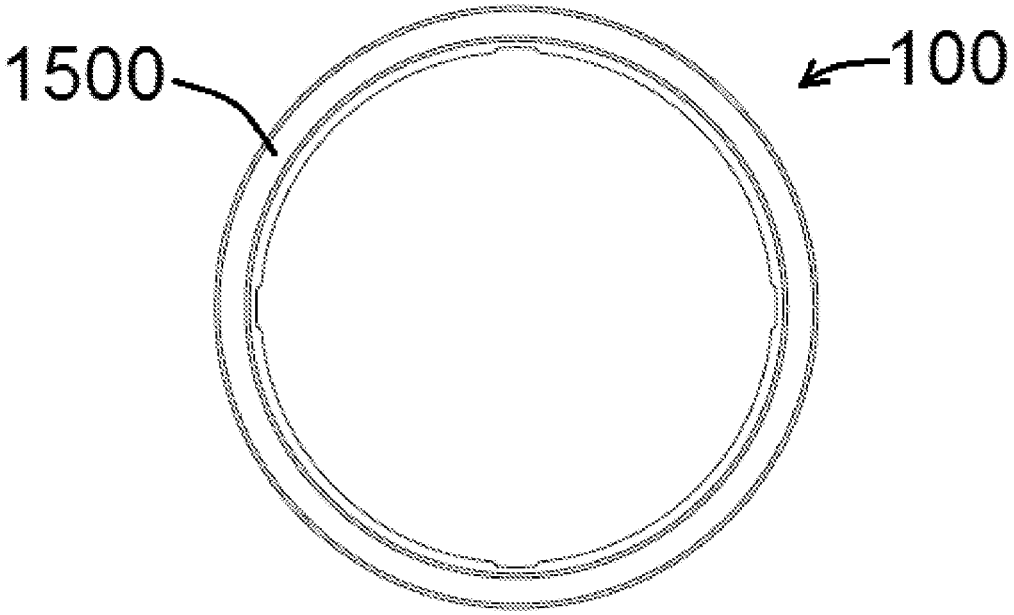
FIG. 19 shows a top view of a threaded portion of a gasket, with the non-threaded portion removed for ease of illustration, according to at least one embodiment of the present disclosure.
Figure 20:
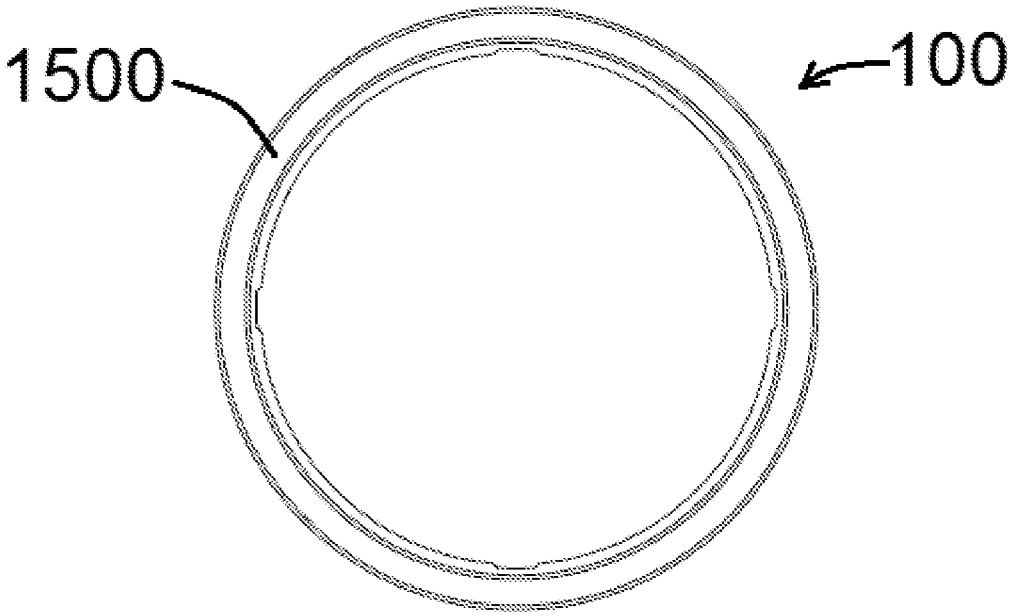
FIG. 20 shows a bottom view of a threaded portion of a gasket, with the non-threaded portion removed for ease of illustration, according to at least one embodiment of the present disclosure.
Figure 21:
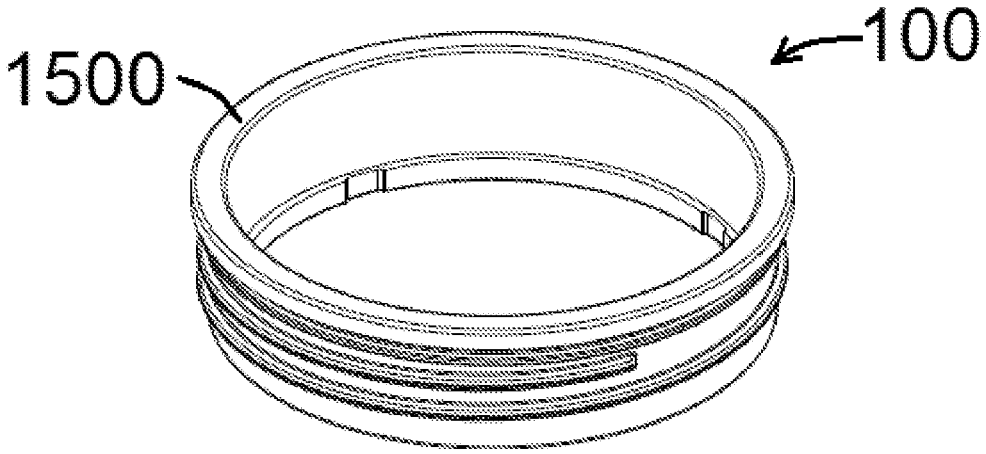
FIG. 21 shows a perspective view of a threaded portion of a gasket, with the non-threaded portion removed for ease of illustration, according to at least one embodiment of the present disclosure.
Figure 22:
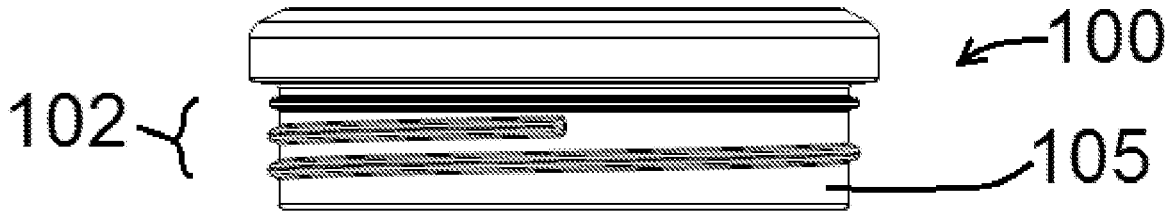
FIG. 22 shows a front view of a gasket formed as a single element/component and not as multiple elements/portions, according to at least one embodiment of the present disclosure.
Figure 23:
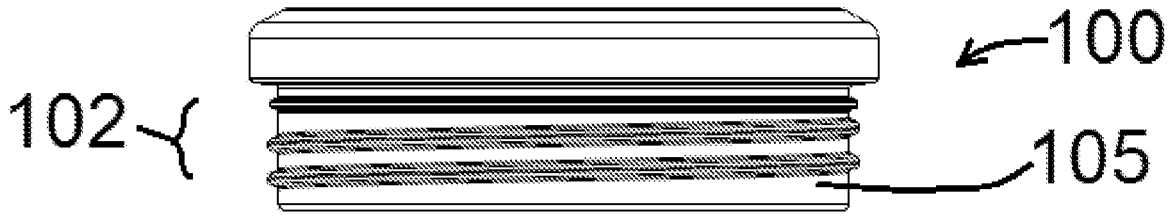
FIG. 23 shows a left side view of a gasket formed as a single element/component and not as multiple elements/portions, according to at least one embodiment of the present disclosure.
Figure 24:
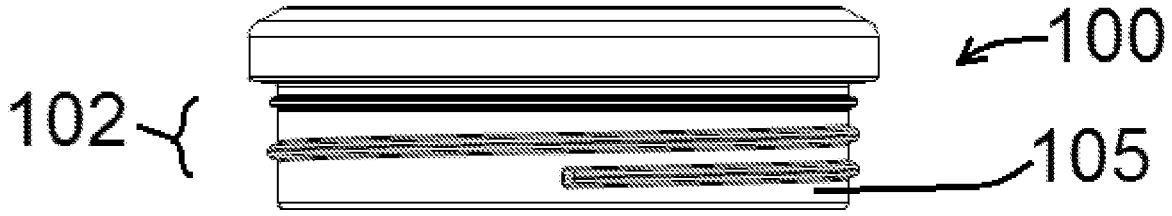
FIG. 24 shows a rear view of a gasket formed as a single element/component and not as multiple elements/portions, according to at least one embodiment of the present disclosure.
Figure 25:
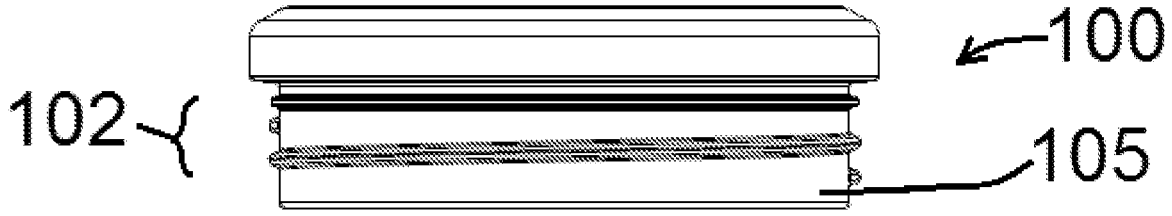
FIG. 25 shows a right side view of a gasket formed as a single element/component and not as multiple elements/portions, according to at least one embodiment of the present disclosure.
Figure 26:
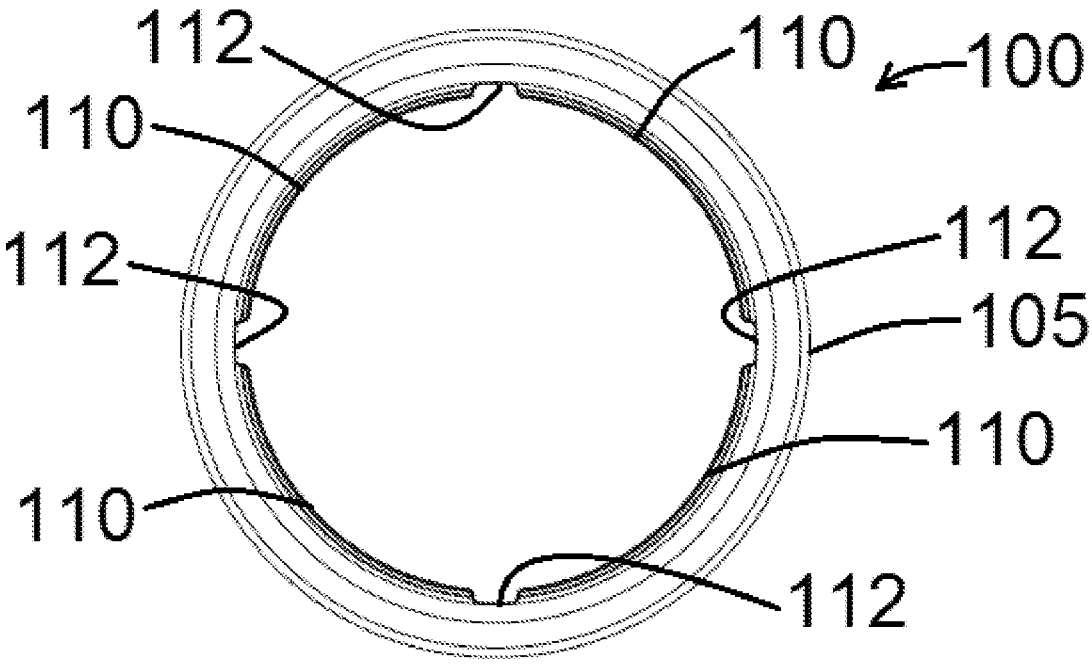
FIG. 26 shows a top view of a gasket formed as a single element/component and not as multiple elements/portions, according to at least one embodiment of the present disclosure.
Figure 27:
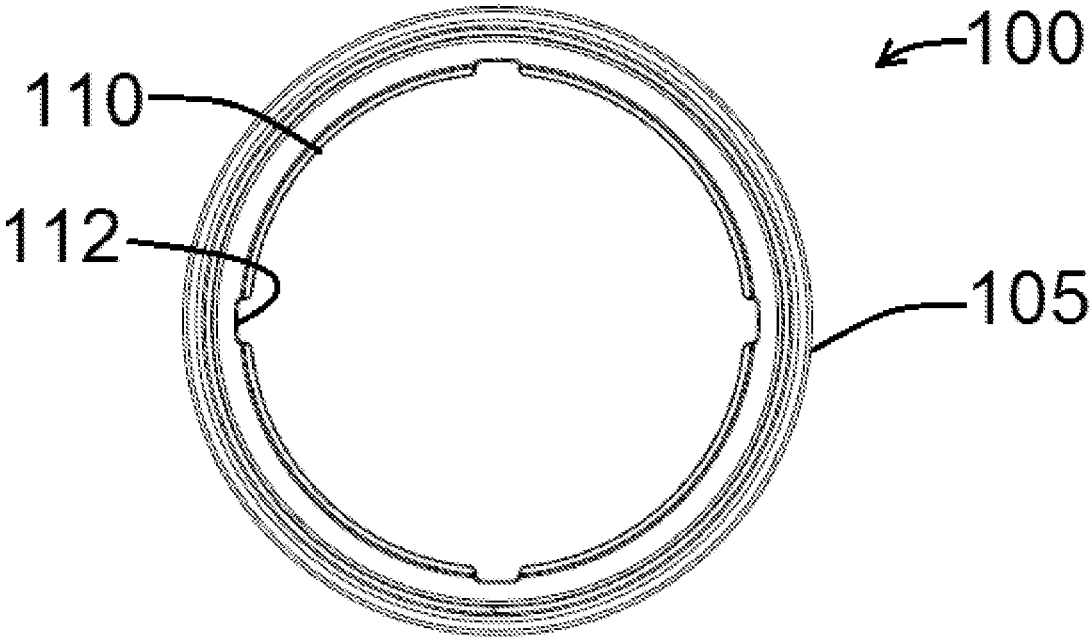
FIG. 27 shows a bottom view of a gasket formed as a single element/component and not as multiple elements/portions, according to at least one embodiment of the present disclosure.
Figure 28:
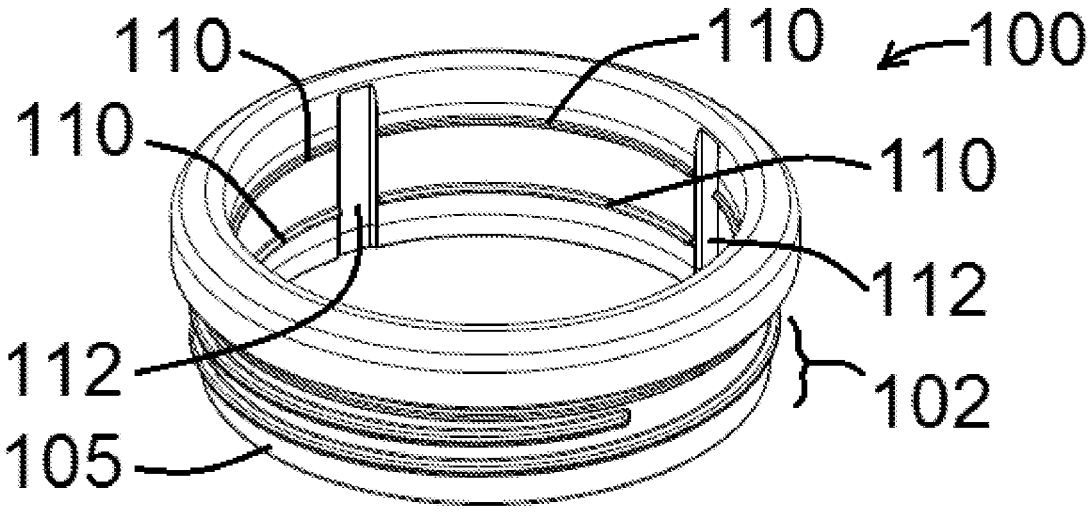
FIG. 28 shows a perspective view of a gasket formed as a single element/component and not as multiple elements/portions, according to at least one embodiment of the present disclosure.

Exemplary gaskets 100 of the present disclosure can include at least one arcuate flange 110, such as shown in FIGS. 7A, 7B, and 7C, positioned on a relative inside of gasket 100 (a relative inside of body 105), whereby two adjacent arcuate flanges 110 (in embodiments having two adjacent arcuate flanges 110) define/have a gap 112 therebetween. As shown in FIG. 7C, arcuate flanges 110 can be on the same axial plane 700 (whereby four arcuate flanges 110 arranged two relatively higher than the other two and whereby each pair are on the same axial plane 700), but arcuate flanges 110 do not need to be parallel to one another. FIGS. 5, 7A, and 7C collectively depict an embodiment whereby four arcuate flanges 110 are present within portions of a general circular circumference, with gaps 112 present within two adjacent arcuate flanges 110. Such an embodiment with four arcuate flanges 110 can be configured to exist in the same axial pane 700, such as shown in FIG. 7C. In embodiments with eight arcuate flanges 110, for example, four arcuate flanges 110 can be in one axial plane 700 (such as a "first" axial plane 700), and four other arcuate flanges 110 can be in a second axial plane 700 (such as a "second" axial plane 700), as shown in FIG. 7C.

Arcuate flanges 110 of the present disclosure extending inward from the gasket body 105, such as toward a central vertical axis 750 as shown in FIG. 7A.

Furthermore, and in various embodiments of gaskets 100 of the present disclosure, gaps 112 are defined within part of the gasket body 105 so to form an indention within gasket body 105. Such an indentation is not required so long as a gap 112 is present between two adjacent arcuate flanges 110.

Arcuate flanges 110 and gaps 112 of exemplary gaskets 100 are optionally configured to allow air to escape from a container 2900 having gasket 100 coupled thereto when a beverage can 6300 is being inserted thereto, as discussed in further detail herein.

Gaskets 100 of the present may comprise a relatively soft or compliant material, such as a rubber or other polymeric material, as may be desired, or may comprise a relatively hard material, such as a hard plastic or metal material.

In at least some embodiments, gaskets 100 comprise one, two, three, four, or more arcuate flanges 110. In the embodiment shown in FIGS. 5, 7A, and 7C, gasket 100 comprises four arcuate flanges 110 on each axial plane 700. Said four arcuate flanges 110 can be oriented by way of two arcuate flanges 110 on a first axial plane 700 and two other arcuate flanges 110 positioned adjacent to the first two arcuate flanges 110 a second axial plane 700, whereby said axial planes 700 are perpendicular or generally perpendicular to a height axis 3000 of a beverage container 2900, such as axis 3000 shown in FIG. 30. Such a configuration therefore results in the existence of four gaps 112, with a pair of arcuate flanges 110 present on the same axial plane defining two of said four gaps 112.

Gaskets 100, and arcuate flanges 110 positioned on a relative inside of gaskets 100, are configured to reversibly secure a beverage can 6300 therein, such as shown in FIGS. 63, 64, 65, 66, 67, 68, 69, and 70 (some environmentally depicted). Arcuate flanges 110 are sized and shaped to engage beverage can 6300 snugly, so that when a beverage can 6300 is at least partially positioned within a beverage container 2900, beverage can 6300 is prevented from (or substantially prevented from) falling out of beverage container 2900 when said beverage container 2900 is tipped downward (such as occurring when a person drinks from a beverage can 6300), and/or when beverage container 2900 is on its side or even inverted (upside down). Friction between beverage container 2900 and beverage can 6300, due to the snug fit of beverage can 6300 within beverage container 2900 having a gasket 100 of the present disclosure coupled thereto, is the reason why beverage can 6300 does not readily fall out of beverage container 2900 after being positioned therein.

Given the generally snug fit, the general problem of actually placing beverage can 6300 within beverage container 2900 would occur due to the presence of air within beverage can 6300 if said arcuate flanges 110 were instead one or more completely circular flanges, as gaps 112 permit the escape of said air when beverage can 6300 is pushed into beverage container 2900. Such a design is unique to the present application disclosure and its underlying priority parent patent applications. Without one or more said gaps 112, pressing beverage can 6300 into beverage container 2900 would result in some resistance due to the presence of trapped air within beverage container 2900. Such pressure/resistance is alleviated by way of one or more gaps 112 present between two adjacent arcuate flanges 110 (or even a gap 112 present within opposite ends of a single arcuate flange 110).

As shown in FIG. 7B, gaskets 100 of the present disclosure can comprise two arcuate flanges 110, each in their own separate plane 700 (as shown in FIG. 7C), or just as one arcuate flange 100 in a single plane 700, whereby relative ends (first end 720 and second end 722) of an arcuate flange are located in close proximity to one another, forming one gap 112. Such an embodiment would allow a beverage can 6300 to be secured within beverage container 2900 and would also permit air to escape beverage container 2900 when beverage can 6300 is positioned therein.

As shown in FIG. 7B, gasket 100 can comprise two (or more) arcuate flanges 110, with each arcuate flange 110 positioned relatively on top of one another, so that each arcuate flange 110 is in its own axial plane 700. Each axial plane 700 can have one arcuate flange 110 with ends 120, 122 defining a gap 112 therebetween. In preferred embodiments, gaps 112 exist adjacent to one another, such as being relatively above one another, as such a configuration would most efficiently and effectively permit air escape from within beverage container 2900 when beverage can 6300 is positioned therein.

Gaskets 100 can comprise one overall portion or can have more than one portion. For example, and as shown in FIGS. 8, 9, 10, 11, 12, 13, and 14 in various views, only a non-threaded portion 800 of an exemplary gasket 100 is shown in various views, while FIGS. 15, 16, 17, 18, 19, 20, and 21 show only a threaded portion 1500 of an exemplary gasket 100 shown in various views. Non-threaded portions 800 and threaded portions 1500 of exemplary gaskets 100 are configured to fit together, forming an exemplary multi-part/multi-portion gasket 100 of the present disclosure, such as shown in FIGS. 1, 2, 3, 4, 5, 6, 7A, 7B, and 7C. Exemplary gaskets 100 of the present disclosure can also comprise just one portion (a unitary gasket 100 itself), such as shown in FIGS. 22, 23, 24, 25, 26, 27, and 28, in various views.

Gaskets 100 can comprise part of a beverage system or kit 400, such as shown in FIGS. 29, 30, 31, 32, 33, 34, 35, 63, 64, 65, 66, 67, 68, 71, 72, 73, 74, 75, 76, and 77, for example. As shown therein, exemplary beverage system or kit 400 comprises at least one gasket 100 and at least one beverage container 2900. Beverage systems or kits can also comprise additional items, such as one of more lids configured to fully or substantially cover a relative top of beverage container 2900 and/or one or more adapters 420 configured to fit within beverage container 2900 when beverage can 6300 is positioned within beverage container 2900.

Figure 29:
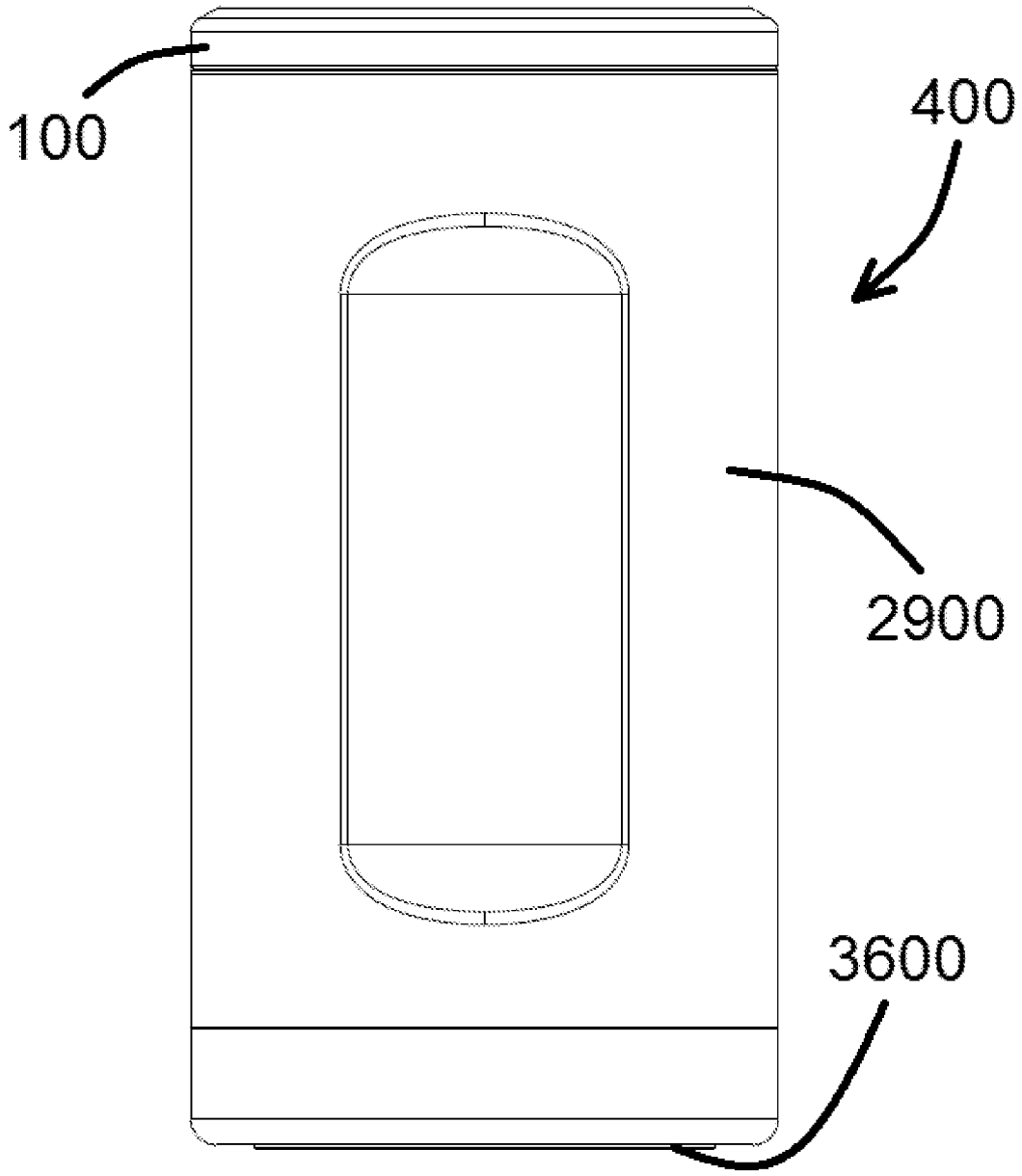
FIG. 29 shows a front view of a beverage system or kit, with a gasket and a container shown along with an optional bottom covering portion coupled to the container, according to at least one embodiment of the present disclosure.
Figure 30:
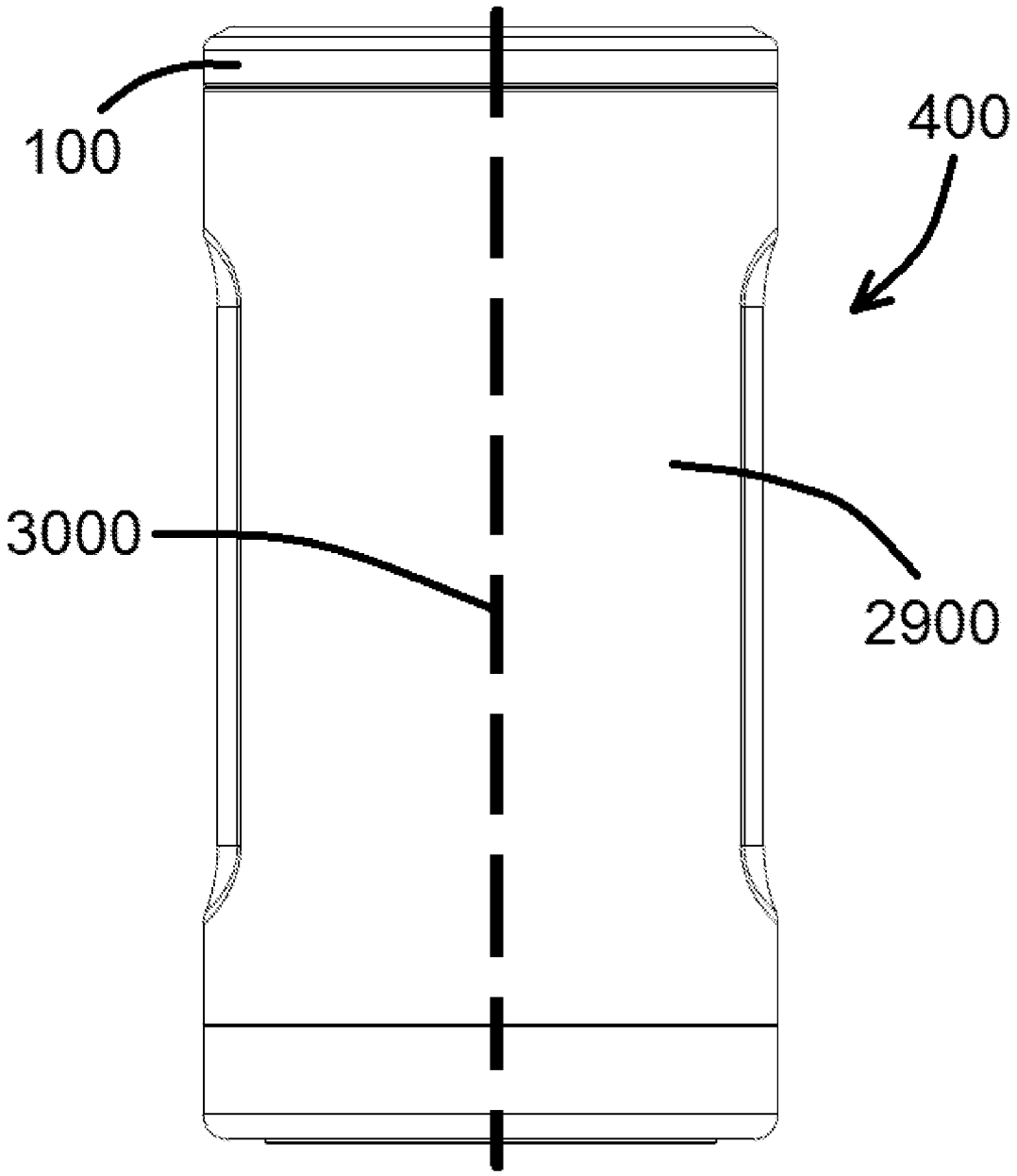
FIG. 30 shows a left side view of a beverage system or kit, with a gasket and a container shown along with an optional bottom covering portion coupled to the container, according to at least one embodiment of the present disclosure.
Figure 31:
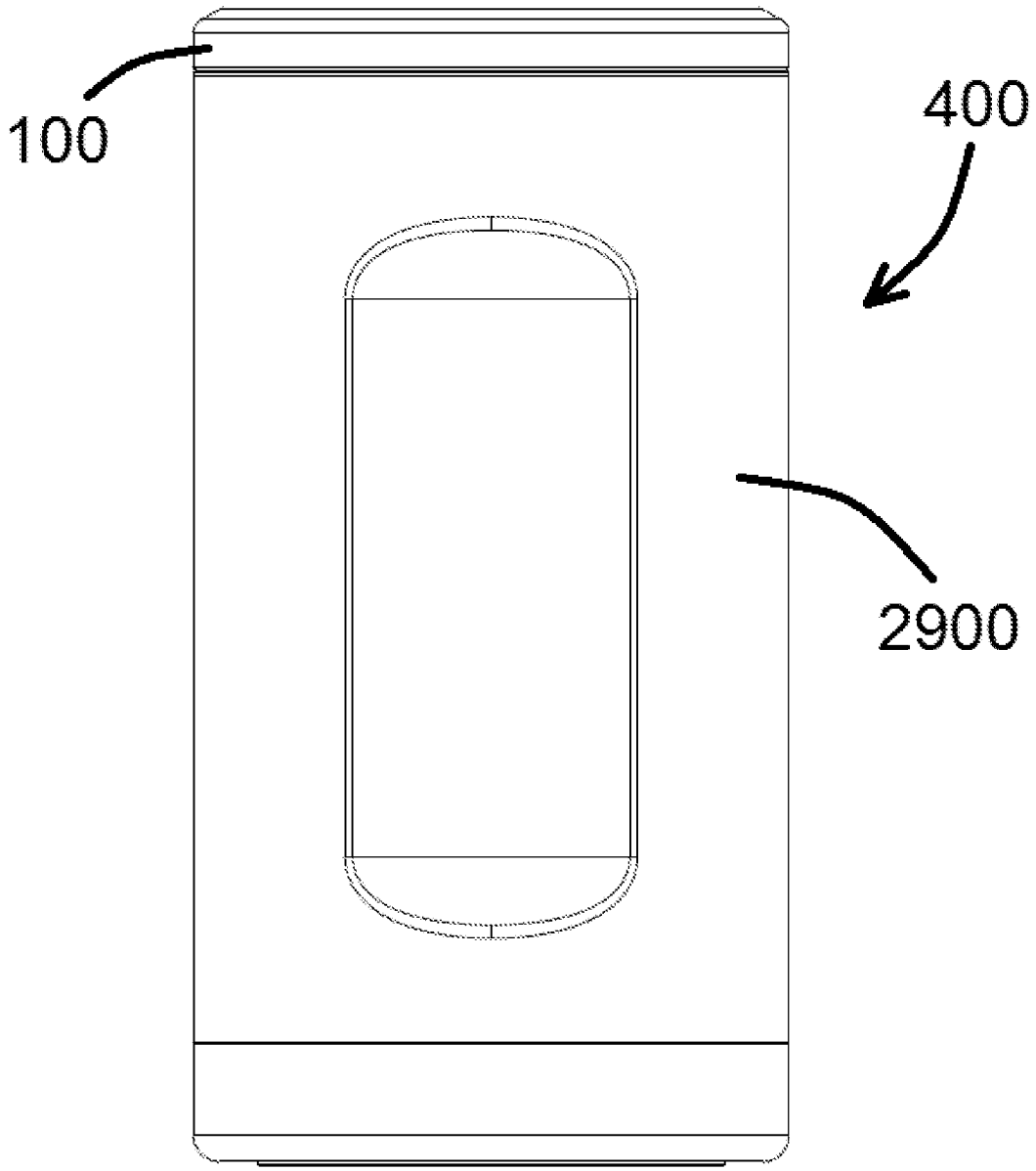
FIG. 31 shows a rear view of a beverage system or kit, with a gasket and a container shown along with an optional bottom covering portion coupled to the container, according to at least one embodiment of the present disclosure.
Figure 32:
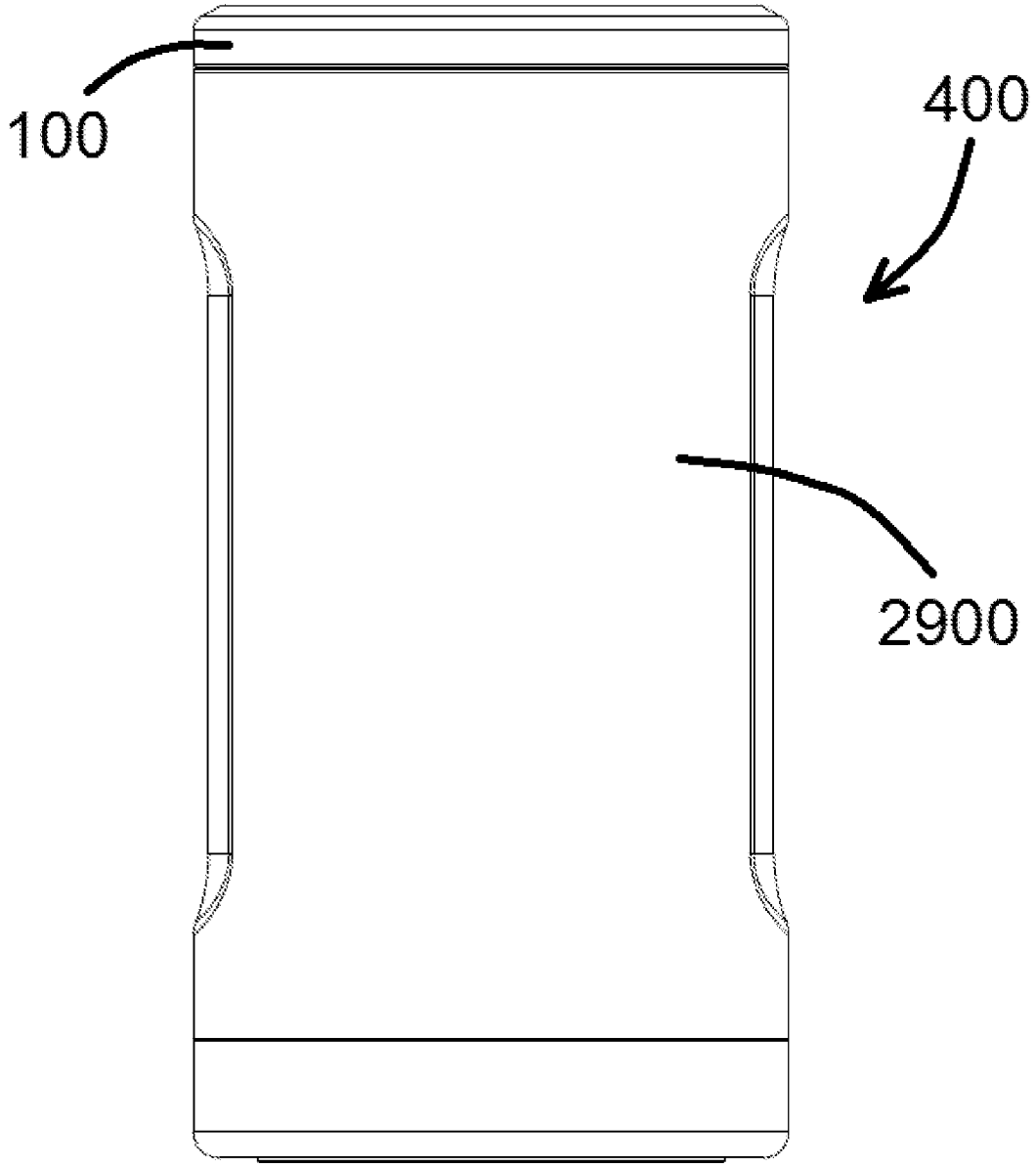
FIG. 32 shows a right side view of a beverage system or kit, with a gasket and a container shown along with an optional bottom covering portion coupled to the container, according to at least one embodiment of the present disclosure.
Figure 33:
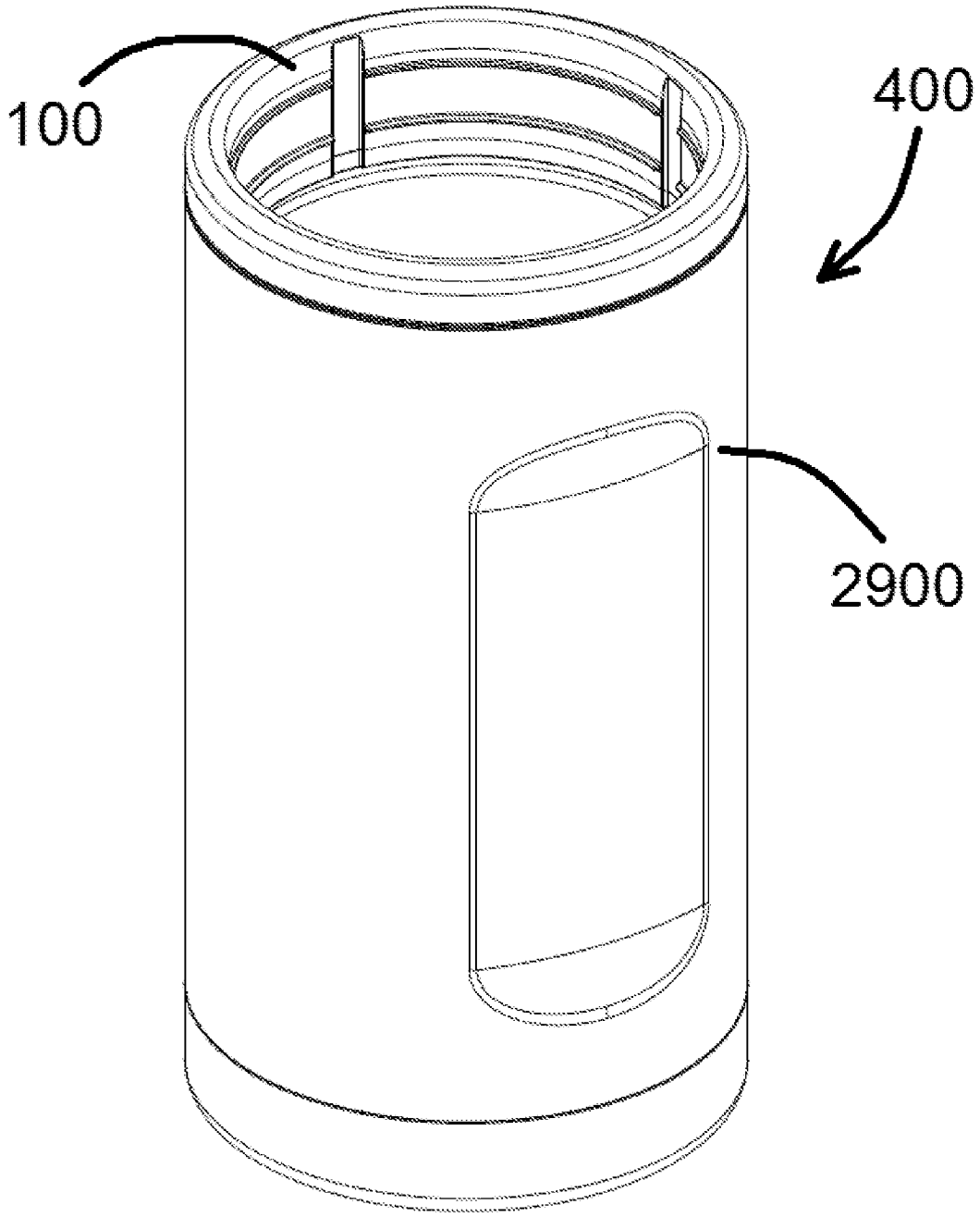
FIG. 33 shows a perspective view of a beverage system or kit, with a gasket and a container shown along with an optional bottom covering portion coupled to the container, according to at least one embodiment of the present disclosure.
Figure 34:
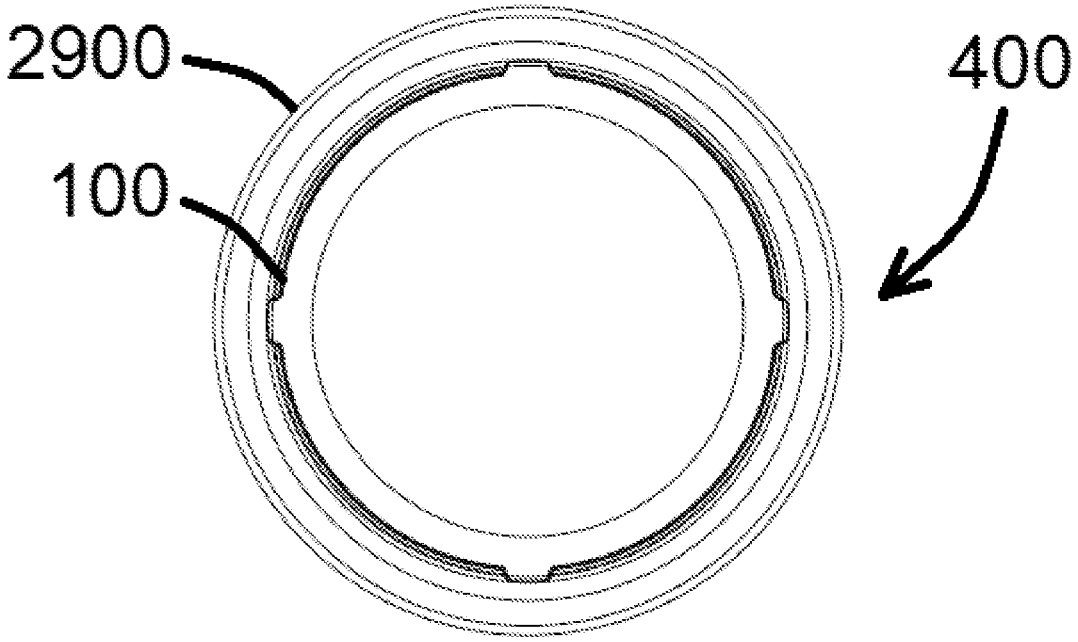
FIG. 34 shows a top view of a beverage system or kit, with a gasket and a container shown along with an optional bottom covering portion coupled to the container, according to at least one embodiment of the present disclosure.
Figure 35:
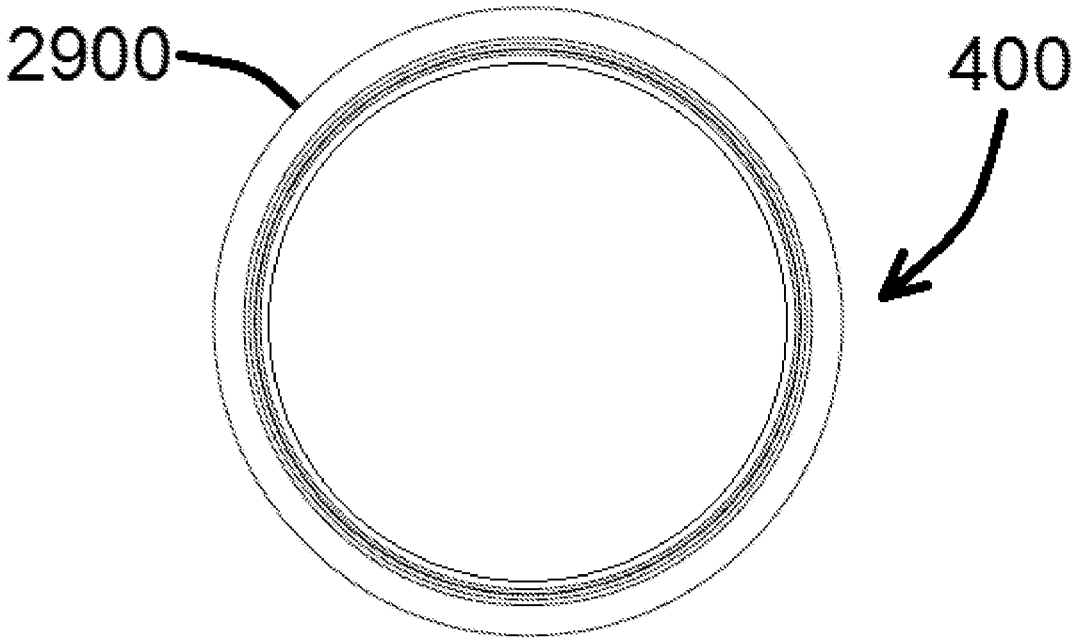
FIG. 35 shows a bottom view of a beverage system or kit, with a gasket and a container shown along with an optional bottom covering portion coupled to the container, according to at least one embodiment of the present disclosure.
Figure 36:
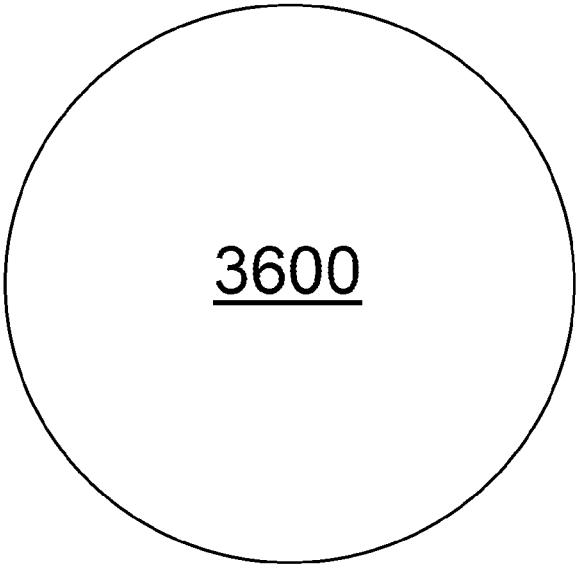
FIG. 36 shows a top view of a bottom covering portion configured to couple to a bottom of a container, according to at least one embodiment of the present disclosure.
Figure 37:
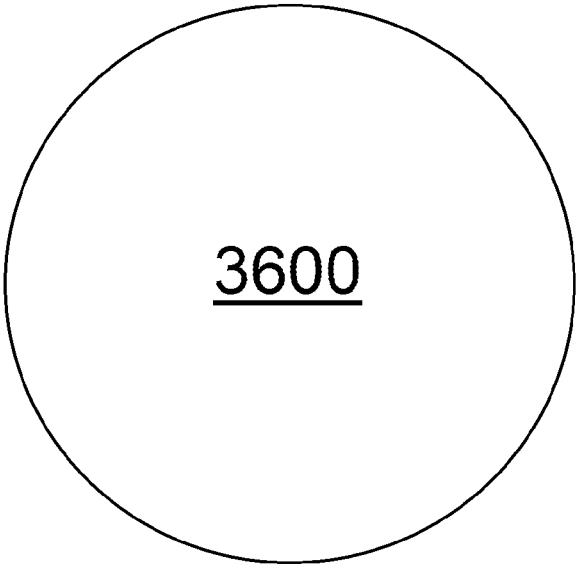
FIG. 37 shows a top view of a bottom covering portion configured to couple to a bottom of a container, according to at least one embodiment of the present disclosure.
Figure 38:
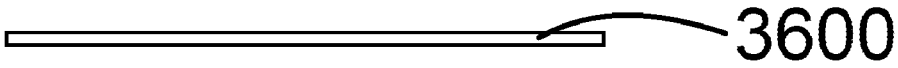
FIG. 38 shows a front view of a bottom covering portion configured to couple to a bottom of a container, according to at least one embodiment of the present disclosure.
Figure 39:
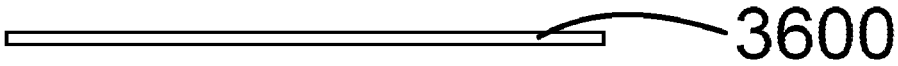
FIG. 39 shows a left side view of a bottom covering portion configured to couple to a bottom of a container, according to at least one embodiment of the present disclosure.
Figure 40:
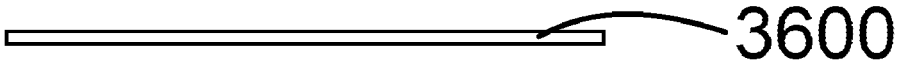
FIG. 40 shows a rear view of a bottom covering portion configured to couple to a bottom of a container, according to at least one embodiment of the present disclosure.
Figure 41:
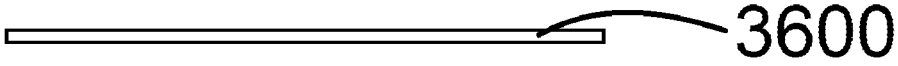
FIG. 41 shows a right side view of a bottom covering portion configured to couple to a bottom of a container, according to at least one embodiment of the present disclosure.
Figure 42:
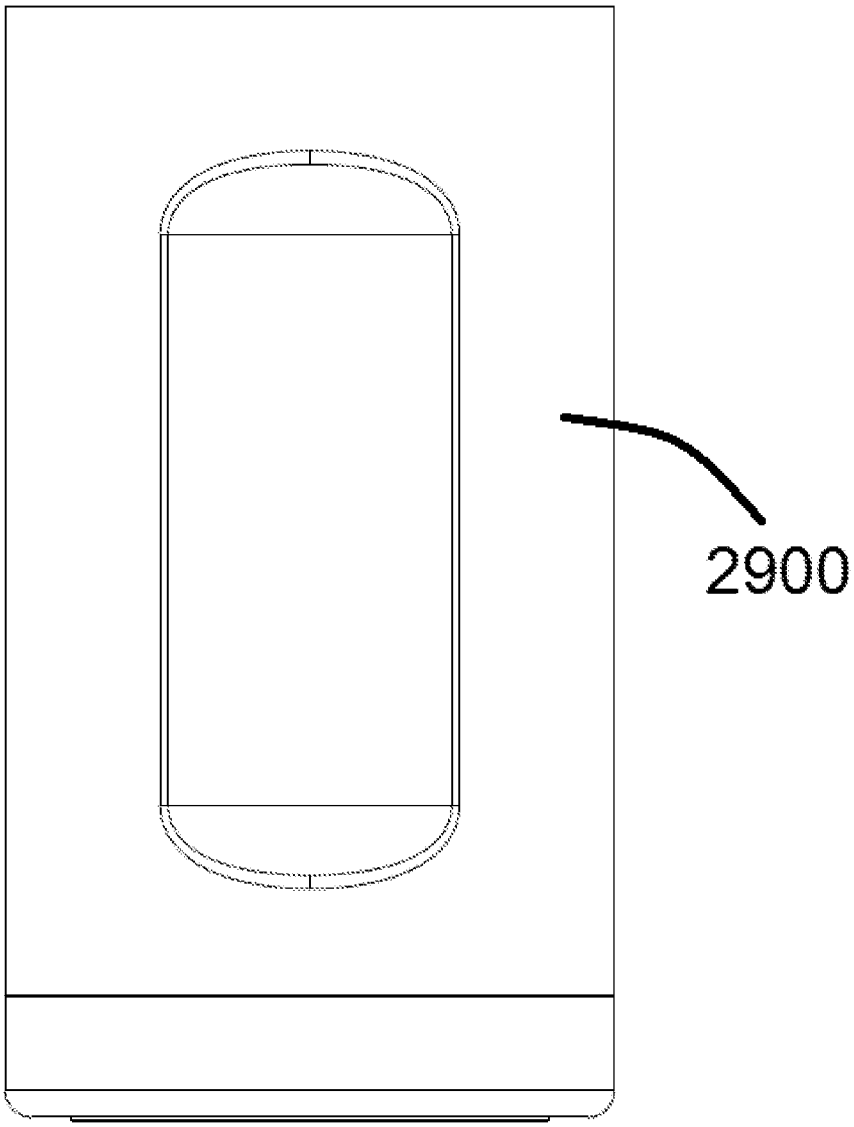
FIG. 42 shows a front view of a container, with an optional bottom covering portion coupled thereto, according to at least one embodiment of the present disclosure.
Figure 43:
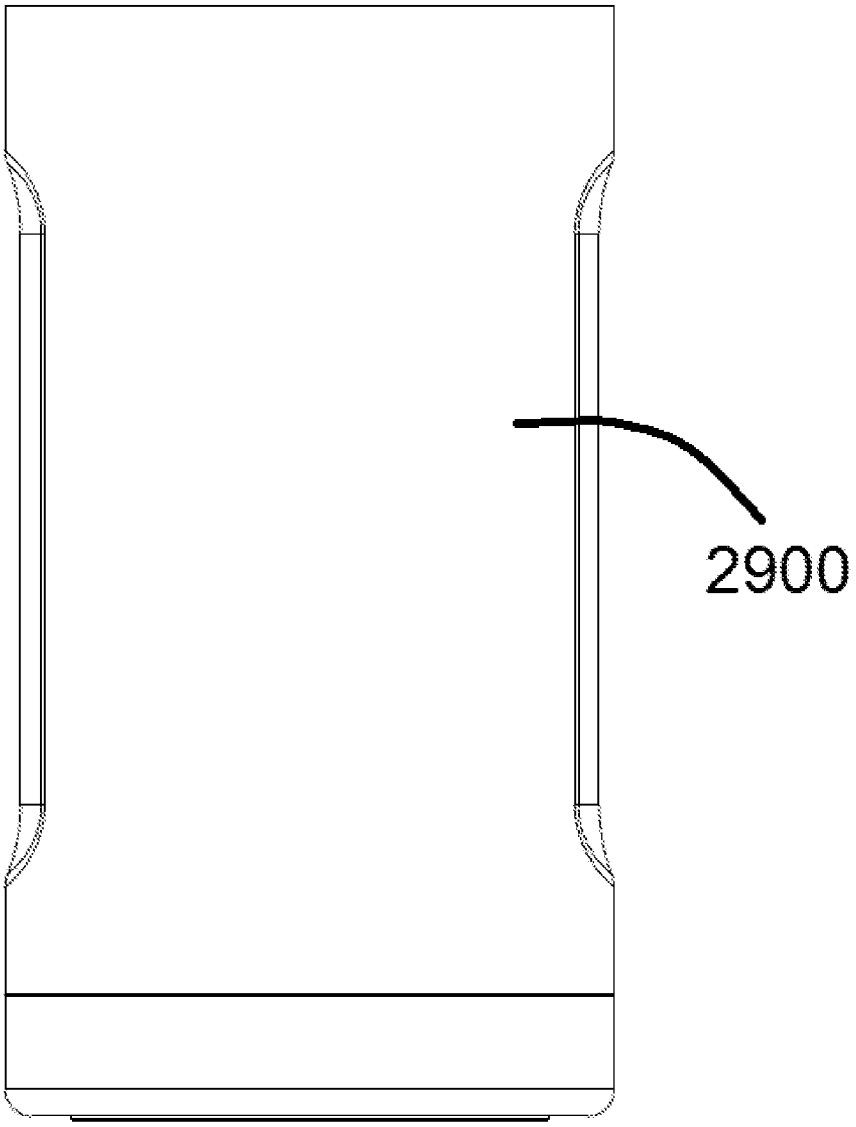
FIG. 43 shows a left side view of a container, with an optional bottom covering portion coupled thereto, according to at least one embodiment of the present disclosure.
Figure 44:
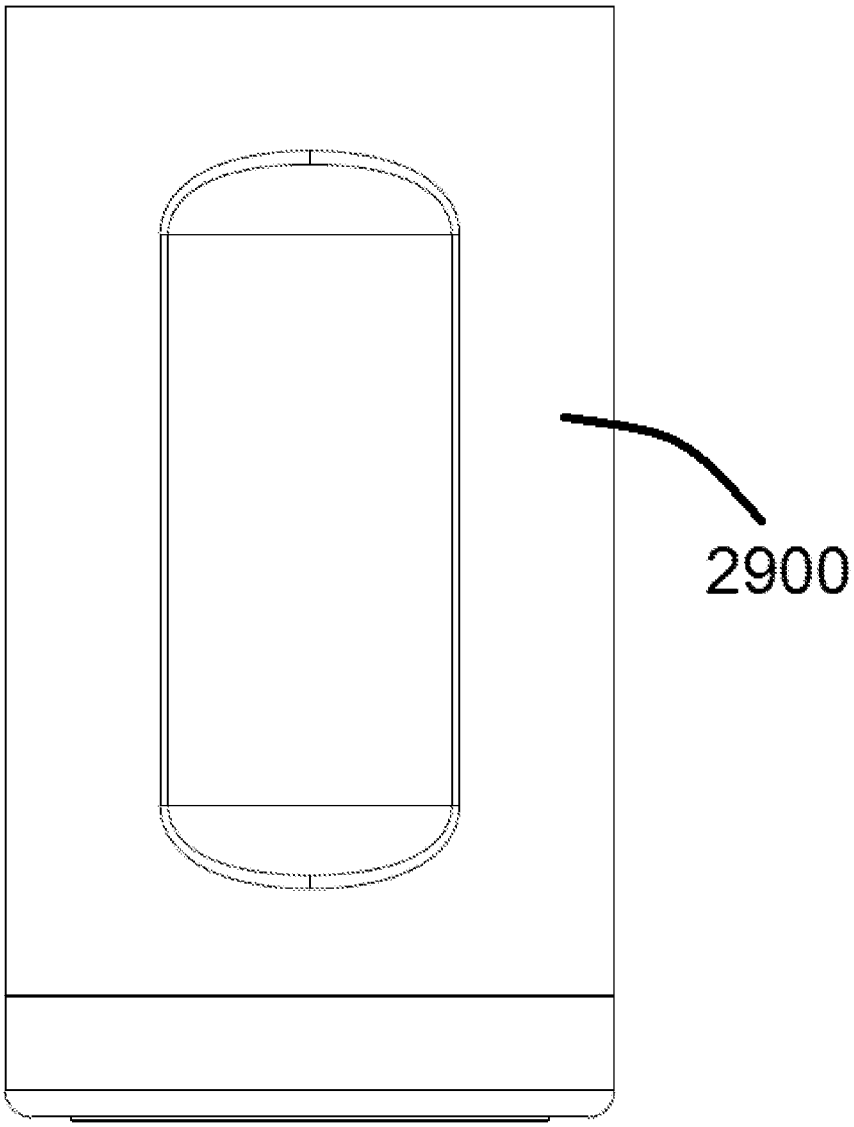
FIG. 44 shows a rear view of a container, with an optional bottom covering portion coupled thereto, according to at least one embodiment of the present disclosure.
Figure 45:
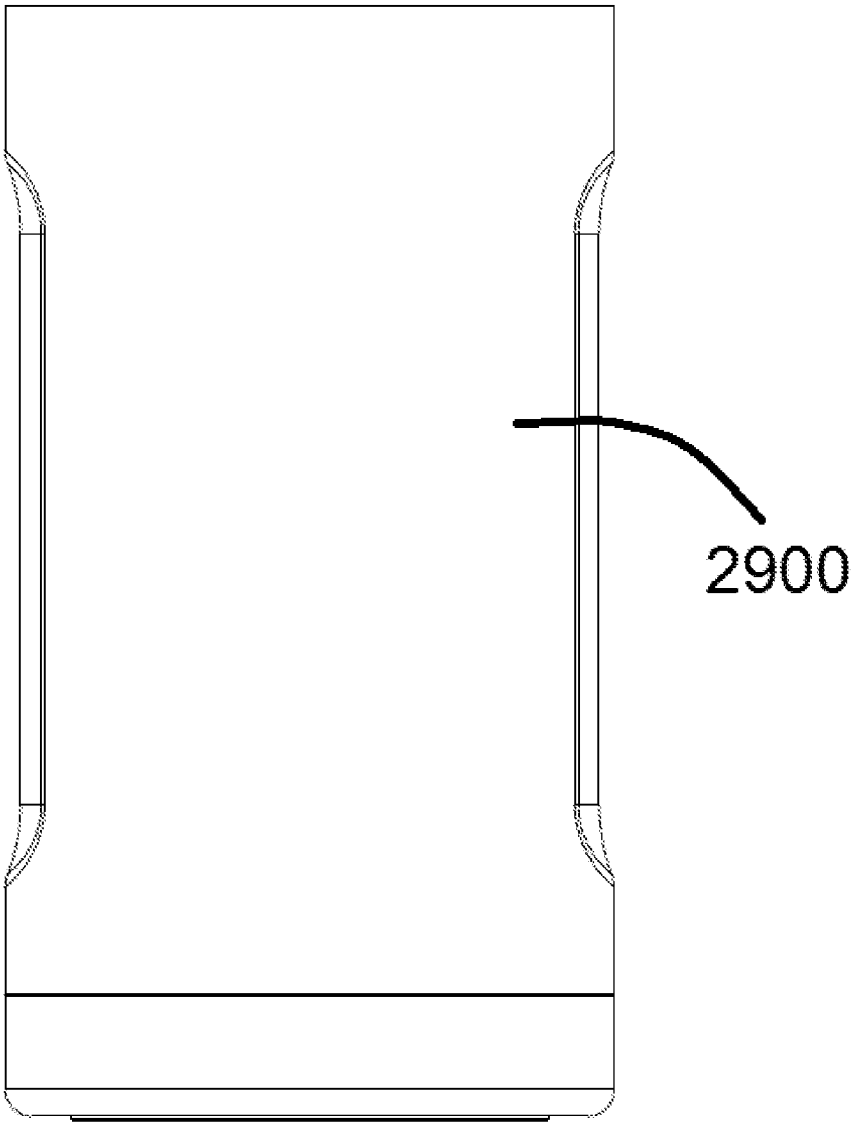
FIG. 45 shows a right side view of a container, with an optional bottom covering portion coupled thereto, according to at least one embodiment of the present disclosure.
Figure 46:
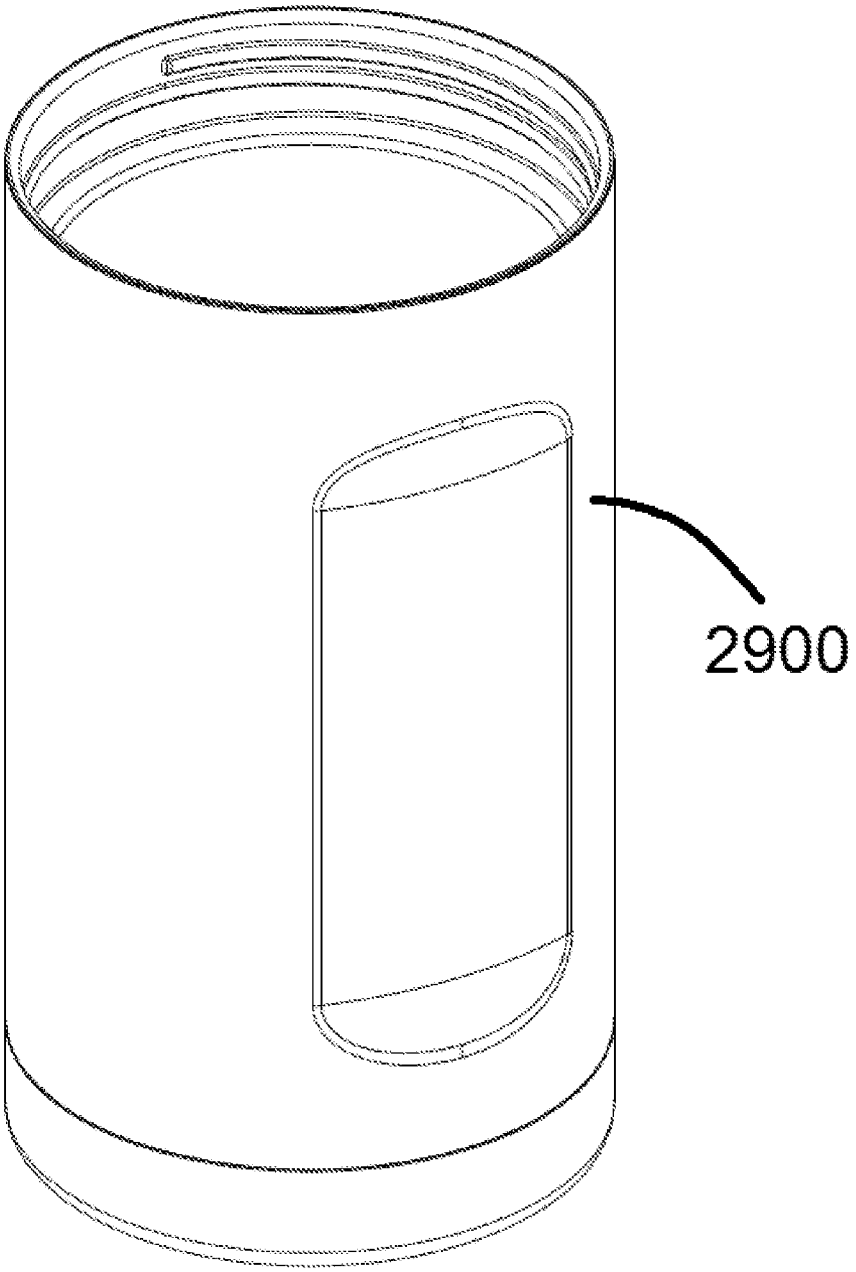
FIG. 46 shows a perspective view of a container, with an optional bottom covering portion coupled thereto, according to at least one embodiment of the present disclosure.
Figure 47:
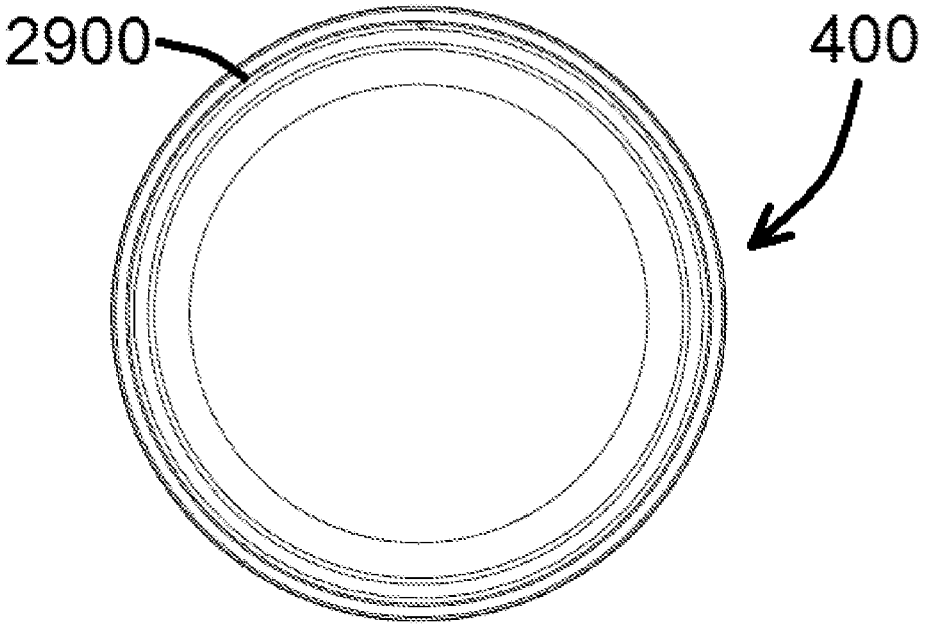
FIG. 47 shows a top view of a container, with an optional bottom covering portion coupled thereto, according to at least one embodiment of the present disclosure.
Figure 48:
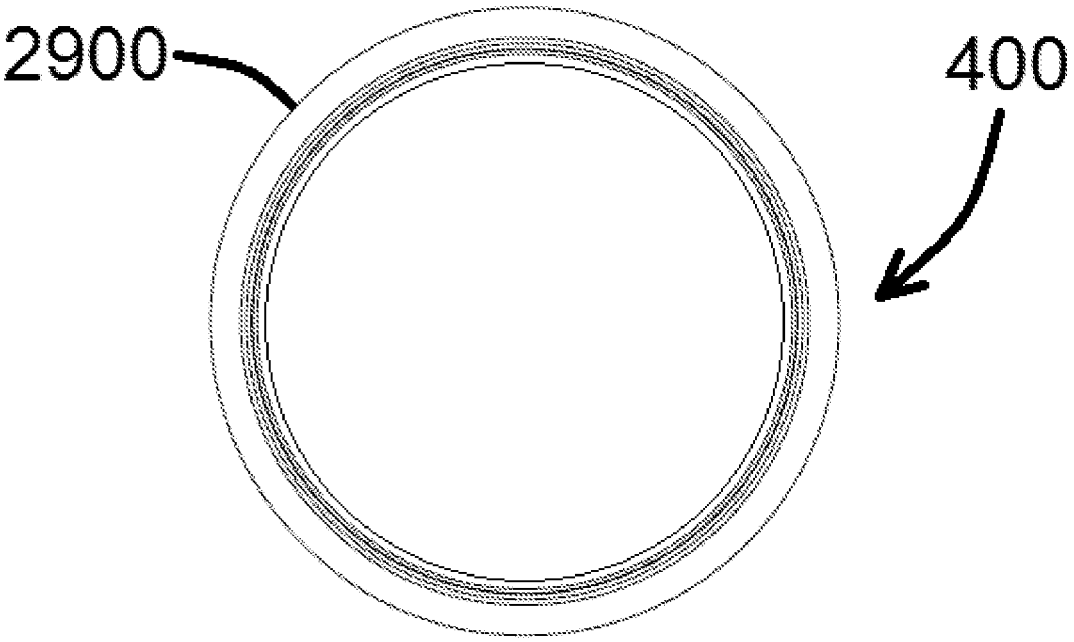
FIG. 48 shows a bottom view of a container, with an optional bottom covering portion coupled thereto, according to at least one embodiment of the present disclosure.
Figure 49:
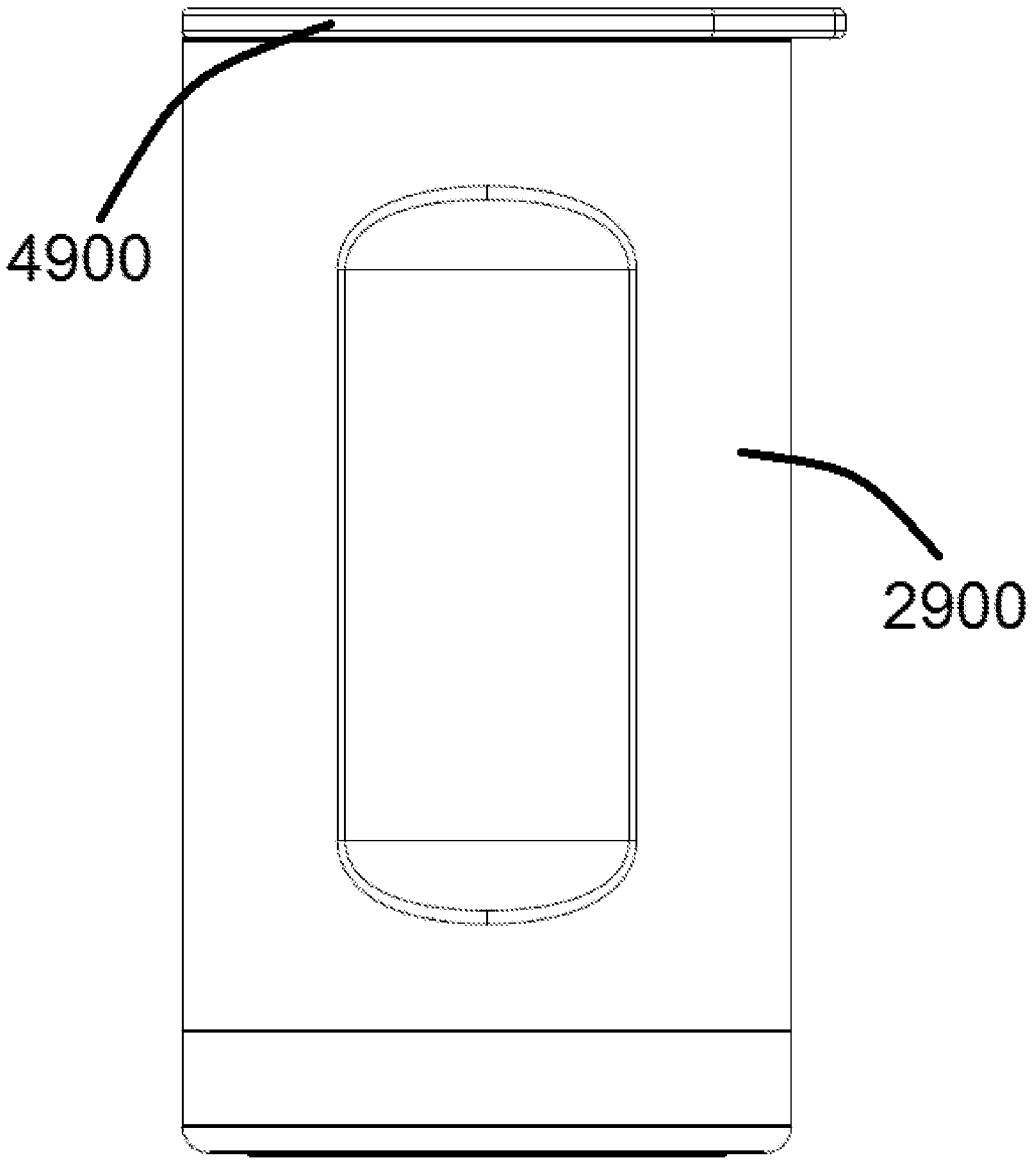
FIG. 49 shows a front view of a container, with an optional bottom covering portion coupled thereto, and with a lid coupled the container, according to at least one embodiment of the present disclosure.
Figure 50:
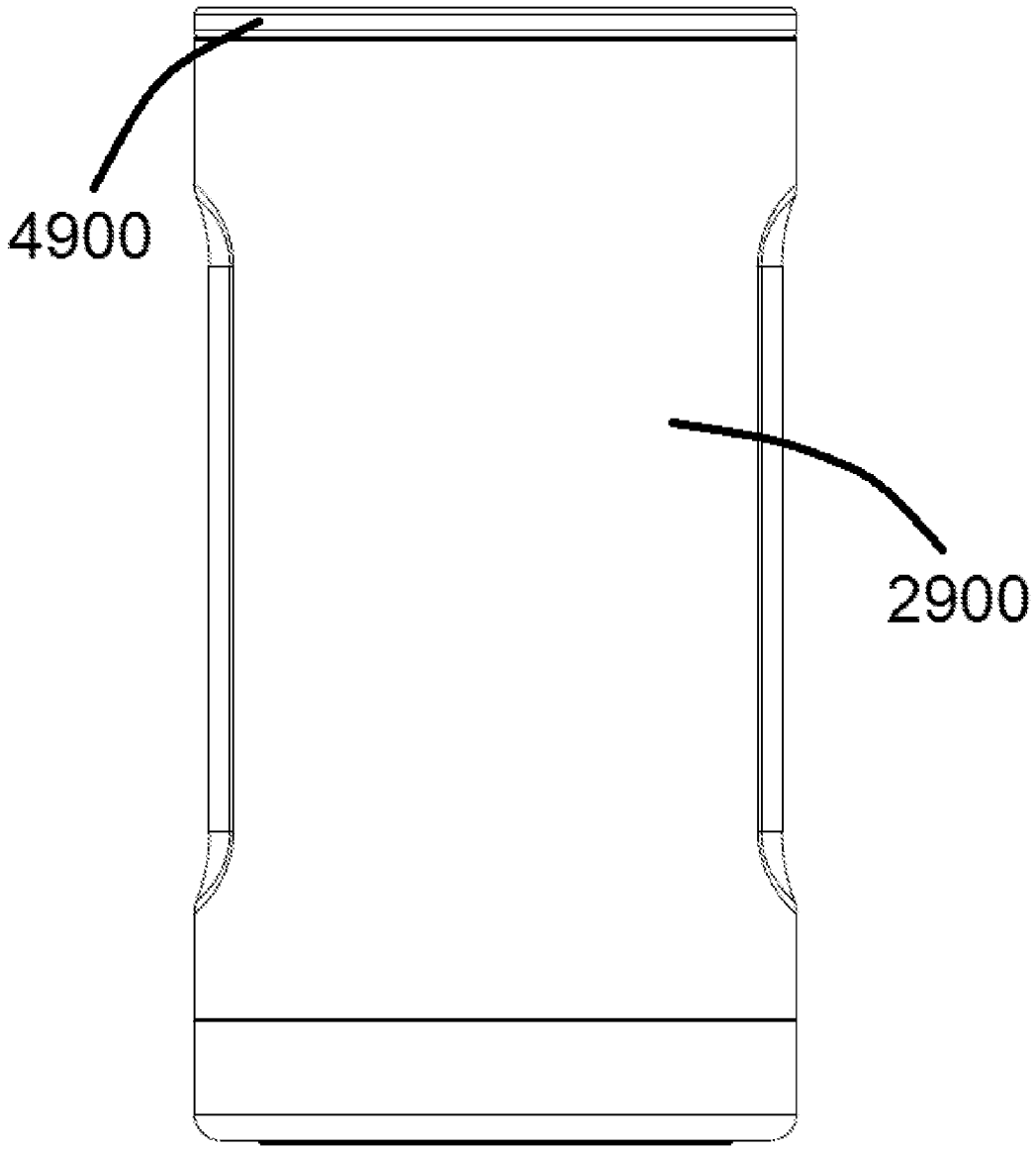
FIG. 50 shows a left side view of a container, with an optional bottom covering portion coupled thereto, and with a lid coupled the container, according to at least one embodiment of the present disclosure.
Figure 51:
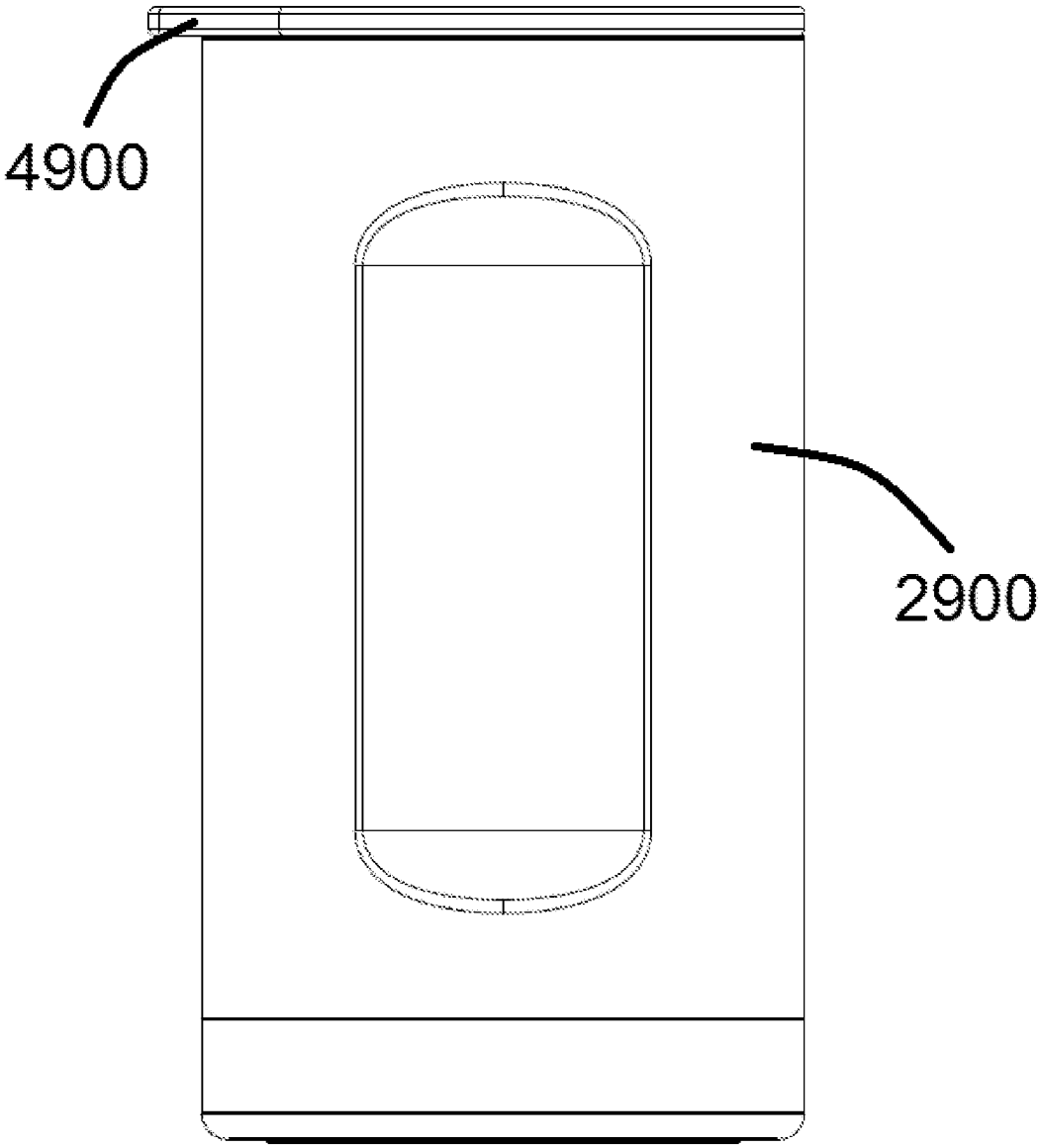
FIG. 51 shows a rear view of a container, with an optional bottom covering portion coupled thereto, and with a lid coupled the container, according to at least one embodiment of the present disclosure.
Figure 52:
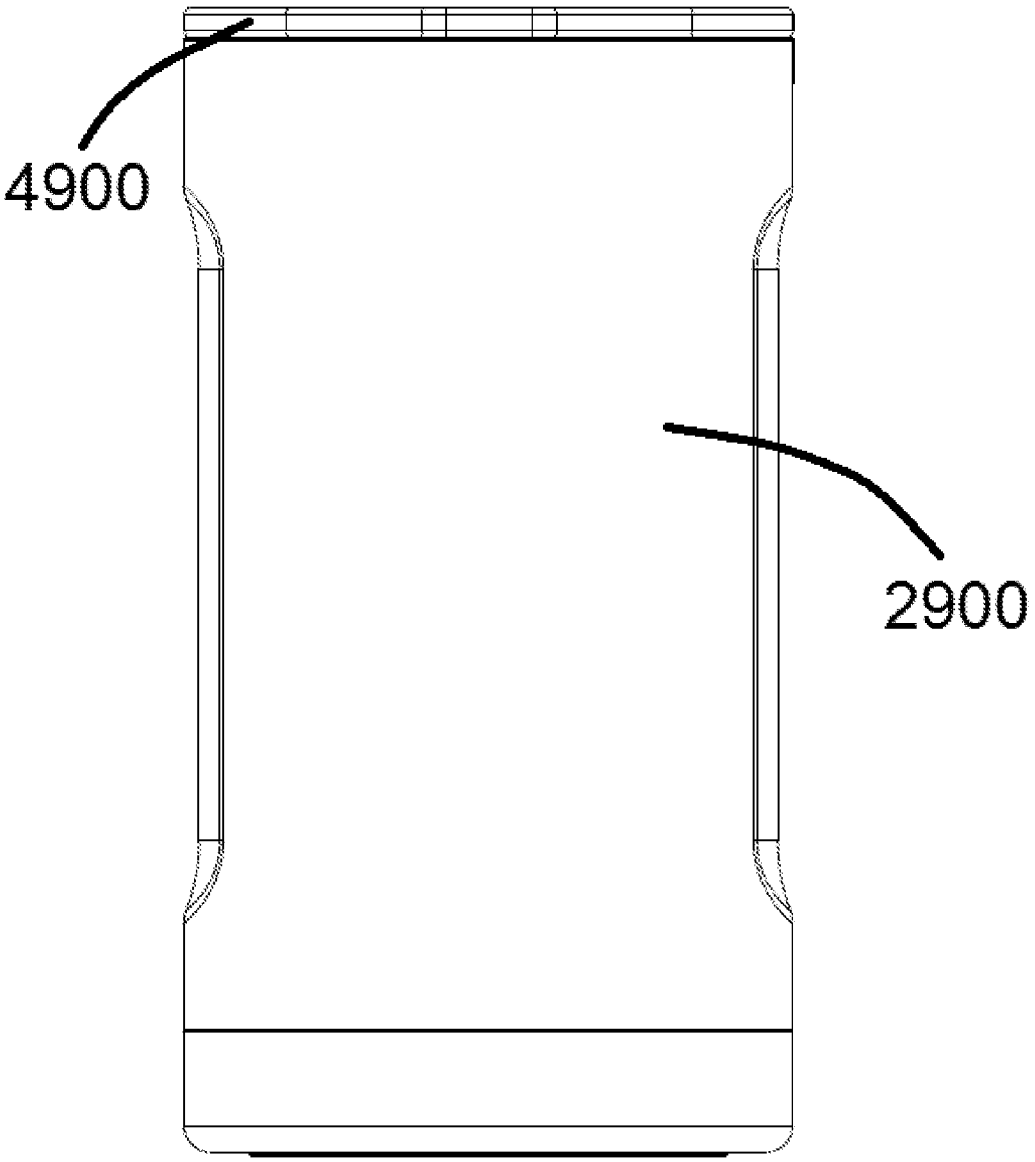
FIG. 52 shows a right side view of a container, with an optional bottom covering portion coupled thereto, and with a lid coupled the container, according to at least one embodiment of the present disclosure.
Figure 53:
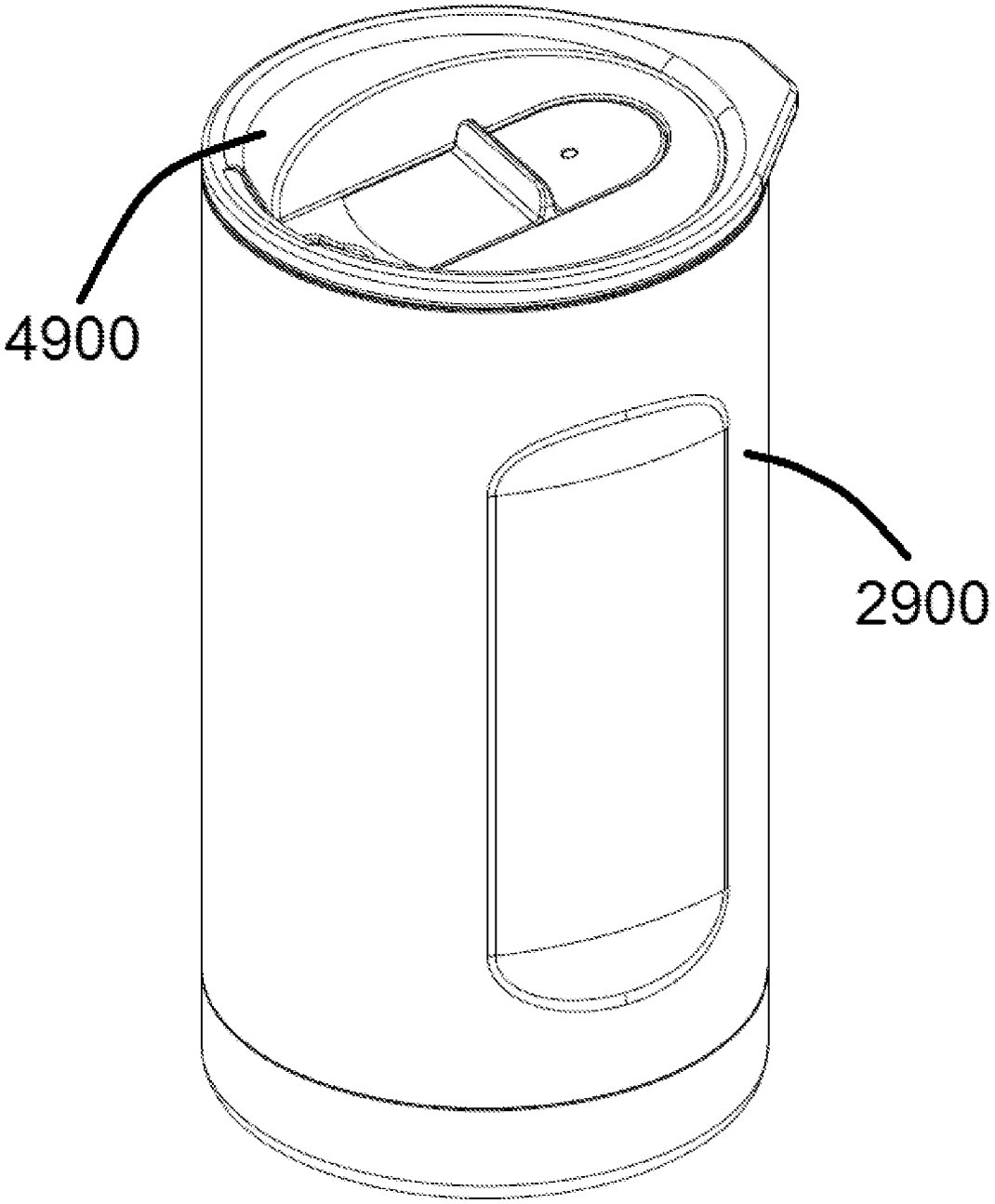
FIG. 53 shows a perspective view of a container, with an optional bottom covering portion coupled thereto, and with a lid coupled the container, according to at least one embodiment of the present disclosure.
Figure 54:
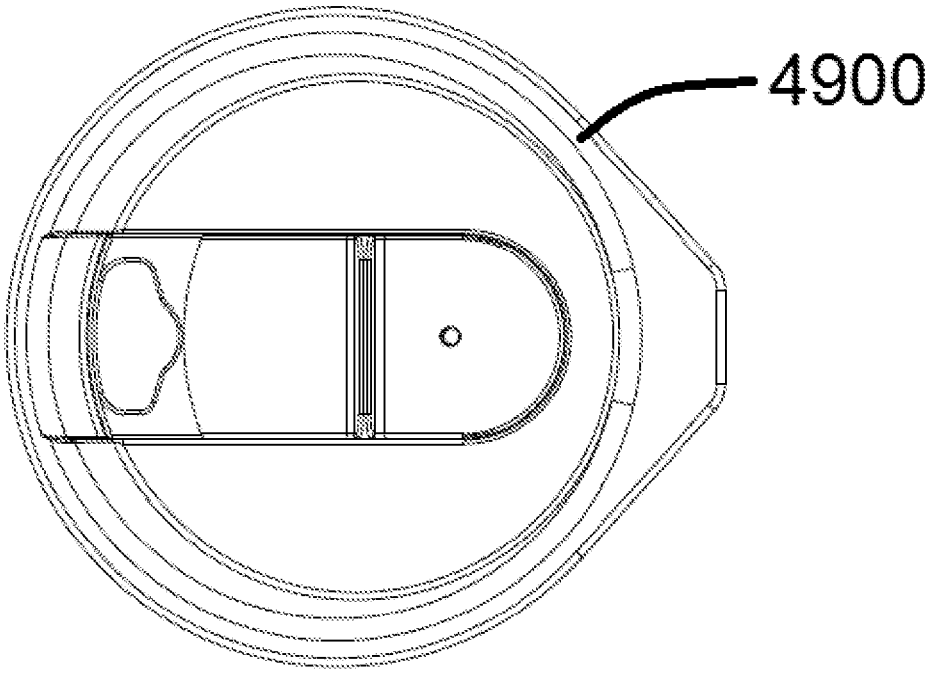
FIG. 54 shows a top view of a container, with an optional bottom covering portion coupled thereto, and with a lid coupled the container, according to at least one embodiment of the present disclosure.
Figure 55:
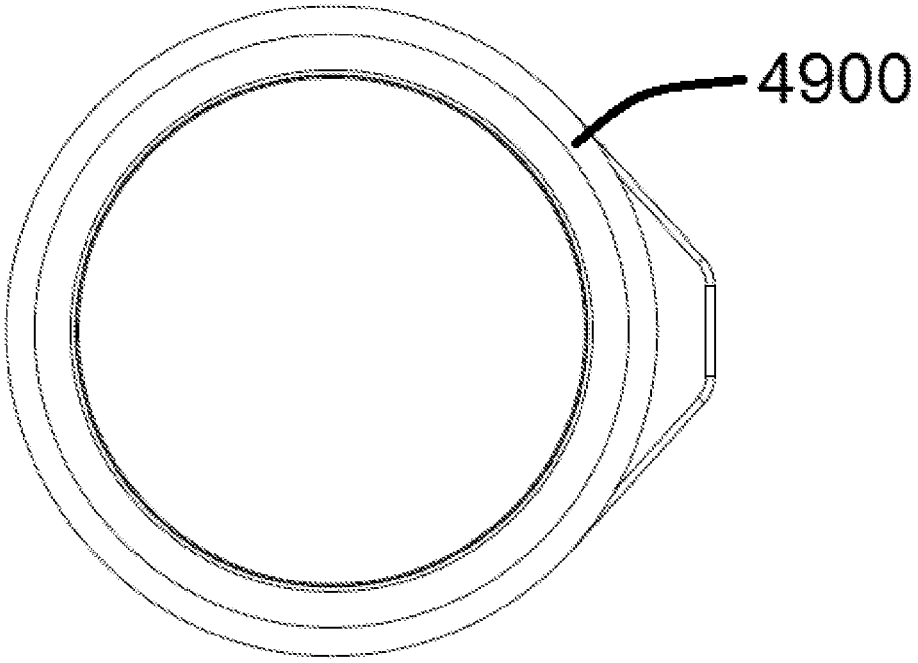
FIG. 55 shows a bottom view of a container, with an optional bottom covering portion coupled thereto, and with a lid coupled the container, according to at least one embodiment of the present disclosure.
Figure 56:
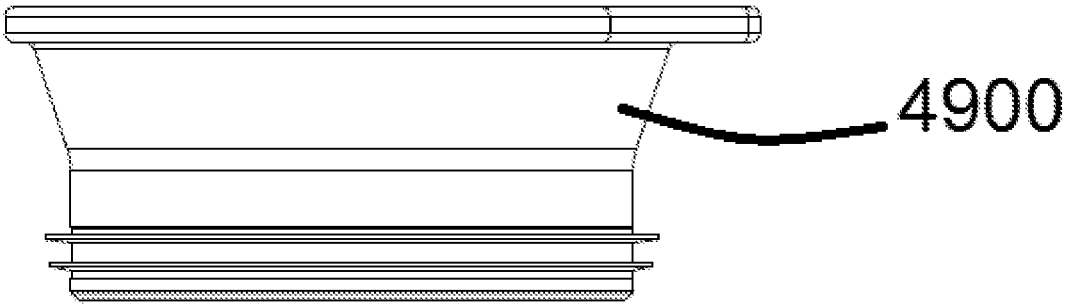
FIG. 56 shows a front view of a lid, according to at least one embodiment of the present disclosure.
Figure 57:
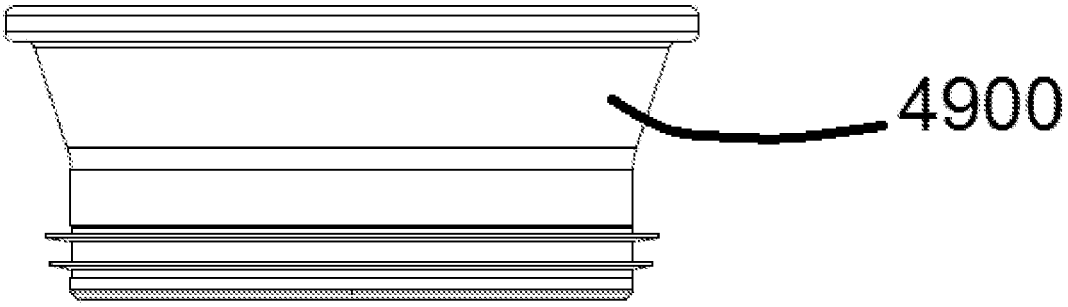
FIG. 57 shows a left side view of a lid, according to at least one embodiment of the present disclosure.
Figure 58:
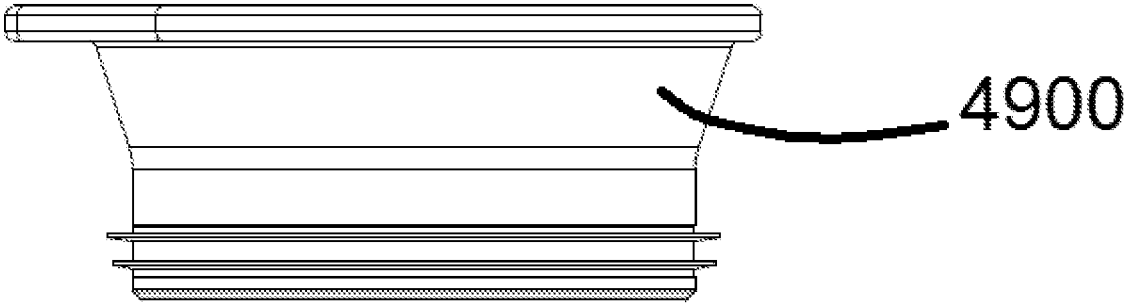
FIG. 58 shows a rear view of a lid, according to at least one embodiment of the present disclosure.
Figure 59:
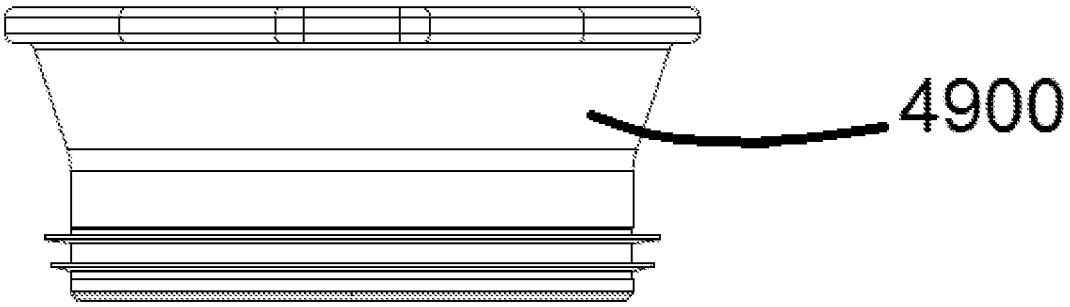
FIG. 59 shows a right side view of a lid, according to at least one embodiment of the present disclosure.
Figure 60:
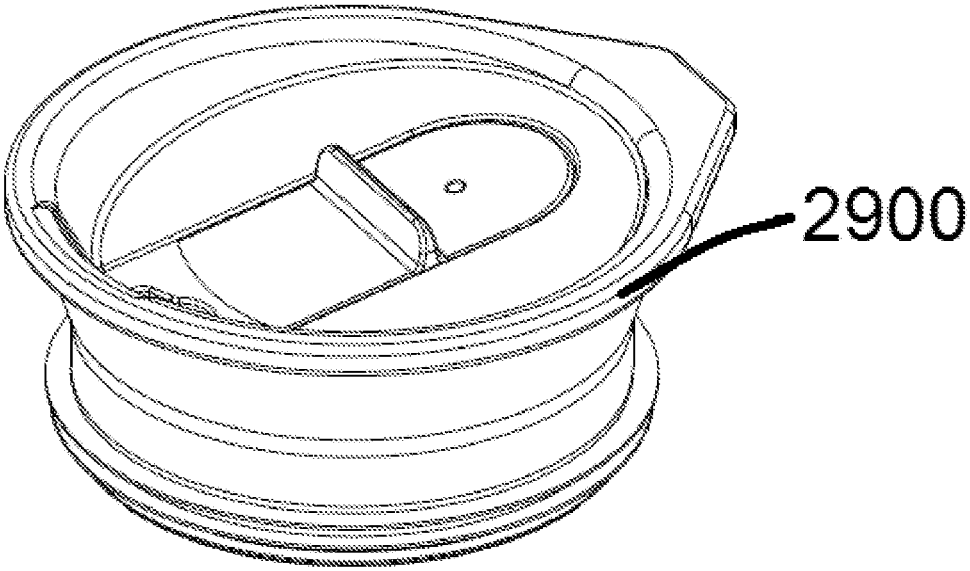
FIG. 60 shows a perspective view of a lid, according to at least one embodiment of the present disclosure.
Figure 61:
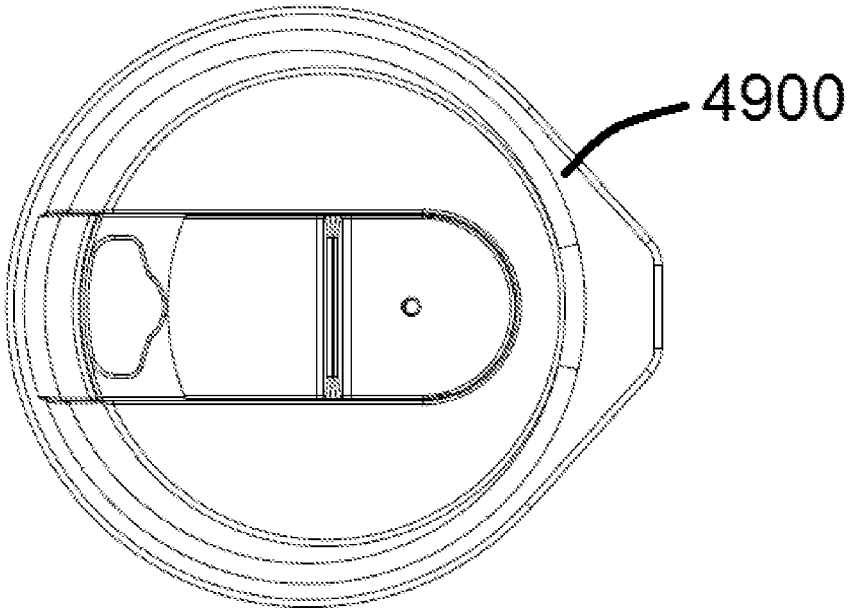
FIG. 61 shows a top view of a lid, according to at least one embodiment of the present disclosure.
Figure 62:
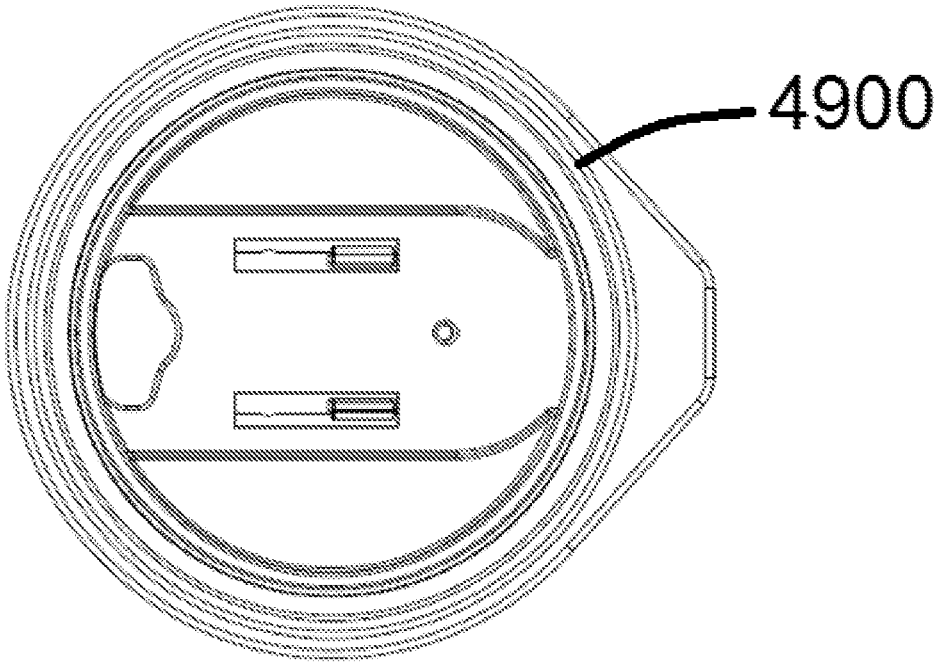
FIG. 62 shows a bottom view of a lid, according to at least one embodiment of the present disclosure.

FIGS. 36, 37, 38, 39, 40, and 41 show various views of an exemplary bottom covering portion 3600 of the present disclosure, said bottom covering portion 3600 configured to cover a relative bottom of a beverage container 2900 of the present disclosure, such as shown in FIG. 29.

FIGS. 42, 43, 44, 45, 46, 47, and 48 show various views of an exemplary container 2900 of the present disclosure having an exemplary bottom covering portion 3600 coupled thereto.

FIGS. 49, 50, 51, 52, 53, 54, and 55 show various views of an exemplary container 2900 of the present disclosure having an exemplary bottom covering portion 3600 coupled thereto and with a lid 4900 coupled to container 2900.

FIGS. 56, 57, 58, 59, 60, 61, and 62 show various views of a lid 4900 of the present disclosure.

Figure 63:
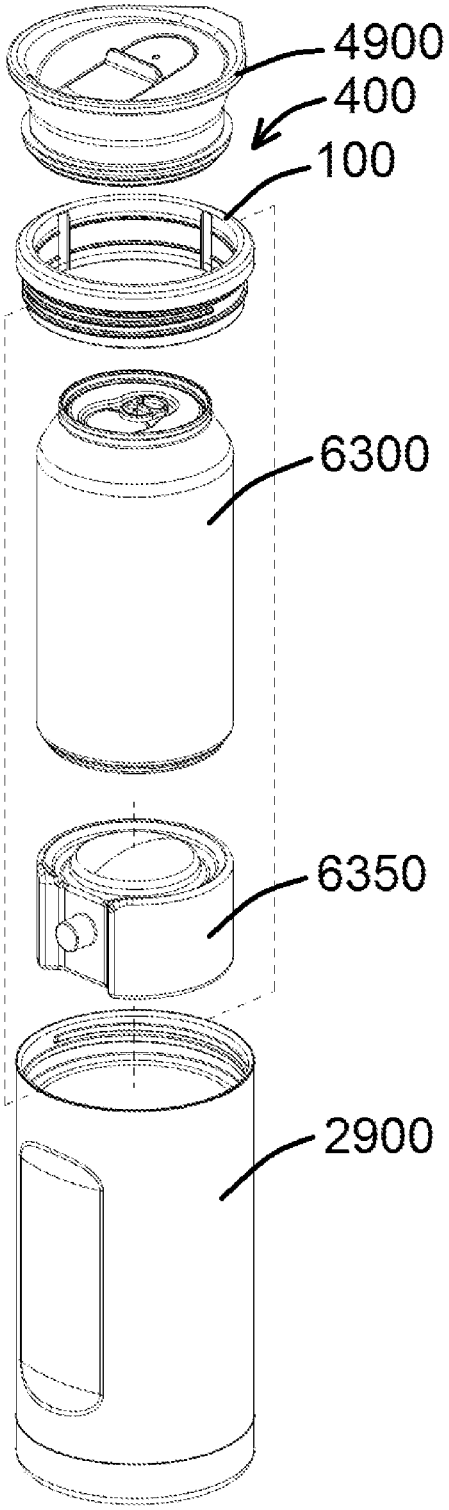
FIGS. 63 and 64 show perspective exploded views of portions of exemplary systems or kits, including beverage cans as part of the exploded views, according to embodiments of the present disclosure.
Figure 64:
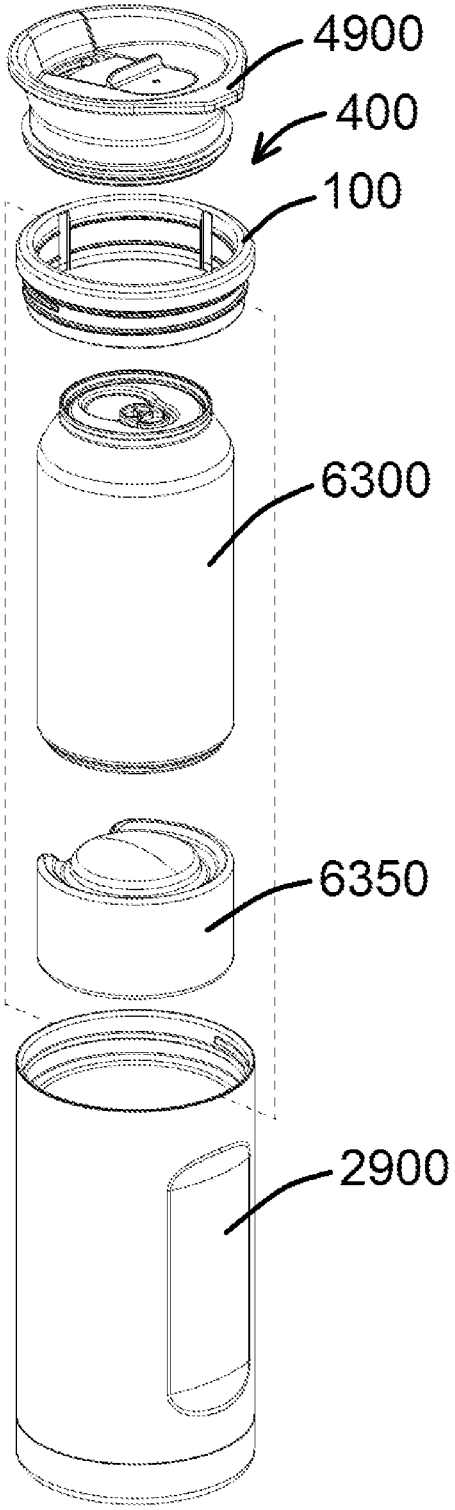

FIGS. 63 and 64 show perspective exploded views of portions of exemplary systems or kits 400 of the present disclosure, including beverage cans 6300 as part of the exploded views, according to embodiments of the present disclosure.

Figure 65:
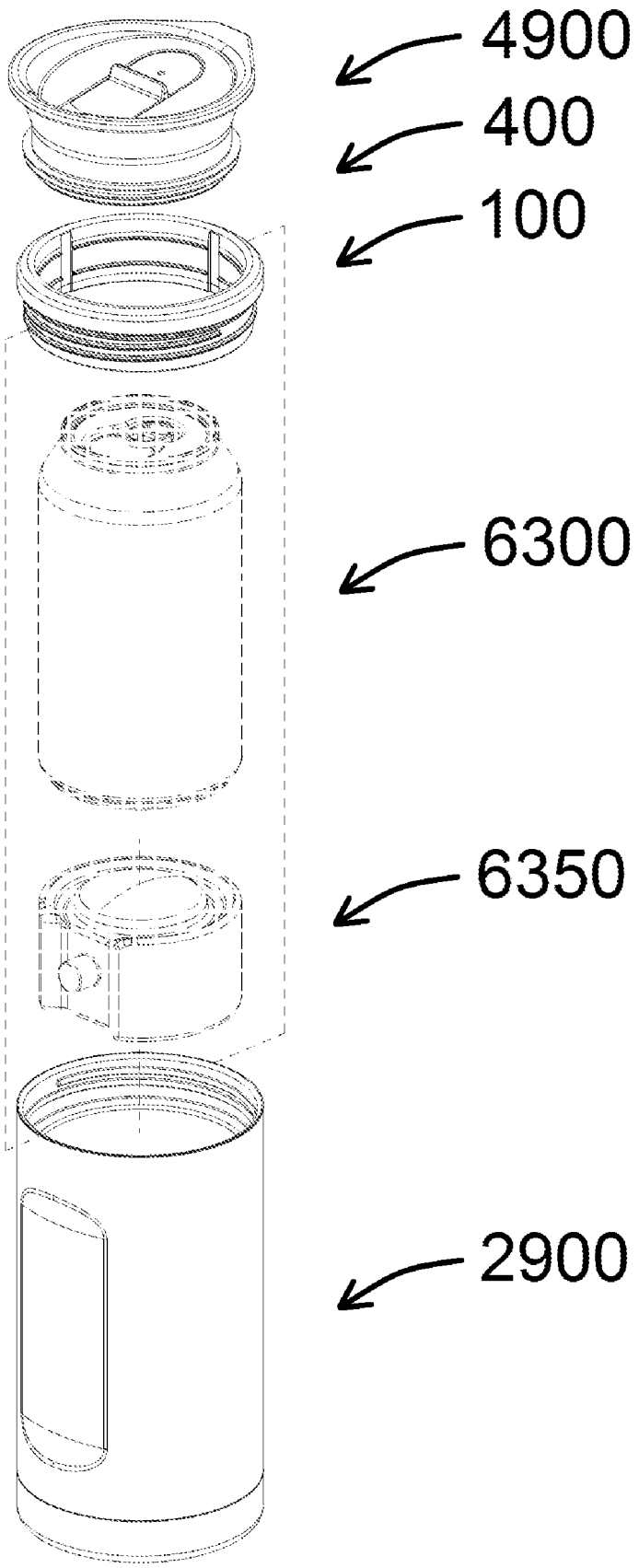
FIGS. 65 and 66 show perspective exploded views of portions of exemplary systems or kits, showing the adapter in environmental view, and including a beverage can as part of the exploded view in environmental view, according to embodiments of the present disclosure.
Figure 66:
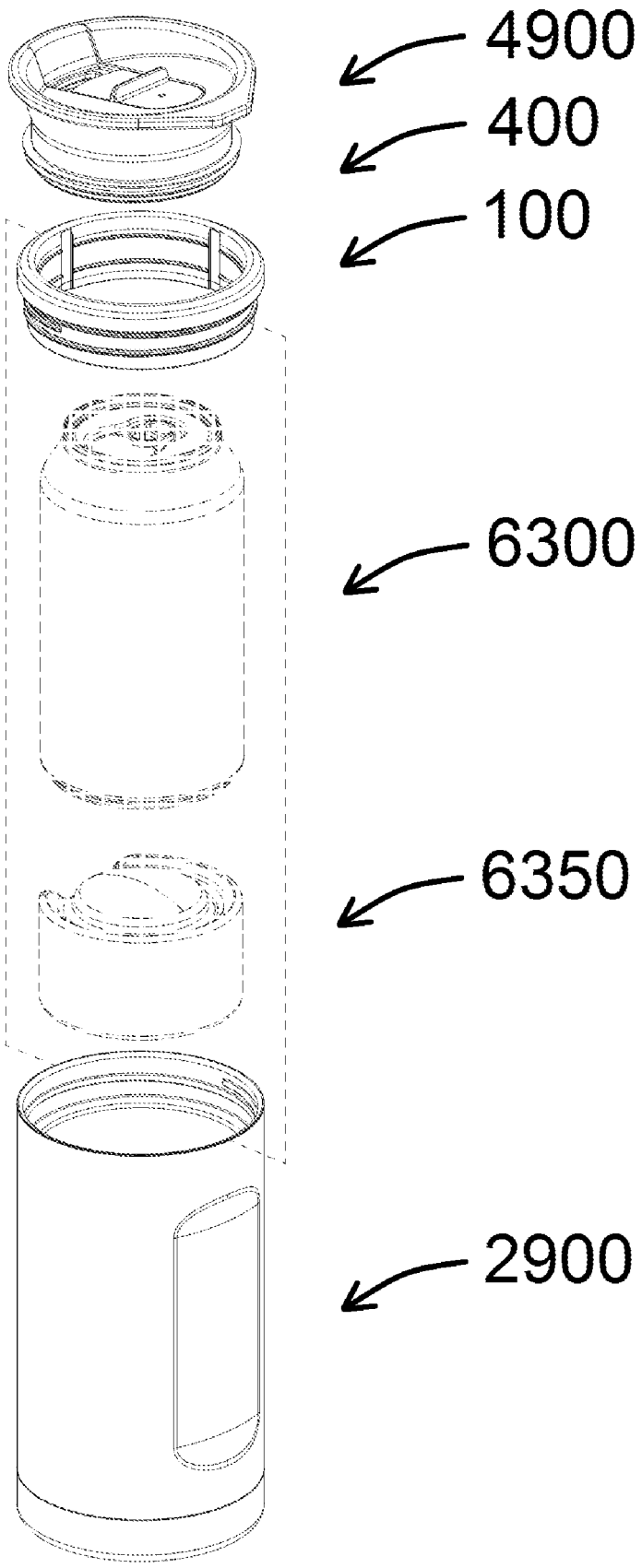

FIGS. 65 and 66 show perspective exploded views of portions of exemplary systems or kits 400 of the present disclosure, showing the adapter 6350 in environmental view, and including a beverage can 6300 as part of the exploded view in environmental view, according to embodiments of the present disclosure.

Figure 67:
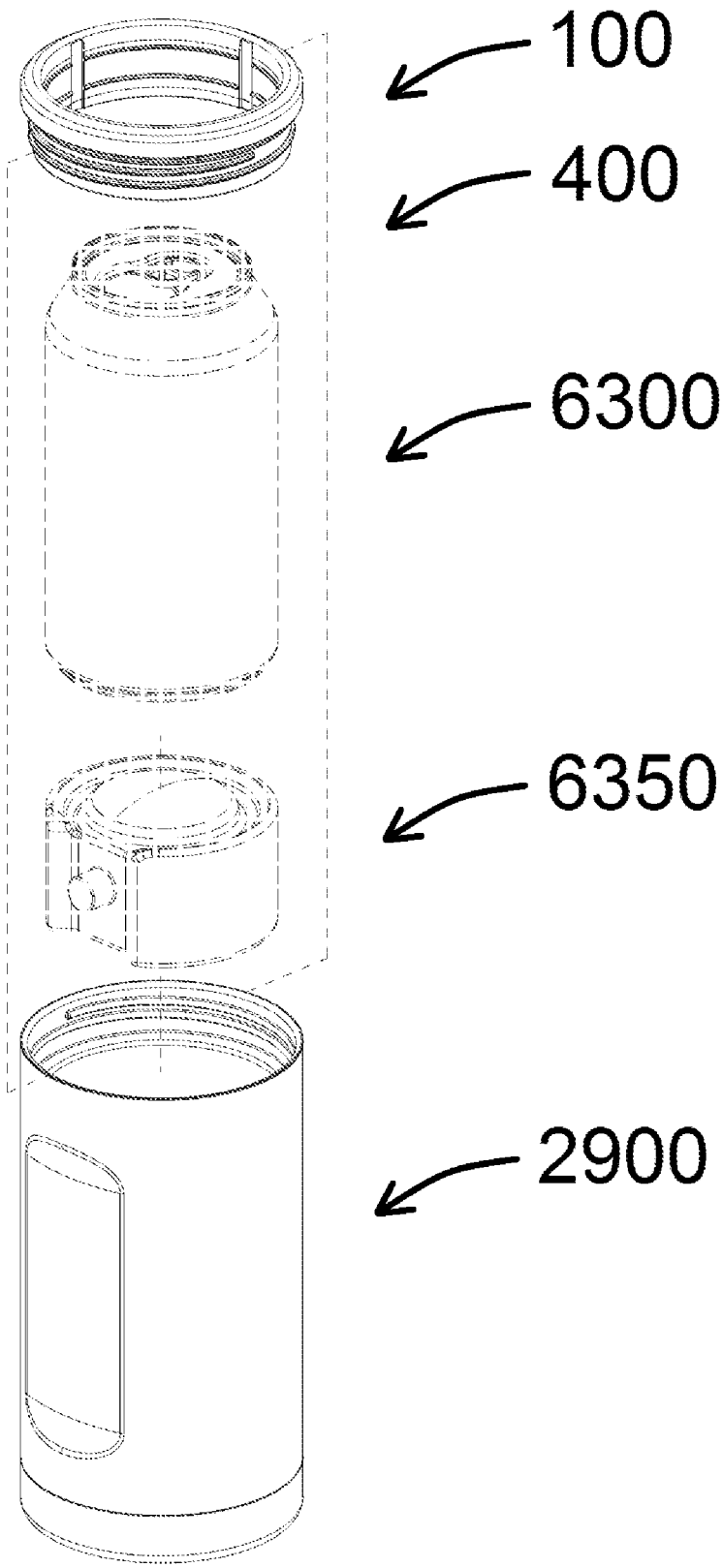
FIGS. 67 and 68 show perspective exploded views of portions of exemplary systems or kits including at least a gasket and a container, showing the adapter in environmental view, and including a beverage can as part of the exploded view in environmental view, according to embodiments of the present disclosure.
Figure 68:
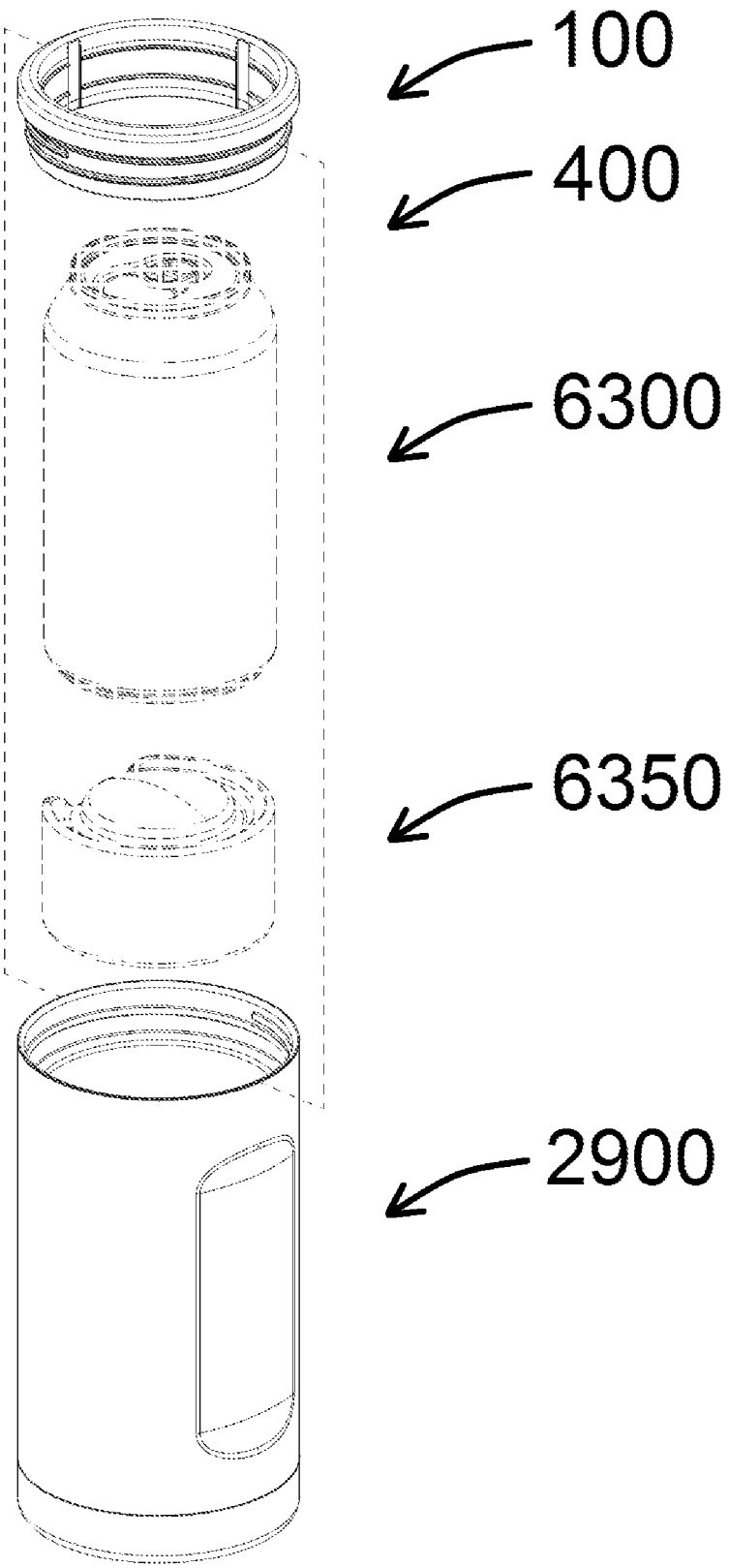

FIGS. 67 and 68 show perspective exploded views of portions of exemplary systems or kits 400 of the present disclosure including at least a gasket 100 and a container 2900, showing the adapter 6350 in environmental view, and including a beverage can 6300 as part of the exploded view in environmental view, according to embodiments of the present disclosure.

Figure 69:
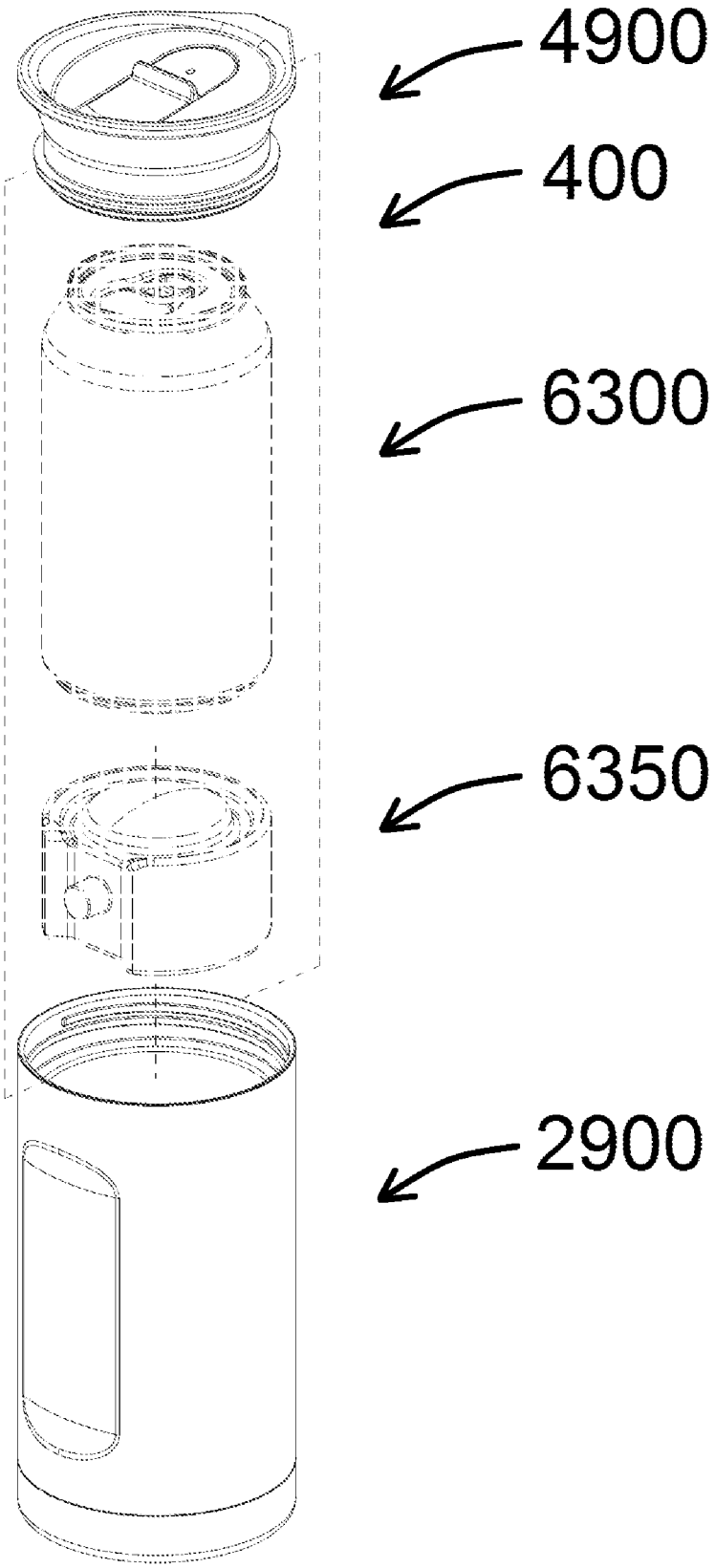
FIGS. 69 and 70 show perspective exploded views of portions of exemplary systems or kits including at least a lid and a container, showing the adapter in environmental view, and including a beverage can as part of the exploded view in environmental view, according to embodiments of the present disclosure.
Figure 70:
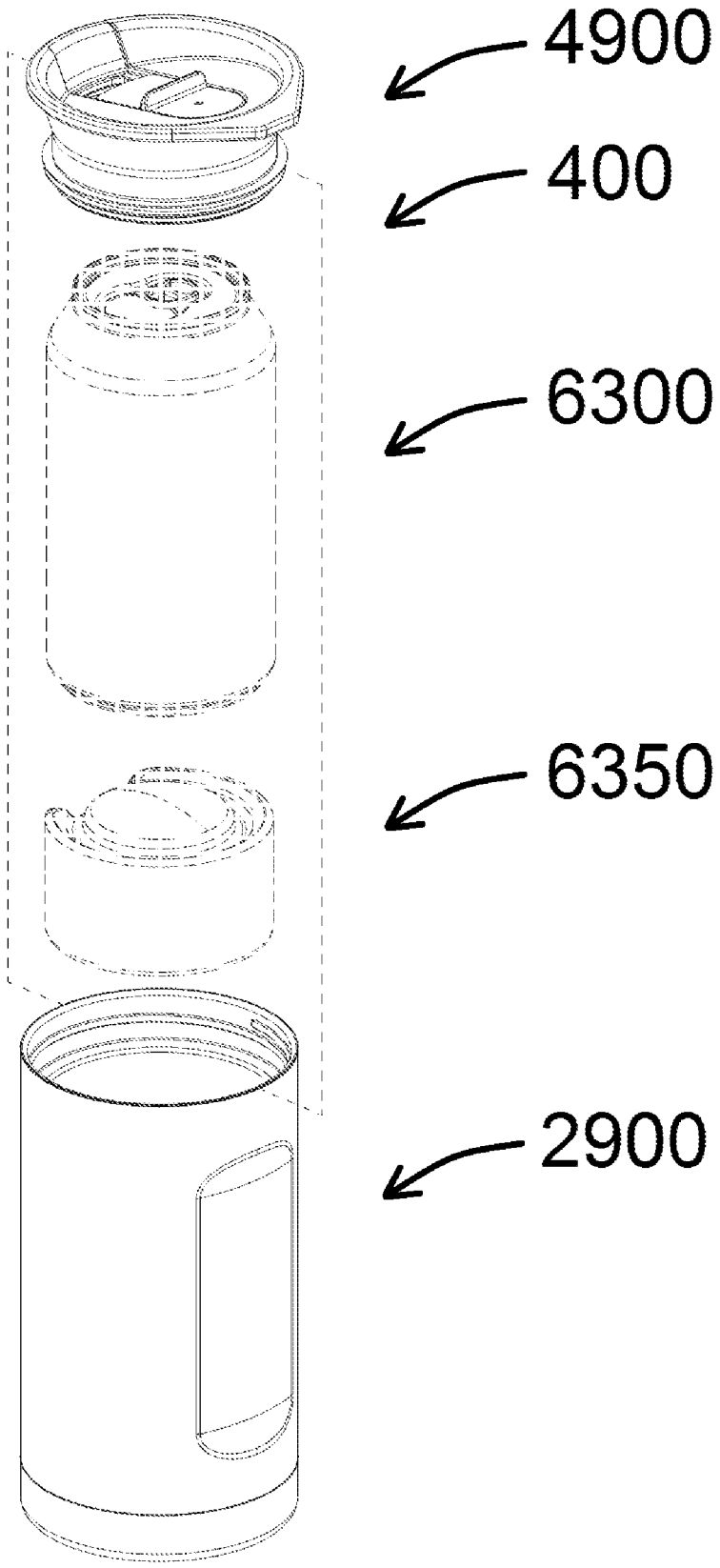

FIGS. 69 and 70 show perspective exploded views of portions of exemplary systems or kits 400 of the present disclosure including at least a lid 4900 and a container 2900, showing the adapter 6350 in environmental view, and including a beverage can 6300 as part of the exploded view in environmental view, according to embodiments of the present disclosure.

Figure 71:
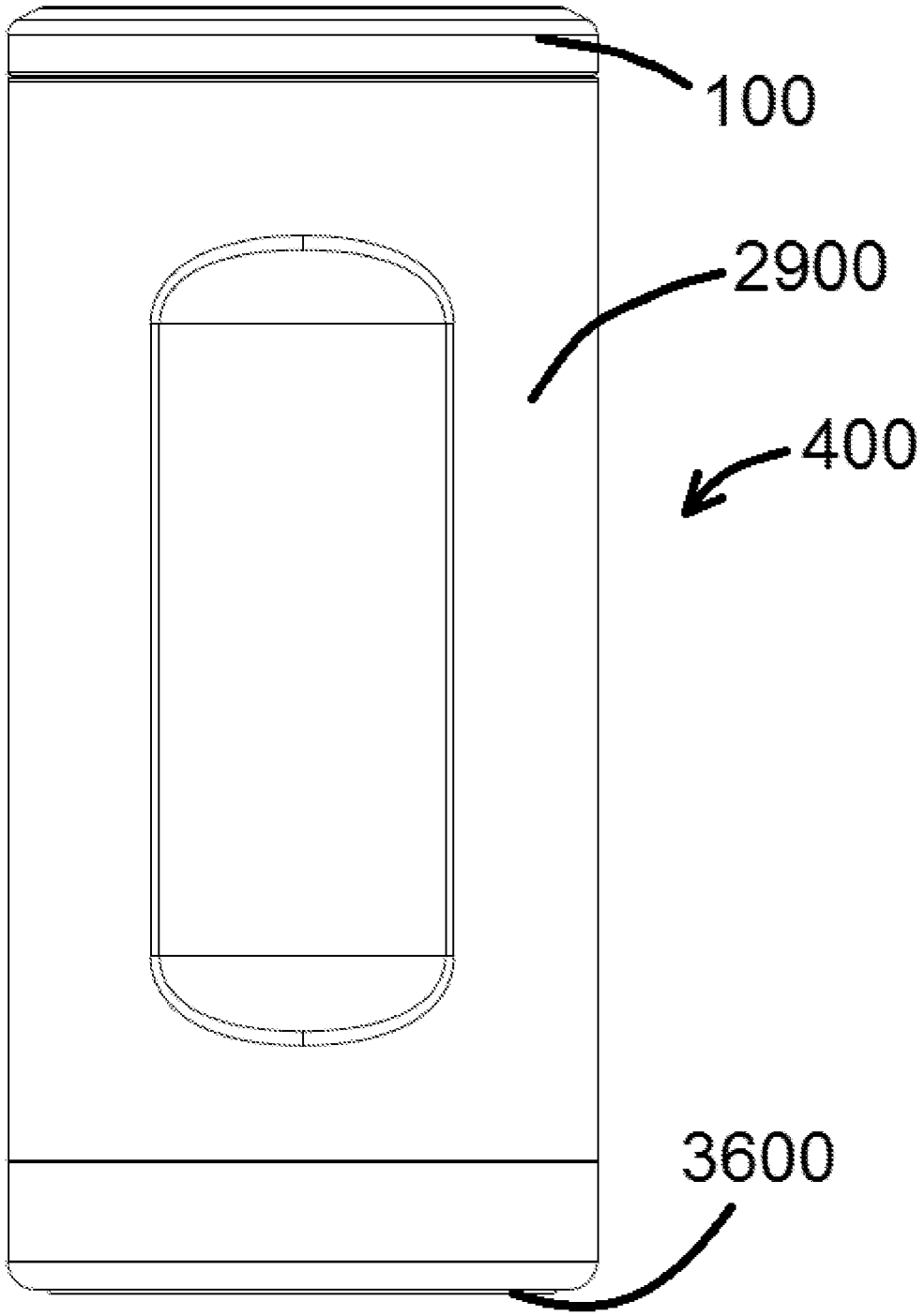
FIG. 71 shows a front view of a beverage system or kit, with a gasket and a container shown along with an optional bottom covering portion coupled to the container, according to at least one embodiment of the present disclosure.
Figure 72:
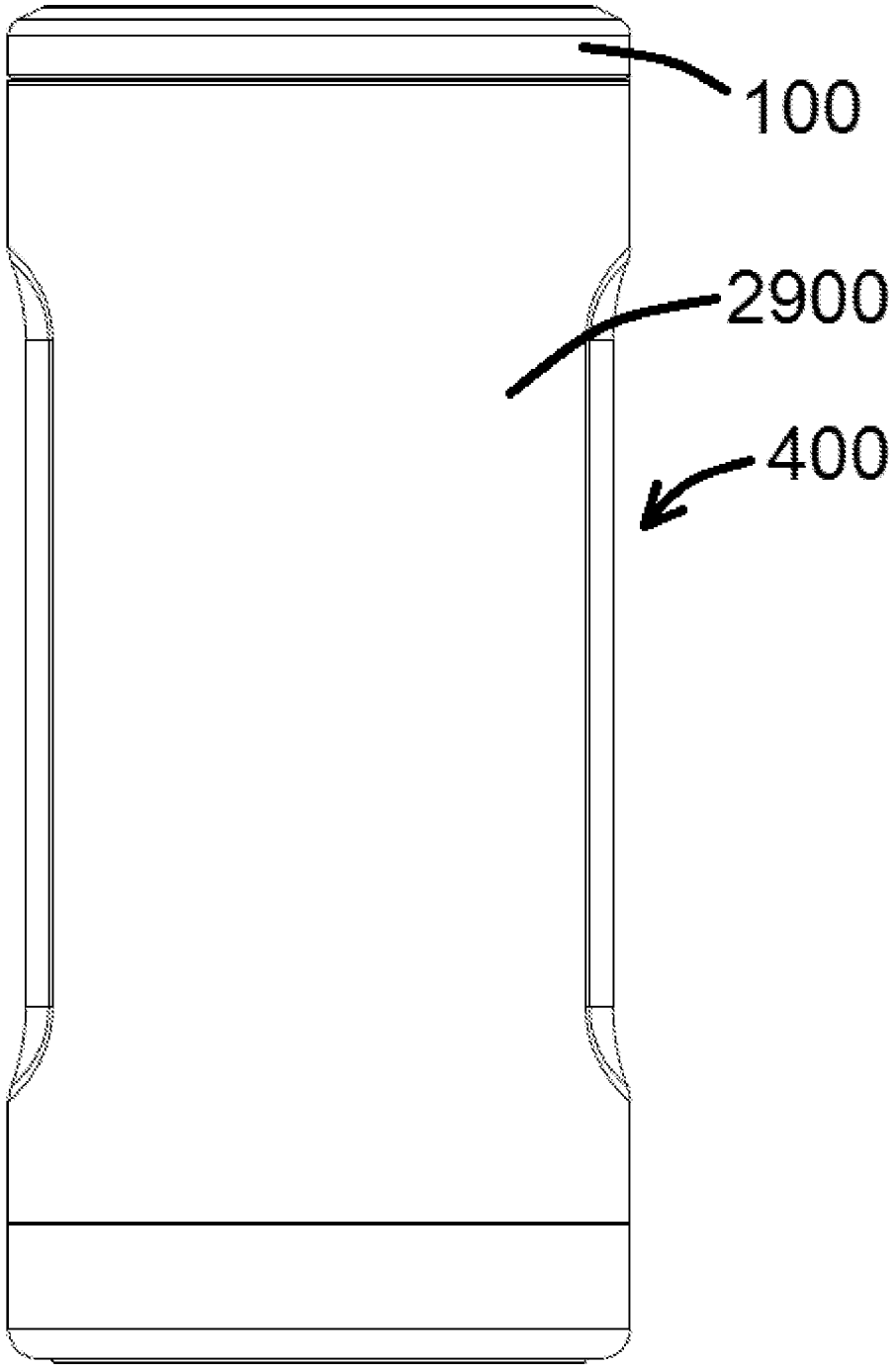
FIG. 72 shows a left side view of a beverage system or kit, with a gasket and a container shown along with an optional bottom covering portion coupled to the container, according to at least one embodiment of the present disclosure.
Figure 73:
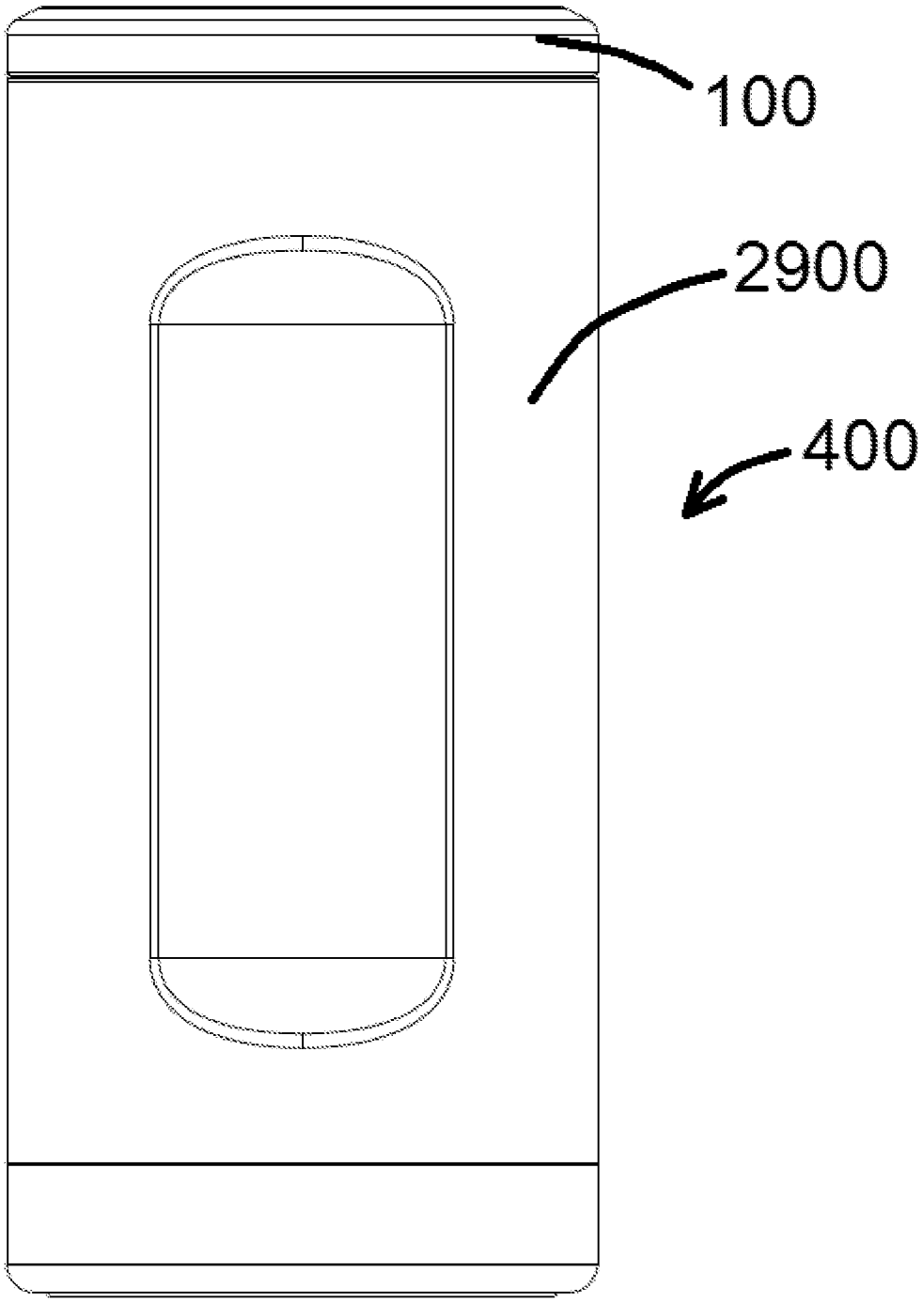
FIG. 73 shows a rear view of a beverage system or kit, with a gasket and a container shown along with an optional bottom covering portion coupled to the container, according to at least one embodiment of the present disclosure.
Figure 74:
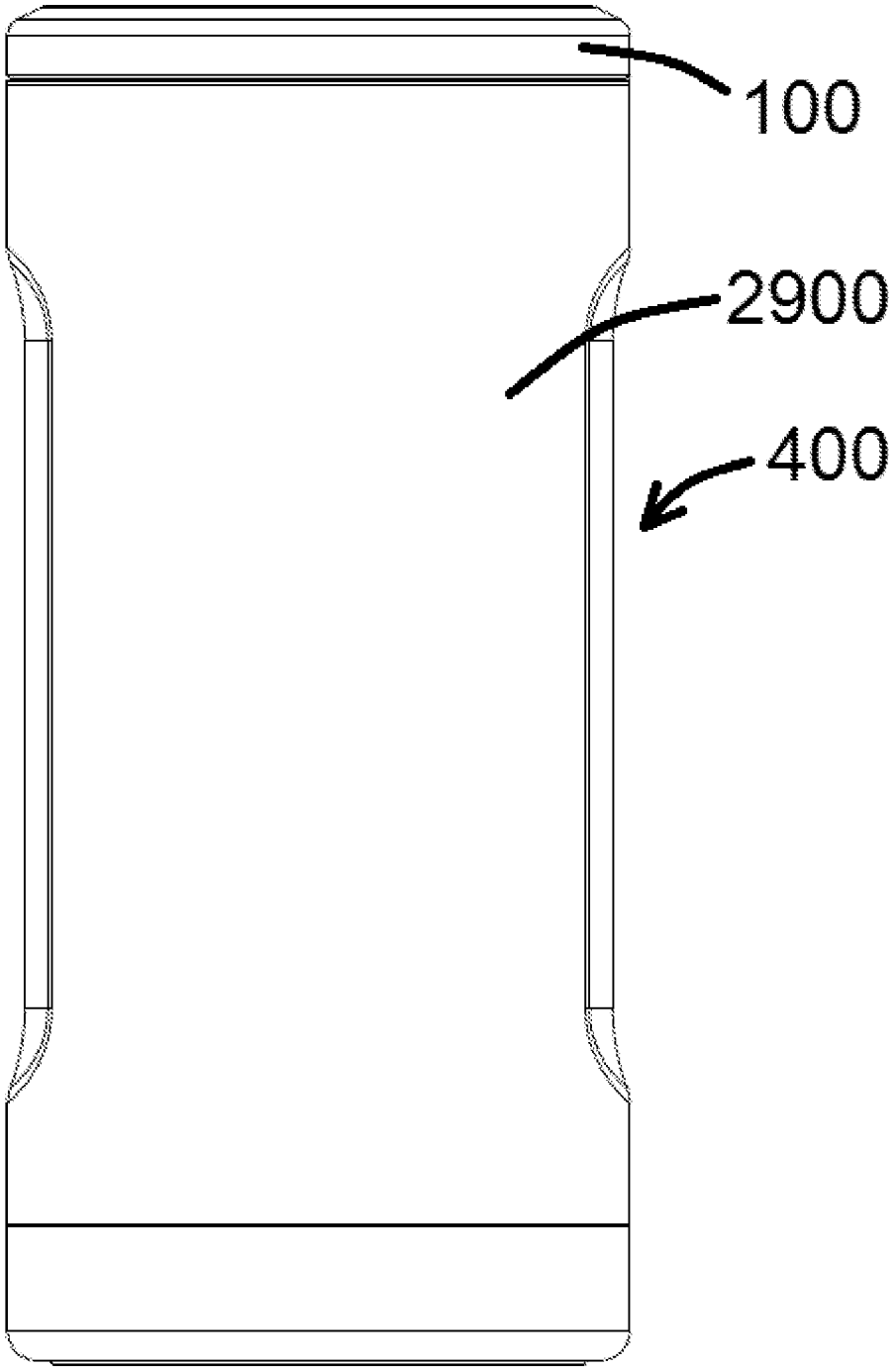
FIG. 74 shows a right side view of a beverage system or kit, with a gasket and a container shown along with an optional bottom covering portion coupled to the container, according to at least one embodiment of the present disclosure.
Figure 75:
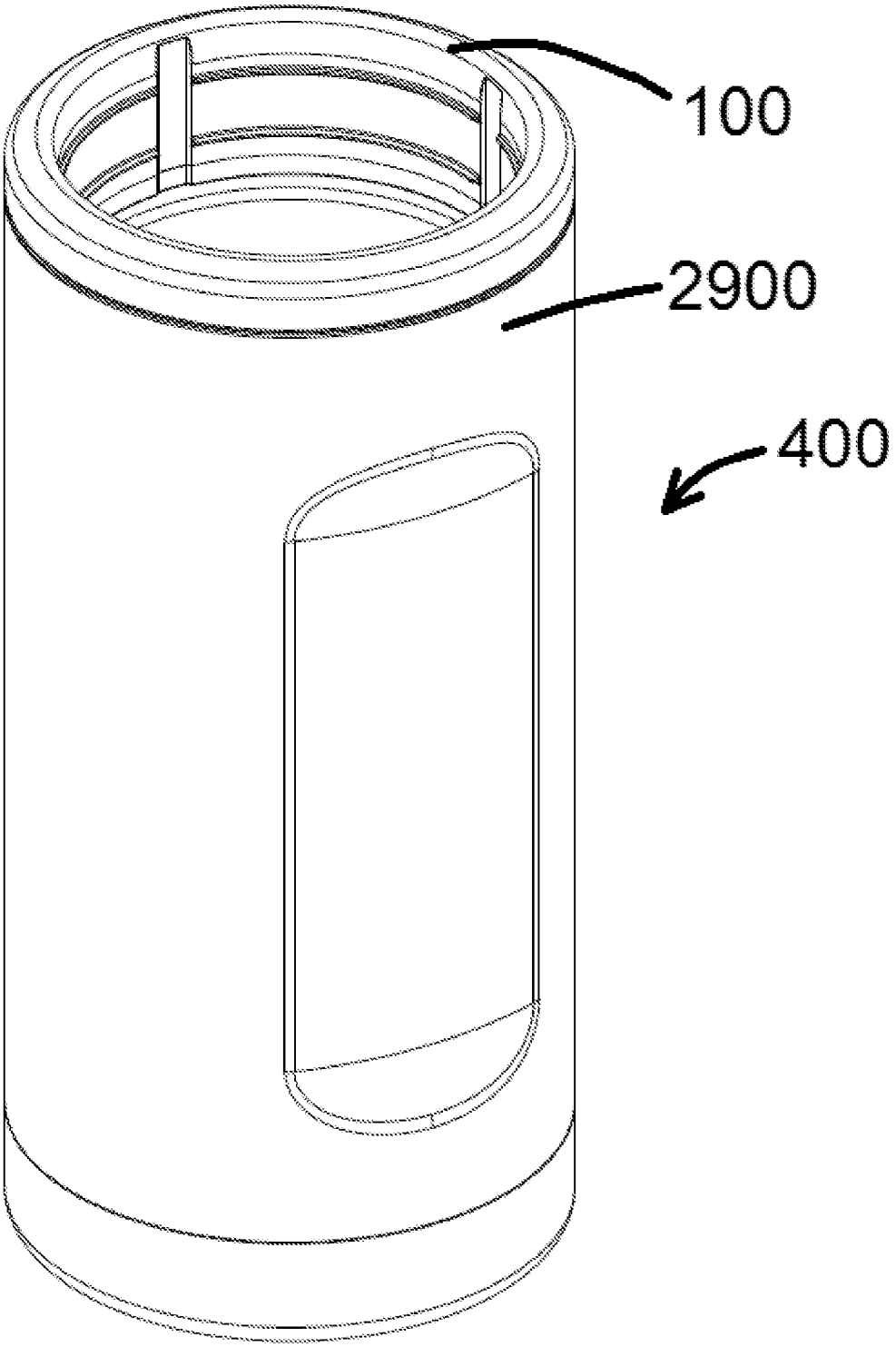
FIG. 75 shows a perspective view of a beverage system or kit, with a gasket and a container shown along with an optional bottom covering portion coupled to the container, according to at least one embodiment of the present disclosure.
Figure 76:
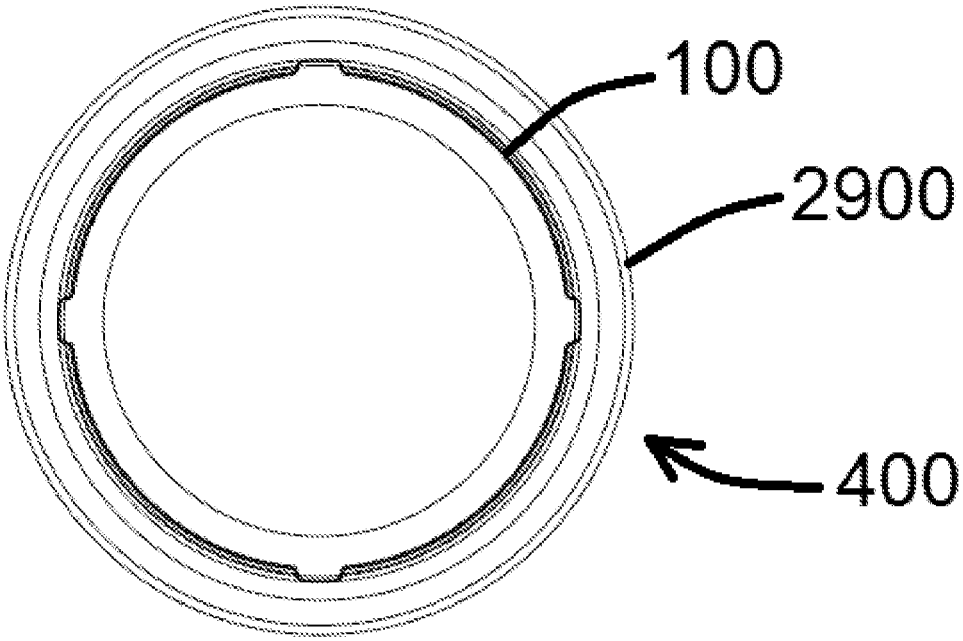
FIG. 76 shows a top view of a beverage system or kit, with a gasket and a container shown along with an optional bottom covering portion coupled to the container, according to at least one embodiment of the present disclosure.
Figure 77:
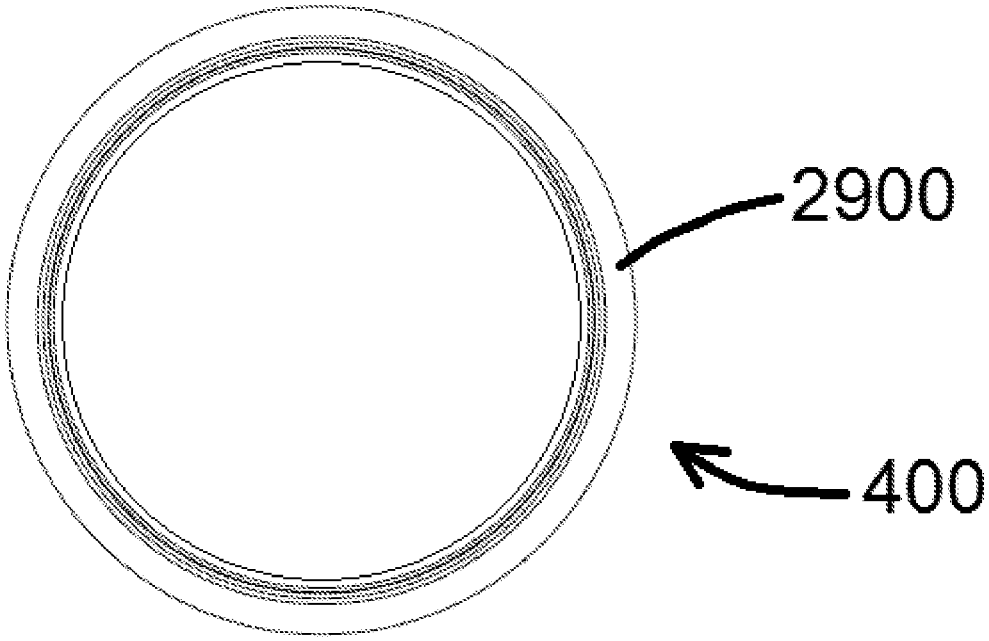
FIG. 77 shows a bottom view of a beverage system or kit, with a gasket and a container shown along with an optional bottom covering portion coupled to the container, according to at least one embodiment of the present disclosure.

FIG. 71 shows a front view of a beverage system or kit 400 of the present disclosure, with a gasket 100 and a container 2900 shown along with an optional bottom covering portion 3600 coupled to the container 2900, according to at least one embodiment of the present disclosure.

Figure 78:
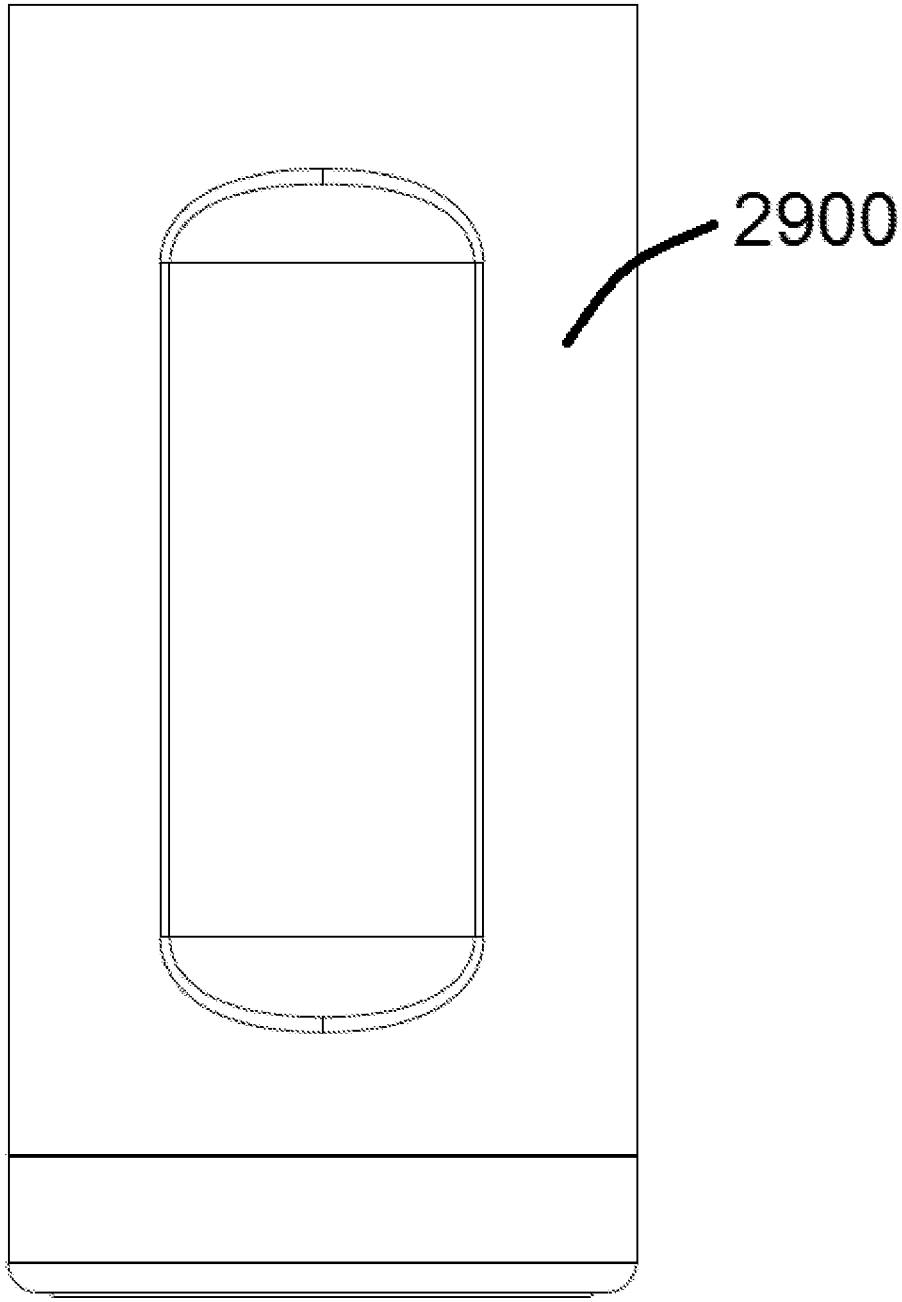
FIG. 78 shows a front view of a container, with an optional bottom covering portion coupled thereto, according to at least one embodiment of the present disclosure.
Figure 79:
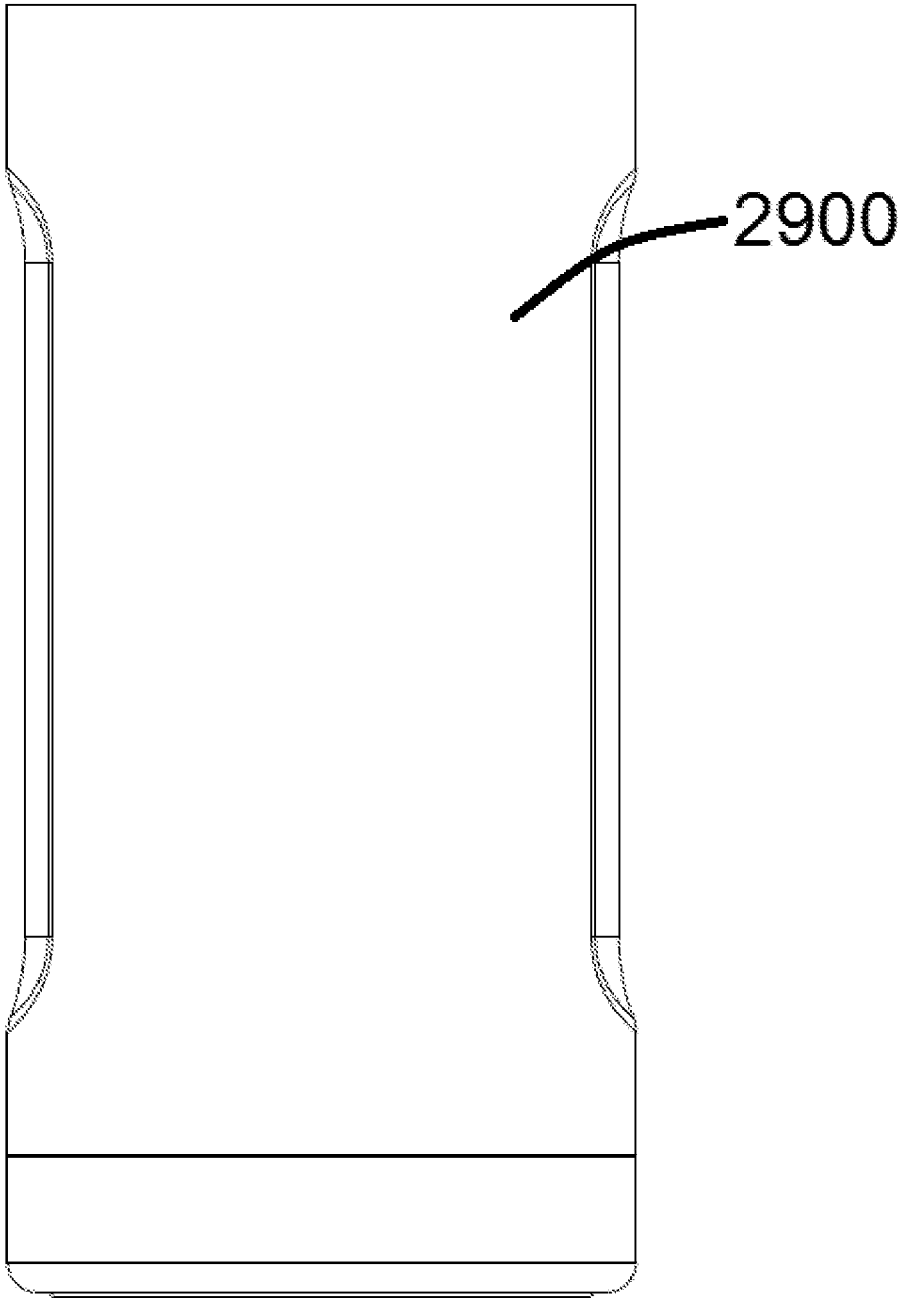
FIG. 79 shows a left side view of a container, with an optional bottom covering portion coupled thereto, according to at least one embodiment of the present disclosure.
Figure 80:
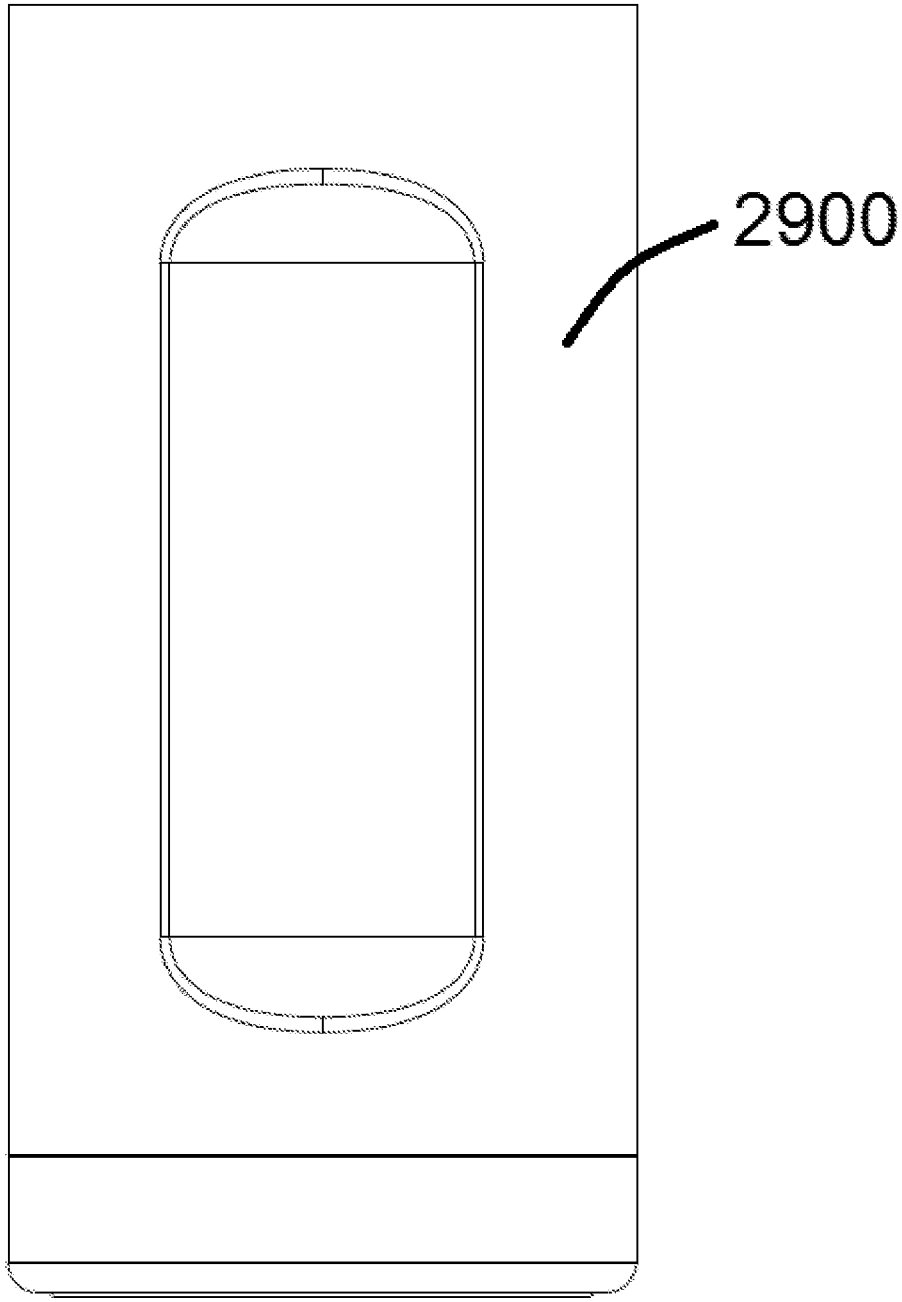
FIG. 80 shows a rear view of a container, with an optional bottom covering portion coupled thereto, according to at least one embodiment of the present disclosure.
Figure 81:
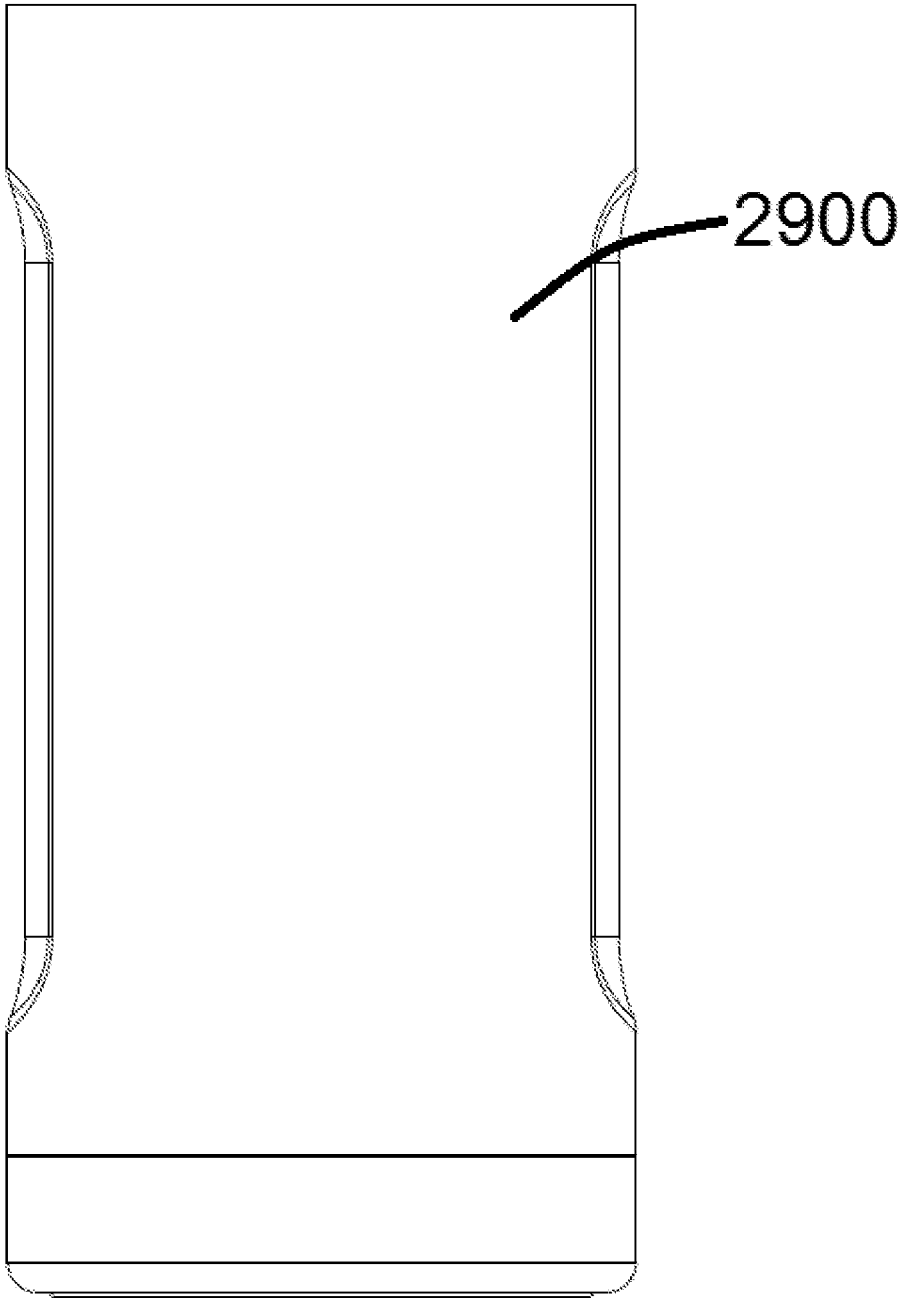
FIG. 81 shows a right side view of a container, with an optional bottom covering portion coupled thereto, according to at least one embodiment of the present disclosure.
Figure 82:
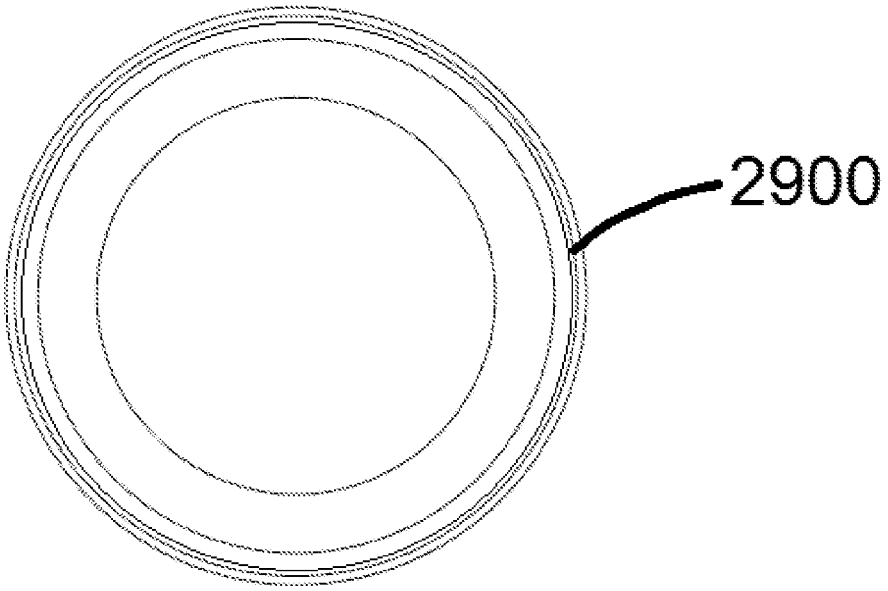
FIG. 82 shows a top view of a container, with an optional bottom covering portion coupled thereto, according to at least one embodiment of the present disclosure.
Figure 83:
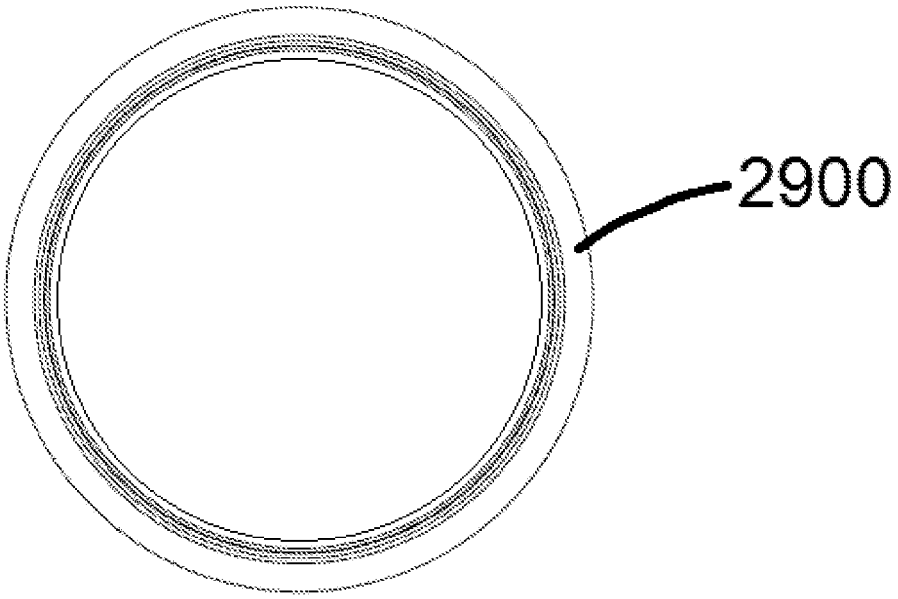
FIG. 83 shows a bottom view of a container, with an optional bottom covering portion coupled thereto, according to at least one embodiment of the present disclosure.

FIGS. 72, 73, 74, 75, 76, and 77 show various views of a beverage system or kit 400 of the present disclosure, with a gasket 100 and a container 2900 shown along with an optional bottom covering portion 3600 coupled to the container 2900, according to various embodiments of the present disclosure FIG. 78 shows a front view of a container 2900, with an optional bottom covering portion 3600 coupled thereto, according to at least one embodiment of the present disclosure.

FIGS. 79, 80, 81, 82, and 83 show various views of a container 2900, with an optional bottom covering portion 3600 coupled thereto, according to various embodiments of the present disclosure.

In view of the foregoing, the present disclosure includes disclosure of various gaskets 100 as well as various embodiments of systems or kits 100 comprising gaskets 100, beverage containers 2900, and optionally other elements/components of the present disclosure.

The invention claimed is:

1. A gasket, comprising:

a gasket body comprising a generally cylindrical shape;

at least two arcuate flanges positioned within a relative inside of the gasket body, the at least two arcuate flanges extending inward from the gasket body; and at least one gap existing between two arcuate flanges of the at least two arcuate flanges;

wherein the gasket is configured so that when the gasket is coupled to or is formed as part of a beverage container, a can of beverage can be inserted into the gasket and at least partially into said beverage container so to prevent said can of beverage from falling out of said beverage container;

wherein the at least one gap is defined within part of the gasket body so to form an indention within the gasket body.

2. The gasket of claim 1, wherein the gasket forms a portion of a beverage container.

3. The gasket of claim 1, wherein the at least two arcuate flanges are present within the same axial plane.

4. The gasket of claim 1, wherein the at least two arcuate flanges extend inward from the gasket body further than any other portion of the gasket body.

5. The gasket of claim 1, wherein the at least two arcuate flanges comprise at least four arcuate flanges, wherein the at least one gap comprises at least four gaps, and wherein each gap of the at least four gaps is present between two adjacent arcuate flanges of the at least four arcuate flanges.

6. The gasket of claim 5, wherein the at least four arcuate flanges are present within the same axial plane.

7. The gasket of claim 5, wherein a first pair of arcuate flanges of the at least four arcuate flanges exist within a first axial plane and wherein a second pair of arcuate flanges of the at least four arcuate flanges exist within a second axial plane, the first axial plane being parallel to the second axial plane.

8. The gasket of claim 5, wherein a first pair of arcuate flanges of the at least four arcuate flanges have a first pair of gaps of the at least four gaps defined or existing therebetween, and wherein the second pair of arcuate flanges of the at least four arcuate flanges have a second pair of gaps of the at least four gaps defined or existing therebetween.

9. The gasket of claim 1, wherein the at least two arcuate flanges comprise at least four arcuate flanges, wherein the at least one gap comprises at least a first gap and at least a second gap, wherein the first gap is defined or existing between a first pair of arcuate flanges of the at least four arcuate flanges exists immediately adjacent to a second gap defined or existing between a second pair of arcuate flanges of the at least four arcuate flanges.

10. The gasket of claim 9, wherein the at least one gap further comprises at least a third gap and at least a fourth gap, wherein the third gap is defined or existing between the first pair of arcuate flanges of the at least four arcuate flanges exists immediately adjacent to a fourth gap defined or existing between the second pair of arcuate flanges of the at least four arcuate flanges.

11. The gasket of claim 1, wherein the at least two arcuate flanges are configured to reversibly engage a beverage can when the gasket is coupled to a beverage container and when the beverage can is at least partially positioned within the beverage container.

12. The gasket of claim 1, forming part of a system or kit, the system or kit further comprising a beverage container, wherein the gasket is configured to be threadably coupled to the beverage container.

13. A gasket, comprising:

a gasket body comprising a generally cylindrical shape;

a first set of four arcuate flanges positioned within a relative inside of the gasket body, the first set of at least four arcuate flanges extending inward from the gasket body and present within a first axial plane;

a first set of four gaps, each gap of the first set of four gaps existing between two adjacent arcuate flanges of the first set of four arcuate flanges;

a second set of four arcuate flanges positioned within the relative inside of the gasket body, the second set of at least four arcuate flanges extending inward from the gasket body and present within a second axial plane, the second axial plane parallel to the first axial plane; and a second set of four gaps, each gap of the second set of four gaps existing between two adjacent arcuate flanges of the second set of four arcuate flanges;

wherein each gap of the first set of four gaps and each gap of the second set of four gaps is defined within part of the gasket body so to form an indention within the gasket body.

14. The gasket of claim 13, forming part of a beverage container.

15. A system or kit, comprising:

a gasket, comprising:

a gasket body comprising a generally cylindrical shape;

a first set of four arcuate flanges positioned within a relative inside of the gasket body, the first set of at least four arcuate flanges extending inward from the gasket body and present within a first axial plane;

a first set of four gaps, each gap of the first set of four gaps existing between two adjacent arcuate flanges of the first set of four arcuate flanges, wherein the at least one gap is defined within part of the gasket body so to form an indention within the gasket body;

a second set of four arcuate flanges positioned within the relative inside of the gasket body, the second set of at least four arcuate flanges extending inward from the gasket body and present within a second axial plane, the second axial plane parallel to the first axial plane; and a second set of four gaps, each gap of the second set of four gaps existing between two adjacent arcuate flanges of the second set of four arcuate flanges; and a beverage container;

wherein the gasket is configured to be threadably coupled to the beverage container.

16. The system or kit of claim 15, further comprising:

a lid configured to reversibly engage an internal portion of the beverage container when the gasket is not threadably coupled to the beverage container.

17. The system or kit of claim 16, further comprising:

an adapter configured to be positioned within the beverage container prior to a beverage can being at least partially positioned within the beverage container;

wherein the gasket is configured to be threadably coupled to the beverage container when the beverage can is at least partially positioned within the beverage container.

* * * * *